US010843716B2

(12) United States Patent
Ghaly

(10) Patent No.: US 10,843,716 B2
(45) Date of Patent: Nov. 24, 2020

(54) METHOD AND APPARATUS FOR AN INTERLOCKING CONTROL DEVICE

(71) Applicant: Siemens Industry, Inc., Alpharetta, GA (US)

(72) Inventor: Nabil Ghaly, South Huntington, NY (US)

(73) Assignee: Siemens Mobility, Inc., New York, NY (US)

( * ) Notice: Subject to any disclaimer, the term of this patent is extended or adjusted under 35 U.S.C. 154(b) by 337 days.

(21) Appl. No.: 15/646,875

(22) Filed: Jul. 11, 2017

(65) Prior Publication Data

US 2017/0305447 A1 Oct. 26, 2017

Related U.S. Application Data

(63) Continuation of application No. 14/149,972, filed on Jan. 8, 2014, now Pat. No. 9,731,733, which is a continuation of application No. 13/506,358, filed on Apr. 13, 2012, now Pat. No. 8,695,927, which is a continuation of application No. 12/313,757, filed on Nov. 24, 2008, now Pat. No. 8,214,092.

(60) Provisional application No. 61/004,824, filed on Nov. 30, 2007.

(51) Int. Cl.
*B61L 19/06* (2006.01)

(52) U.S. Cl.
CPC ..... *B61L 19/06* (2013.01); *B61L 2019/065* (2013.01)

(58) Field of Classification Search
CPC ..... B61L 19/06; B61L 2019/065
See application file for complete search history.

(56) References Cited

U.S. PATENT DOCUMENTS 4,327,415 A * 4/1982 Rush ..... B61L 27/04 246/187 C
5,437,422 A * 8/1995 Newman ..... B61L 27/0038 246/5
5,467,945 A * 11/1995 Kubota ..... B61L 19/06 246/187 B
5,533,695 A * 7/1996 Heggestad ..... B61L 3/125 246/1 R
6,032,905 A * 3/2000 Haynie ..... B61L 27/0038 246/167 R
6,246,956 B1 * 6/2001 Miyoshi ..... B61L 23/16 246/182 R (Continued)

*Primary Examiner* — Zachary L Kuhfuss

(57) ABSTRACT

A distributed interlocking device, architecture and process are disclosed, and are based on segregating vital logic for a signal installation by type of signal equipment. A plurality of intelligent signal devices is disclosed, wherein each intelligent signal device is used to control a basic signal unit. A signal unit includes a set of signal apparatuses that are geographically and logically interrelated. An intelligent signal device receives data related to the states of other signal devices, determines and controls its own operational states, and communicates its own operational states to other devices. A generic intelligent signal device is also disclosed. Further, a plurality of new concepts, and signal control functions are provided, and include a vital change management process, and a failure recovery scheme based on dynamic reconfiguration of home and distant control functions.

12 Claims, 68 Drawing Sheets

(56) References Cited

U.S. PATENT DOCUMENTS 6,556,898 B2 * 4/2003 Clawson ..... B61L 21/04 104/130.01
6,580,976 B1 * 6/2003 Belcea ..... B60T 7/128 340/988
6,694,231 B1 * 2/2004 Rezk ..... B61L 15/0045 701/19
7,006,012 B2 * 2/2006 Taoka ..... B60L 3/0015 246/122 R
7,222,003 B2 * 5/2007 Stull ..... B61L 15/0027 701/19
7,269,487 B2 * 9/2007 Watanabe ..... B61L 1/18 246/122 R
7,539,624 B2 * 5/2009 Matheson ..... B61L 27/0016 705/7.22
7,731,129 B2 * 6/2010 Stull ..... B61L 27/0005 246/167 R
8,200,380 B2 * 6/2012 Ghaly ..... B61L 3/008 701/19
8,214,092 B2 * 7/2012 Ghaly ..... B61L 19/06 701/19
8,428,798 B2 * 4/2013 Kull ..... B61L 15/0027 246/167 R
8,478,463 B2 * 7/2013 Knott ..... B61L 3/221 246/167 R
8,548,654 B2 * 10/2013 Katsuta ..... B61L 27/0038 246/177
8,651,433 B2 * 2/2014 Ghaly ..... B61L 3/008 246/167 R
8,695,927 B2 * 4/2014 Ghaly ..... B61L 19/06 246/28 R
9,290,191 B2 * 3/2016 Ghaly ..... B61L 3/008
9,718,487 B2 * 8/2017 Ghaly ..... B61L 27/0055
9,731,733 B2 * 8/2017 Ghaly ..... B61L 19/06
10,232,866 B2 * 3/2019 Ghaly ..... B61L 27/0055
2005/0001741 A1 * 1/2005 Taoka ..... B60L 3/0015 340/933
2007/0162199 A1 * 7/2007 Katsuta ..... B61L 27/0038 701/19
2009/0230255 A1 * 9/2009 Lemonovich ..... G06F 15/17 246/167 R
2010/0258682 A1 * 10/2010 Fries ..... B61L 3/121 246/1 C
2016/0046306 A1 * 2/2016 Miyajima ..... B60L 15/40 701/19
2017/0113707 A1 * 4/2017 Ghaly ..... B61L 3/16
2017/0305447 A1 * 10/2017 Ghaly ..... B61L 19/06
2019/0168788 A1 * 6/2019 Ghaly ..... B61L 27/0055

* cited by examiner

Generic Automatic Signal Unit

GENERIC AUTOMATIC SIGNAL UNIT

| HOME CONTROL FUNCTION | | |
|---|---|---|
| XXXXH | ALWAYS ACTIVATED | CORE FUNCTION |
| KEY-BY ONLY | ACTIVATED | NOT ACTIVATED |
| CYCLE CHECK | ACTIVATED | NOT ACTIVATED |
| TRAIN SEPARATION | ACTIVATED | NOT ACTIVATED |
| STATION TIME CONTROL | ACTIVATED | NOT ACTIVATED |
| GRADE TIME CONTROL | ACTIVATED | NOT ACTIVATED |
| TEMP SPEED RESTRICTION | ENABLED | NOT ENABLED |
| TIMER BACK CHECK | ACTIVATED | NOT ACTIVATED |
| DIRECTIONAL CONTROL | ACTIVATED | NOT ACTIVATED |
| CBTC INTERFACE | ACTIVATED | NOT ACTIVATED |

102

108

FIG. 26

| SIGNAL LIGHTING FUNCTION | | | |
|---|---|---|---|
| SECONDARY CONTROL PARAMETERS | | | INTERNAL FUNCTION |
| RED ASPECT | ACTIVATED | NOT ACTIVATED | NOT USED |
| YELLOW ASPECT | ACTIVATED | NOT ACTIVATED | NOT USED |
| GREEN ASPECT | ACTIVATED | NOT ACTIVATED | NOT USED |
| ??MPH ASPECT | ACTIVATED | NOT ACTIVATED | XXXXSTR |
| LUNAR WHITE | ACTIVATED | NOT ACTIVATED | XXXXSH |
| CBTC INTERFACE | ACTIVATED | NOT ACTIVATED | NOT USED |
| S ASPECT | ACTIVATED | NOT ACTIVATED | XXXXS |
| D ASPECT | ACTIVATED | NOT ACTIVATED | XXXXD |
| LIGHT OUT FUNCTION | ACTIVATED | NOT ACTIVATED | XXXXLOR |

FIG. 36

STOP CONTROL FUNCTION

| XXXXV | ALWAYS ACTIVATED | CORE FUNCTION |
|---|---|---|
| DIRECTIONAL CONTROL | ACTIVATED | NOT ACTIVATED |
| CBTC INTERFACE | ACTIVATED | NOT ACTIVATED |
| COMBINATION HV | ACTIVATED | NOT ACTIVATED |
| CENTRAL KEY-BY CONTROL | ACTIVATED | NOT ACTIVATED |
| KEY-BY TIMER | ACTIVATED | NOT ACTIVATED |

143

FIG. 43

| DETECTION BLOCK FUNCTIONS | | |
|---|---|---|
| TRACK CIRCUIT REPEATER | ACTIVATED | NOT ACTIVATED |
| ARB | ACTIVATED | NOT ACTIVATED |
| NRB | ACTIVATED | NOT ACTIVATED |
| LOSS OF SHUNT | ACTIVATED | NOT ACTIVATED |

FIG. 48

| INDICATION FUNCTIONS | | |
|---|---|---|
| OVERRUN DETECTION | ACTIVATED | NOT ACTIVATED |
| TRACK CIRCUIT INDICATION | ACTIVATED | NOT ACTIVATED |
| ARB INDICATION | ACTIVATED | NOT ACTIVATED |
| NRB INDICATION | ACTIVATED | NOT ACTIVATED |
| SIGNAL INDICATION | ACTIVATED | NOT ACTIVATED |
| STOP INDICATION | ACTIVATED | NOT ACTIVATED |
| LIGHT OUT INDICATION | ACTIVATED | NOT ACTIVATED |

FIG. 50

| Function | Approach Signal - Main Parameters | | | | | | |
|---|---|---|---|---|---|---|---|
| Home | CBTC Interface | Cycle Check | Train Separation | Station Time | Grade Time | Temp. Speed | Timer Back Check |
| | Trailing Switch | Facing Switch | Route Locking | Traffic Control | a-b-c | | |
| Stop | Directional Control | Combination HV | Central Key By | Key By Timer | CBTC Interface | Stop Contr. Stick - VS | |
| Signal Lighting | Red | Yellow | Green | Lunar White | ??MPH | S & D | Light Out |
| Distant | No Distant | a-b-c | | | | | |
| Red Signal Repeater | a-b-c | | | | | | |
| Push Button Stick | Opposing Route | Slotting | | | | | |
| Detection Block | Track Repeater | ARB | NRB | Loss of Shunt | | | |
| Approach Lock | Approach Limit | Quick Release | Time Lock | a-b-c | Trailing Switch | | |
| Indication | Overrun Detection | Track Circuit | ARB | NRB | Signal | Stop | Light Out |
| Control | Clear | Cancel | Fleet | Cancel Fleet | Temp. Speed | Central Key By | |

FIG. 52

| Function | Home Signal - Main Parameters | | | | | | |
|---|---|---|---|---|---|---|---|
| Home | Route 1 | Route 2 | Route 3 | Route 4 | a-b | Temp. Speed | Call On |
| Red Signal Repeater | a-b | | | | | | |
| Stop | Directional Control | Combination HV | Stop Release | Key By Timer | CBTC Interface | | |
| Signal Lighting | Track | Route | 3 Yellow | Call-On | ??MPH | Lunar White | Light Out |
| Distant | Route 1 | Route2 | Route 3 | Route 4 | Route 5 | Route 6 | |
| Home Slotting | Cycle Check | Route 1 | Route 2 | Route 3 | Route 4 | | |
| Detection Block | Track Repeater | ARB | NRB | Loss of Shunt | | | |
| Approach Lock | Approach Limit | Quick Release | Time Lock | Route | | | |
| Route Lock | North | South | Trigger Signals | Cascade Route Lock | | | |
| Indication | Overrun Detection | Track Circuit | ARB | NRB | Signal | Stop | Light Out |
| Control | Clear | Cancel | Fleet | Cancel Fleet | Temp. Speed | Central Key By | |

FIG. 53

| Function | Switch - Main Parameters | | | | | | |
|---|---|---|---|---|---|---|---|
| Switch Lock | CBTC Interface | NVP Check | Detector Lock | Approach Lock | Route Lock | Conditional Lock | Overlap Lock |
| | Emergency Release | Loss of Shunt | | | | | |
| Switch Control | Single/ Double | | | | | | |
| Switch Selector | Approach Signals | Exits | Single/ Double | | | | |
| Switch Correspondence | Single/ Double | | | | | | |
| Switch Repeater | Single/ Double | Electric/ Air | | | | | |
| Switch Operation | Electric/ Air | Single/ Double | | | | | |
| Emergency Release | Approach Signals | Home Signals | Switch # 1 | Switch # 2 | Switch # 3 | Switch # 4 | |
| Indication | Out of Corresp. | Normal | Reverse | Locked | Overload | | |
| Control | Normal | Reverse | Emergency Release | | | | |

FIG. 54 xxx VITAL PROCESSOR MODULE

| EXPORT DATA – SHEET4 | | | | |
|---|---|---|---|---|
| DATA | PARAMETER1 | PARAMETER2 | DESTINATION ADDRESS | |
| ASU-VSD | | | ADVANCE SIGNAL | PLC |
| | | | | |
| U(TSR) | TSR ACTIVATED | | ADVANCE SIGNAL | |
| US(GT) | GRADE TIME ACTIVATED | FIRST SHOT GT ACTIVATED | ADVANCE SIGNAL | |
| U(GT) | GRADE TIME ACTIVATED | SECOND SHOT GT ACTIVATED | ADVANCE SIGNAL | |
| US(ST) | STATION TIME ACTIVATED | FIRST SHOT ST ACTIVATED | ADVANCE SIGNAL | |
| U(ST) | STATION TIME ACTIVATED | FIRST SHOT ST ACTIVATED | ADVANCE SIGNAL | |

FIG. 62

METHOD AND APPARATUS FOR AN INTERLOCKING CONTROL DEVICE

CROSS REFERENCE TO RELATED APPLICATIONS

This is a continuation application of patent application U.S. Ser. No. 14/149,972, filed in the Patent and Trademark Office on Jan. 8, 2014, which is a continuation of U.S. Ser. No. 13/506,358, filed in the Patent and Trademark Office on Apr. 13, 2012, and which was issued as U.S. Pat. No. 8,695,972, which is a continuation of U.S. Ser. No. 12/313,757, filed in the Patent and Trademark Office on Nov. 24, 2008, and which was issued as U.S. Pat. No. 8,214,092, which benefits from provisional application U.S. Ser. No. 61/004,824 filed in the Patent and Trademark Office on Nov. 30, 2007.

BACKGROUND OF THE INVENTION

Field of the Invention

This invention relates generally to train control systems, and more specifically to a distributed solid state interlocking that includes a plurality of intelligent wayside signal devices such as track circuits, signal aspects, traffic controllers, track switch machines, automatic train stop machines, etc. An intelligent signal device makes its own determination related to the functionality and operation of the device, and continuously monitors its own state. For example, an intelligent signal determines its own aspect, and the position of its associated stop mechanism when used in transit applications. Similarly, an intelligent switch determines if the switch should be locked or not, and monitors the position and status of the switch. The intelligent wayside devices are interconnected together by a data network to detect train movements, and provide safe operation of trains through interlockings, as well as in automatic block signal controlled territory.

Description of Prior Art

Solid State Interlockings (SSI), a.k.a. Electronic Interlockings, are well known and have evolved from the relay-based interlockings that are widely used at various railroads, and transit properties around the world. Typically, a solid state interlocking consists of a centralized vital processor that controls a plurality of signal peripherals, including signal aspects, track switch machines, automatic trip stop devices, and the like. The prior art employs a safety critical software logic that executes on the vital processor, and which is based either on Boolean equations that emulates conventional relay logic or, in the alternative, on a set of interlocking rules that are applied to a vital data base that describes the interlocking configuration. However, all Solid State Interlockings described in the prior art share the common characteristic of having the safety critical software logic executes on a central vital processor, which in turn controls various I/O devices that interface with office and wayside signal peripherals. Such interfaces to wayside signal apparatuses are normally implemented using copper cables from the centralized processor location to the various field locations where the signal apparatuses or peripherals are installed.

This centralized architecture employed by the prior art has a number of limitations and disadvantages. First, the implementation of a centralized interlocking configuration requires the installation of a large number of copper cables that interconnects the I/O ports of the centralized interlocking processor to the various signal peripherals at field locations. Such copper cables are expensive to furnish, install, test, and maintain. These copper installations require maintenance and protection against grounds, crosses, and other electrical faults. The Federal Railroad Administration (FRA) requires periodic testing of these cables to ensure the integrity of the signal installations. Further, copper installations are susceptible to electro-magnetic interference, and require shielding.

Second, the centralized architecture is susceptible to catastrophic failures, which normally cause a decommissioning of an entire interlocking. While there are a number of redundancy schemes that could be used to decrease the probability of such catastrophic failures, a catastrophic failure could still occur because of a common software fault, or due to external factors such as human error, grounding faults, lightening, or other electrical spikes.

Third, for a medium or a large size interlocking, the system response time is generally slower than the response time provided by a relay installation. This is mainly due to communication delays/time outs between the centralized processor & I/O boards, redundancy configurations to comply with hot standby requirements, and the I/O interfaces to the various signal peripherals. Also, slower response time occurs as a result of the processing time required for of a plurality of iterations of the entire interlocking logic software, and to implement safety features such as vital shutdown of the centralized processor.

Fourth, it is normally difficult and time consuming to design a centralized interlocking logic either by emulating relay logic circuits, or by developing a set of interlocking rules and associated vital data base. This is particularly the case for a large interlocking.

Fifth, after making a change or modification to a centralized vital interlocking logic software, it is necessary to perform extensive retesting of the interlocking functions.

The present invention addresses the limitations, and disadvantages of the prior art by employing a distributed processing configuration, by providing a physical and logical isolation between the various interlocking components, and by allocating and distributing the interlocking control logic to the various signal apparatuses.

OBJECT OF THE INVENTION

This invention relates to train control devices, and in particular to a distributed solid state interlocking system, wherein the control logic for the interlocking resides in the various interlocking peripherals. The new solid state interlocking system does not employ centralized logic control, but rather uses a fast data network to communicate information between intelligent signal peripherals. Collectively, such intelligent signal peripherals operate as a data flow machine wherein the status of each signal device and other information are transmitted in real time to other signal devices. A state machine is then used at each signal peripheral to process data, and to control & provide the functionality of the peripheral.

Accordingly, it is an object of the current invention to provide a distributed electronic interlocking system, wherein the intelligence and functions of the interlocking is distributed and allocated to the various signal apparatuses or peripherals.

It is another object of this invention to provide an electronic interlocking system that minimizes the use of line cables. Line cable is defined in the art to include copper and/or fiber cable that relays a vital command from a centralized location to a signal peripheral in the field, transmits the status of a signal peripheral to another peripheral or to a centralized location, or interconnects two signal peripherals for the purpose of implementing a vital signal or interlocking function.

It is also an object of this invention to provide an electronic interlocking system that includes intelligent signal peripherals, and wherein it would be possible to provide new and/or enhanced functions related to such intelligent peripherals.

It is still an object of this invention to provide an electronic interlocking system that has a distributed intelligence in order to minimize the occurrence of a catastrophic failure that impacts a large section of the interlocking.

It is a further object of this invention to minimize a catastrophic failure by providing a distributed electronic interlocking system, which includes a plurality of hardware modules that are co-located in one enclosure, and are interconnected by a data network, and wherein each hardware module is dedicated for the control of a specific signal device.

It is another object of this invention to provide an electronic interlocking system, wherein a failure of the hardware and/or software that controls an intelligent signal peripheral does not impact the functionality of other signal peripherals.

It is also an object of this invention to provide an electronic interlocking system that is easy to design, install, test, and modify.

It is still an object of this invention to provide an electronic interlocking system that includes a plurality of intelligent signal peripherals, and wherein an intelligent signal peripheral is controlled by a generic controller that employs a plurality of parameters, or a vital data base.

It is also an object of this invention to provide an electronic interlocking system, that includes a plurality of intelligent signal peripherals, and wherein an intelligent signal peripheral is capable of communicating either directly, or through a Communication Based Train Control (CBTC) zone controller, with a CBTC equipped train for the purpose of integrating the interlocking system with the CBTC system.

It is another object of this invention to provide an electronic interlocking device that incorporates a Vital Change Management Process (VCMP) to handle disarrangements of an interlocking. This VCMP identifies changes and/or modifications to the vital control logic of an interlocking, or changes to the configuration of an interlocking, assess the impact of these changes on the various vital elements, and/or safety functions of the interlocking, defines the interlocking elements and/or functions that must be tested, maintains a record of the tests performed, and ensures that the interlocking is re-commissioned only after all required tests are performed, and successfully completed.

It is yet an object of this invention to provide an electronic block signal control installation that includes a plurality of intelligent signal units, wherein a signal unit includes an automatic wayside signal, its associated automatic trip stop mechanism, and track circuit.

It is also an object of this invention to provide an intelligent block signal control device that is parameterized to enable dynamic selection between alternate signal layout configurations, and wherein one of such configurations is used for tie-in purposes.

It is still an object of this invention to provide an intelligent block signal control device that is controlled by a generic controller, which employs a plurality of parameters, and/or a vital data base.

It is a further object of this invention to provide an intelligent block signal control device that incorporates a plurality of parameter sets, and wherein one of said sets is used to maintain train service during certain failures.

It is another object of this invention to provide an intelligent block signal control device, which is parameterized to enable selection between a plurality of signal layout configurations, wherein one of said configurations is associated with the removal from service of the signal ahead.

It is still an object of this invention to provide an intelligent block signal control device, which is parameterized to enable selection between a plurality of signal layout configurations, wherein one of said configurations is associated with the failure of the signal ahead.

It is a further object of this invention to provide an intelligent block signal control device, which is parameterized to enable selection between a plurality of signal layout configurations, wherein one of said configurations is associated with low adhesion conditions.

It is also an object of this invention to provide an electronic interlocking device that includes a centralized hardware module, which employs a plurality of virtual state machines that are logically isolated from each other, wherein each virtual state machine is used to control a signal device, and wherein said plurality of virtual state machines exchange data related to the statuses of associated signal devices.

It is a further object of this invention to provide an electronic interlocking system that includes a plurality of intelligent signal devices, wherein an intelligent signal device is programmed to provide protection for work zones.

It is still an object of this invention to provide an electronic interlocking system that includes a plurality of intelligent signal devices, wherein an intelligent signal device is programmed to enforce temporary civil speed limits.

It is also an object of this invention to provide an electronic interlocking system that includes a plurality of intelligent track circuits, wherein an intelligent track circuit provides additional statuses for the associated detection block, including the "always reporting block" status, and the "never reporting block status."

BRIEF SUMMARY OF THE INVENTION

The foregoing and other objects of the invention are achieved in accordance with a preferred embodiment of the invention by providing an electronic interlocking system, wherein the control logic of the interlocking is distributed between intelligent signal units that are interconnected by a wayside data network. The intelligent signal units are also connected to a programmable logic controller (PLC), which provides the non-vital selection functions, the associated Zone Controller (ZC) if Communication Based Train Control (CBTC) technology is used, and the Automatic Train Supervision (ATS) server if applicable. A signal unit includes one or more signal peripherals, and is controlled by an intelligent signal device (ISD) that includes a vital processor module, a data communication module, and an interface module. Each signal unit receives imported data, via the data communication module, from other signal units, the relevant PLC, ZC, and/or ATS server. Also, each signal unit exports data to other signal units, the relevant PLC, ZC, and/or ATS server to provide the status of the associated signal peripherals. Further, each signal unit receives input data related to the status of associated signal equipment via the interface module. Output data is generated by the vital processor module, and is used to activate the associated signal peripherals.

The configuration of a signal unit is a design choice that is subject to predefined rules. However, there is a plurality of generic signal units that are provided to simplify signal control logic design requirement, and to provide data driven, or parameter driven installations. Further, the unit configuration rules are designed to optimize the performance of the interlocking. In particular, the allocation of signal peripherals to the various signal units is driven in part by the objective to minimize the response time for the various interlocking functions. For example, an "Automatic Signal Unit" includes the automatic signal, its associated stop mechanism and circuit controller, and the track circuit for the detection block immediately ahead of the signal. The inclusion of said track circuit in the automatic signal unit ensures that the red aspect of the signal is activated almost immediately after a train crosses the insulated joint into the block ahead of the signal, and since the track circuit associated with said block is included in the automatic signal unit. Similarly, a "Switch Signal Unit" includes the track circuit associated with the first detection block in the reverse direction of traffic for the switch detector circuit to ensure that the switch is locked by its detector circuit as soon as a train crosses the corresponding insulated joint.

In addition, to reduce data communications between the various signal units, and in order to optimize the response time, the control logic for certain internal signal functions is repeated at a plurality of signal units, rather than communicating the status of said internal signal functions between signal units. For example, the control logic for route locking functions is repeated at opposing "Home Signal Units," and could also be repeated at "Switch Signal Units." In addition to reducing data exchanges between signal units, this concept of repeating internal signal functions in a plurality of signal units has the added benefit of minimizing the impact of a signal unit failure.

The concept of intelligent signal devices provides the inherent characteristic of isolating the control logic for all the functions associated with a signal device from the control logic of other signal devices. The only link between the control logic for two signal units is the communication link between the respective data communication modules. Because data flow between the two processors associated with two signal units is predetermined, it is a simple task to identify the signal units affected by a modification of the interlocking, or a change in the control logic for a signal unit. Such deterministic data flow between signal units makes it possible to provide a "Vital Change Management Process" (VCMP) to simplify the testing requirements associated with the disarrangement of an interlocking.

The VCMP could be implemented in a real time vital processor, which monitors changes to the interlocking configuration, data flow, and/or control logic, identifies testing requirements for affected signal units, and maintains records of successfully completed tests for signal units affected by a particular version or release. Upon the initiation of a new modification, and/or release, the VCMP first identifies existing and/or new signal units included in the modification and/or release then it determines additional signal units impacted by the modification and/or release using data flow information.

The Concept of intelligent signal units, also, presents an opportunity to provide enhanced safety, and operational flexibility for various signal equipment. For example, it would be possible to enhance the safety of an automatic signal by enabling and disabling the "Key-By" function from a centralized location (ATS for example). Additional safety function such as temporary civil speed limits, and protection for work zones could be implemented in a fixed block installation by employing the grade time control feature of signal units together with centralized control functions. Similarly, the states of a track circuit associated with a detection block could be expanded to include "Always Reporting Block" (ARB), and "Never Reporting Block" (NRB). Such expanded track circuit states could be used to enhance the safety and operational flexibility of train operation. For example, a new switch locking function could be activated if an associated detector block indicates an NRB status. Alternatively, an emergency screw release function for a switch could be enabled if an associated detector block indicates an ARB status. Obviously, the proper operating procedures must be followed for such emergency screw release operation.

Another safety enhancement is related to low adhesion conditions. The computing resources of an intelligent signal device are used to dynamically reconfigure the signal layout in an area upon the detection of a low adhesion condition. In effect, this new dynamic reconfiguration function will increase safe train separation, and is activated by a command from a centralized control location.

Further, because the control logic for an intelligent signal device is primarily dedicated to a specific signal apparatus, the control logic could be parameterized to provide a generic device dedicated to said specific signal apparatus. In this case the generic device is customized to a particular location by manipulating a set of parameters. Such generic device will also reduce the design and engineering tasks required for new signal installations, and will greatly reduce the number of circuit and detail drawings. For example, the control logic for an automatic signal unit could be configured as a generic control logic that is customized to a site specific location using a data base, and/or a plurality of parameters. The control logic will include all possible functions and features related to the home and distant controls for the automatic signal location, the automatic stop control, signal lighting requirements, and indication requirements. Internal vital parameters are then added to provide a means for selecting the specific functions and features associated with a particular location.

Also, one of the advantages provided by an intelligent signal device is to reduce the impact of signal failures on train operation, and to simplify the staging and tie-in process during the initial construction phase, and/or during the implementation of modifications to signal installations. This advantage is achieved in the above described automatic signal unit example by providing two sets of home and distant control logic, together with an enabling parameter that dynamically activates the appropriate set under predefined conditions. The first set of home and distant control logic is based on the location and other parameters of the signal ahead in the current signal arrangement layout. The second set is based on the location and other parameters of a different signal ahead in a modified signal arrangement layout. Said second set could then be activated to implement a tie-in task during a signal bulletin. This feature provides a measurable reduction in time and effort required to implement changes to signal installations.

Similarly, the second set of home and distant control logic could be based on the location and other data for the second signal ahead in the current signal arrangement layout. In such a case, this second set could be activated by a parameter to provide fast recovery from a failure at the first signal ahead. In effect, upon such failure, the first signal ahead is removed from service until it is repaired. Train service continues at normal operating speed with a longer home and distant controls. Obviously, if the nature of the failure is related to a track circuit failure, then this feature cannot provide recovery at normal operating speed. Also, the proper operating procedures should be implemented (proper aspect displayed, stop hooked or driven down, etc) when a signal is taken out of service.

The intelligent signal devices are interconnected by a wayside data network (WDN) that manages the data exchanges between the various signal devices, the associated PLC that provides the non-vital selection functions, the zone controller (if CBTC is used), and the ATS server if applicable. The WDN is designed to provide a resilient and fault tolerant backbone allowing high speed data exchange between the various signal devices that form the electronic interlocking. The network employs a fiber optic backbone with appropriate equipment to provide layer 2 communication services between the various elements of the interlocking, as well as layer 3 communication service (routing) to interface the elements of the electronic interlocking with the ATS server, and/or with operator consoles at dispatcher locations. All data messages exchanged between the various intelligent signal devices are time stamped, and are processed by vital processor modules to ensure freshness of data received. In the event of communication interruption, or a determination that the data received is not fresh, then default values are assigned to affected import data. Such default values are based on the safe state for each affected input variable. For example, the import data for the status of a track circuit will default to "occupied" upon loss of communication, or a determination that the received status does not comply with the freshness threshold. Alternatively, the import data for the status of a track circuit that is used to activate a timing function (such as grade time or station time) will default to "vacant" upon loss of communication, or a determination that the received status does not comply with the freshness threshold. This means that an import variable could have two different default values if it is used in two different applications.

It should be noted that the implementation of intelligent signal devices will simplify interface requirements with a CBTC system. Each intelligent signal device could communicate directly with the zone controller to provide the status of its associated signal equipment, and to receive override control data and other information generated by the CBTC zone controller. Alternatively, and as the state of the art for CBTC technology evolves, intelligent signal devices could communicate directly with vital computers on board approaching trains to provide status information, and receive override data. Also, intelligent signal devices could be interconnected with dynamic transponders in non-CBTC territory to provide the status of wayside signals to the transponders. In turn, said dynamic transponders could transmit a plurality of variable civil speeds to approaching CBTC trains based on the aspects of wayside signals. Furthermore, an intelligent signal device could be interfaced with vital wheel detectors to provide speed measurement or axle counter functions.

It should also be noted that the concept of intelligent signal devices could be partly employed in a signal installation. The extent this concept is implemented at an interlocking is a design choice. For example, intelligent signal devices could be employed to control the automatic signals between two interlockings, while maintaining conventional relay or solid state interlocking (with centralized intelligence) to control the signal equipment at the interlockings (home signals, approach signals, switch machines, etc). Alternatively, automatic, approach, and home signals could be implemented using intelligent devices, while maintaining centralized logic for switches, traffic signals, and other signal equipment.

Further, intelligent signal devices could be provided in a centralized location for the purpose of isolating the control logic for the various signal equipment from each other. In such a case, the main objective for employing intelligent signal devices is to minimize the probability of a catastrophic failure that would impact the entire interlocking, and to employ the deterministic data flow characteristic of distributed intelligence for the purpose of providing a Vital Change Management Processor. Obviously, in such a case, and since the intelligent signal devices are co-located in a single location, line cables are required to interconnect field equipment with the various interface modules.

Another design alternative is to implement the intelligent signal devices as individual state machines that operate on fault tolerant, and vital hardware architecture. In such a case, each state machine represents an intelligent signal device, and is logically isolated from other state machines operating on said fault tolerant hardware. Such logical isolation is implemented in a vital manner to ensure the integrity of the Vital Change Management Process. In such a case each type of state machine could be parameterized to minimize design efforts, and data is exchanged between the various state machines in a manner that is similar to the data flow between individual intelligent signal devices that are interconnected by a wayside data network.

BRIEF DESCRIPTION OF THE DRAWINGS

These and other more detailed and specific objectives will be disclosed in the course of the following description taken in conjunction with the accompanying drawings wherein:

FIG. 26 shows an example of a graphic user interface diagram of the various parameters incorporated in the home control function of an automatic signal unit.

FIG. 36 shows an example of a graphic user interface diagram of the various parameters incorporated in the signal lighting function of an automatic signal unit.

FIG. 43 shows an example of a graphic user interface diagram of the various parameters incorporated in the stop control function of an automatic signal unit.

FIG. 48 shows an example of a graphic user interface diagram of the various parameters incorporated in the train detection functions of an automatic signal unit.

FIG. 50 shows an example of a graphic user interface diagram of the various parameters incorporated in the indication functions at an automatic signal unit.

FIG. 52 indicates an example of the main functions and associated primary parameters for an approach signal unit.

FIG. 53 indicates an example of the main functions and associated primary parameters for a home signal unit.

FIG. 54 indicates an example of the main functions and associated primary parameters for a switch signal unit.

FIGS. 60-62 indicate an example of parameterized export data configuration for an automatic signal unit.

DESCRIPTION OF THE PREFERRED EMBODIMENT

The preferred embodiment of the present invention provides a structure, or a process to control interlocking devices, and to control the safe operation of trains over sections of signaled track territory. For a typical interlocking installation that includes at least one track switch, a plurality of wayside signals and associated stop mechanisms (for transit application), and a plurality of detection blocks, the current invention configures the interlocking elements into a plurality of signal units, each of which has an independent vital control device. These vital control devices are interconnected by a data network that manages the data exchanges between the devices. Unlike a conventional interlocking that employs centralized control logic, the current invention segregates the interlocking control logic by type of interlocking element.

For example, in a typical interlocking configuration the control logic for track switch machines, home signals, approach signals, automatic signals, and directional traffic signals are segregated from each other. Such segregation, combined with placing vital control devices at close proximity to the physical trackside signal devices, provide many benefits. These benefits include minimizing the operational impact of a failure, minimizing line cable requirements, making it possible to develop a generic, parameter driven control device for each type of signal element, simplifying design, testing and commissioning tasks for the initial installation, as well as after a disarrangement of the interlocking, and simplifying the interfaces between trackside signal devices, and other signal devices such as Programmable Logic Controllers (PLC), Zone Controllers, and ATS servers.

In order to minimize data exchanges between signal unit devices, certain signal control logic could be duplicated within different signal units rather than transmitting additional data between units. For example, route locking functions could be duplicated within the devices that control home signals, and the devices that control track switches. The logic could also be repeated within the PLC that provides the non-vital selection functions for the interlocking. In addition to reducing data exchange requirements, this design approach will minimize the failure impact of one unit on the remaining control devices at an interlocking.

Figure 1:
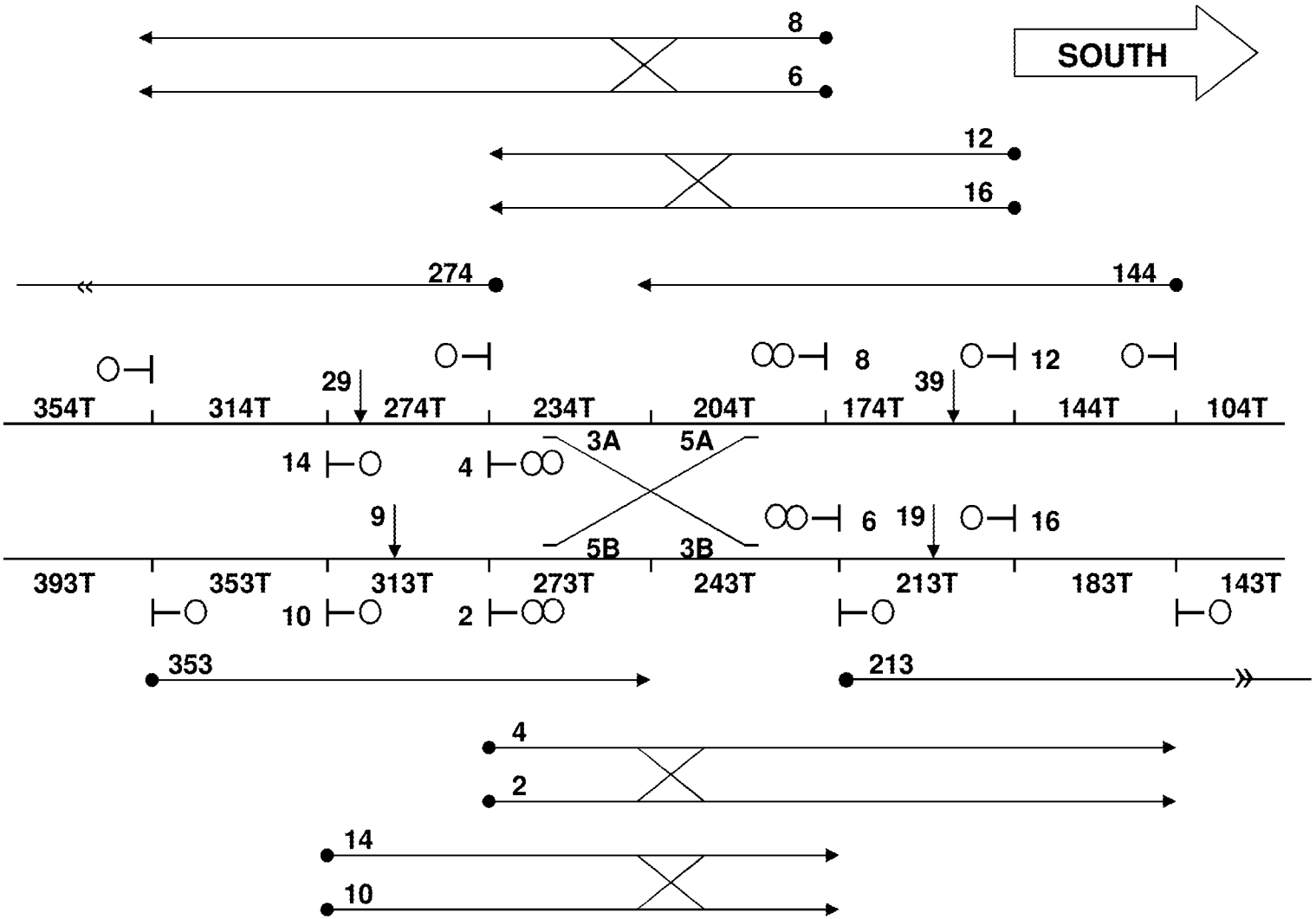
FIG. 1 is a signal arrangement drawing for a simple diamond crossover interlocking in a transit application.
Figure 2:
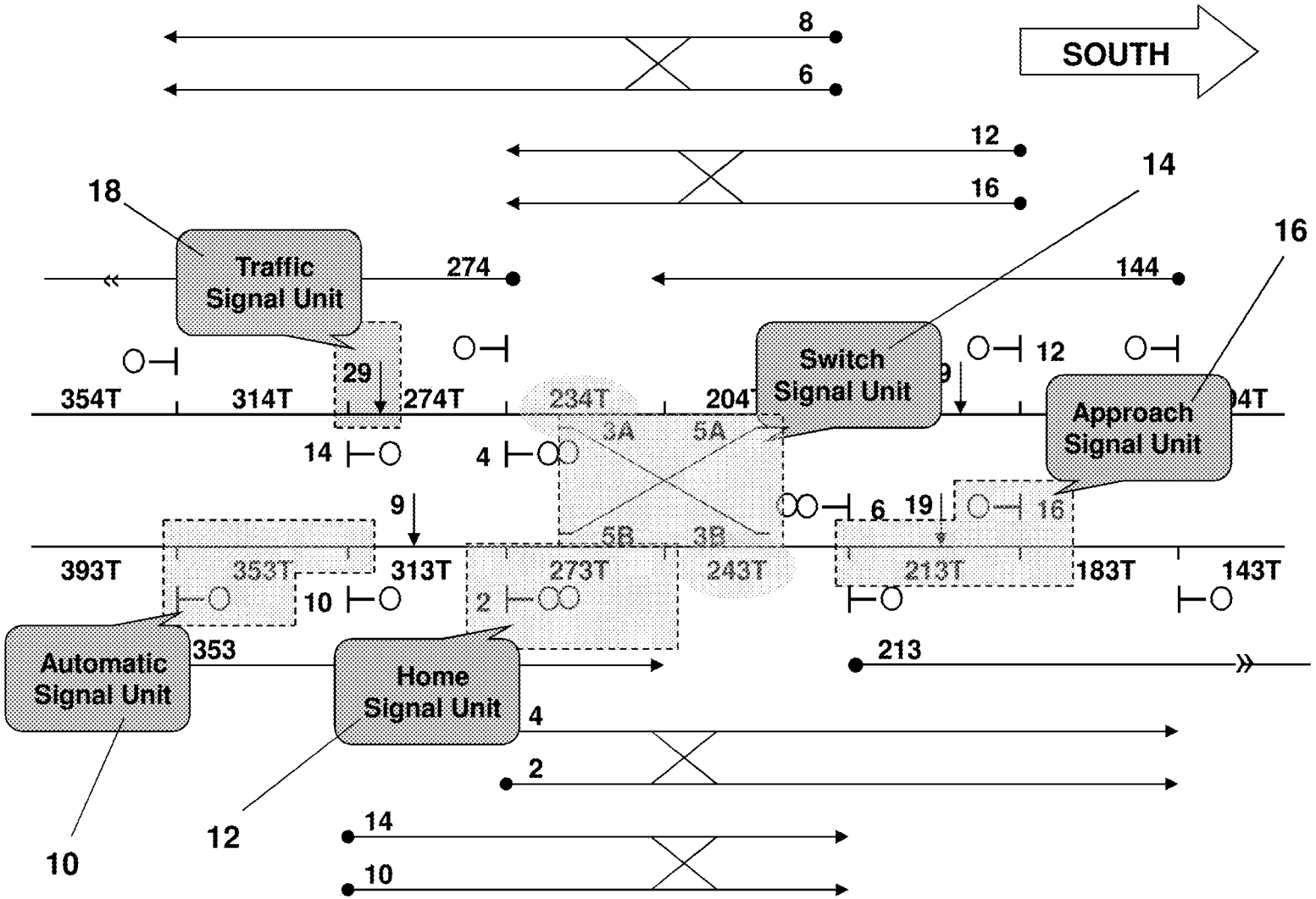
FIG. 2 indicates the various types of signal units for the diamond crossover signal configuration.

Referring now to the drawings where the illustrations are for the purpose of describing the preferred embodiment of the invention and are not intended to limit the invention hereto, FIG. 1 is a signal arrangement diagram for a diamond cross over, which includes track switches (3 & 5), home signals (2, 4, 6 & 8), approach signals (10, 12, 14 & 16), automatic signals (143, 213, 353, 144, 274 & 354), detection blocks (143, 183, 213, 243, 273, 313, 353, 393, 104, 144, 174, 204, 234, 274, 314 & 354), and directional traffic control signals (9, 19, 29 & 39). Under the new concept disclosed herein, this interlocking is configured as a plurality of signal units by grouping together signal elements that are geographically and/or logically interrelated as shown in FIG. 2. For example, automatic signal 353, which includes signal head 353, and its associated stop, is combined with track circuit 353 to form automatic signal unit 353/10. Similarly, home signal 2 (signal head, associated stop, and stop release push button) is combined with track circuit 273 to form home signal unit 2/12. Switch signal unit 3-5/14 includes 3A, 3B, 5A & 5B switch machines, 3A, 3B, 5A & 5B switch circuit controllers, as well as track circuits 234 & 343. Approach signal unit 16/16 includes the associated signal head and stop mechanism, as well as track circuit 213. Traffic signal unit 29/18 includes directional traffic control signal 29.

Figure 3:
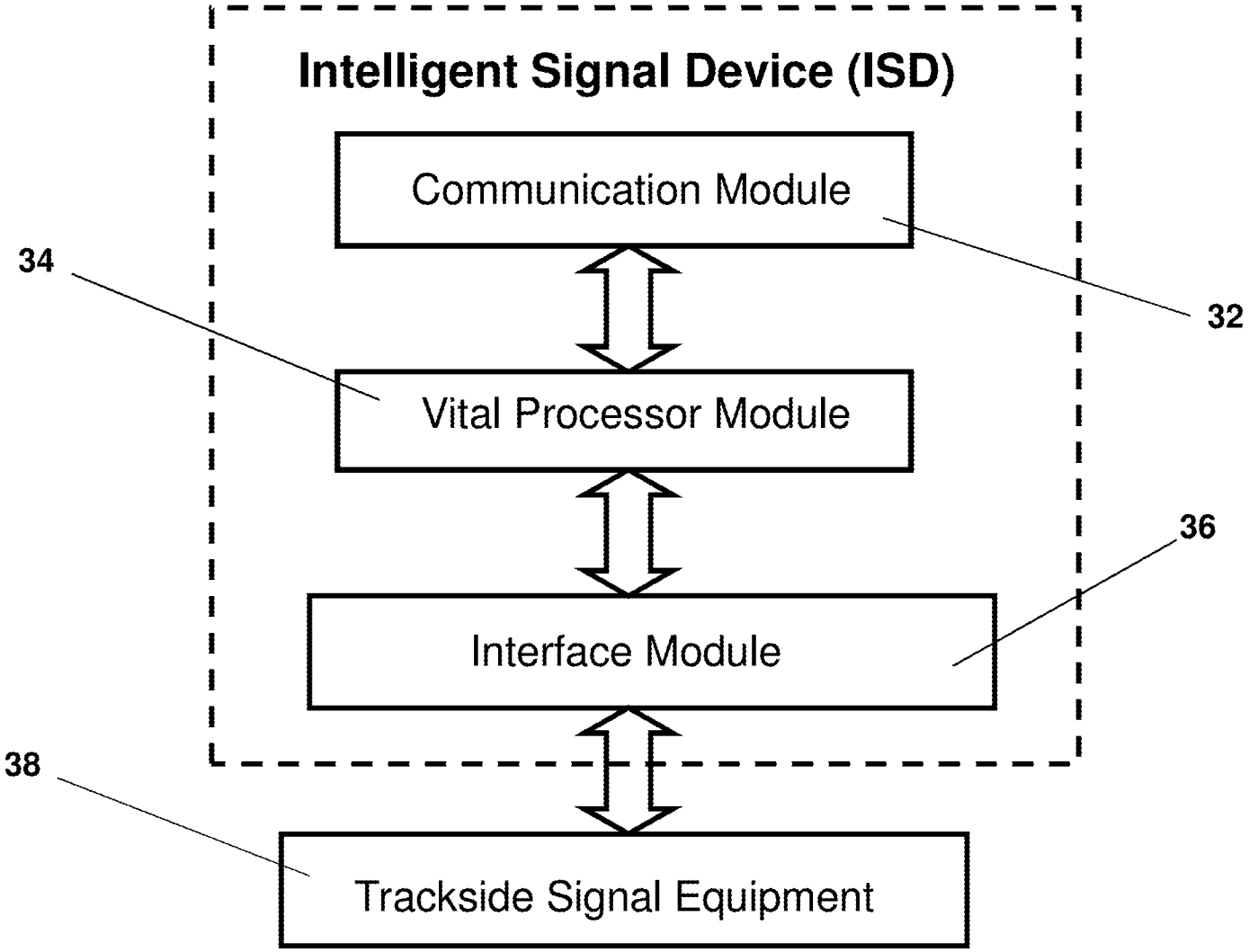
FIG. 3 shows the generic architecture for an Intelligent Signal Device (ISD).
Figure 4:
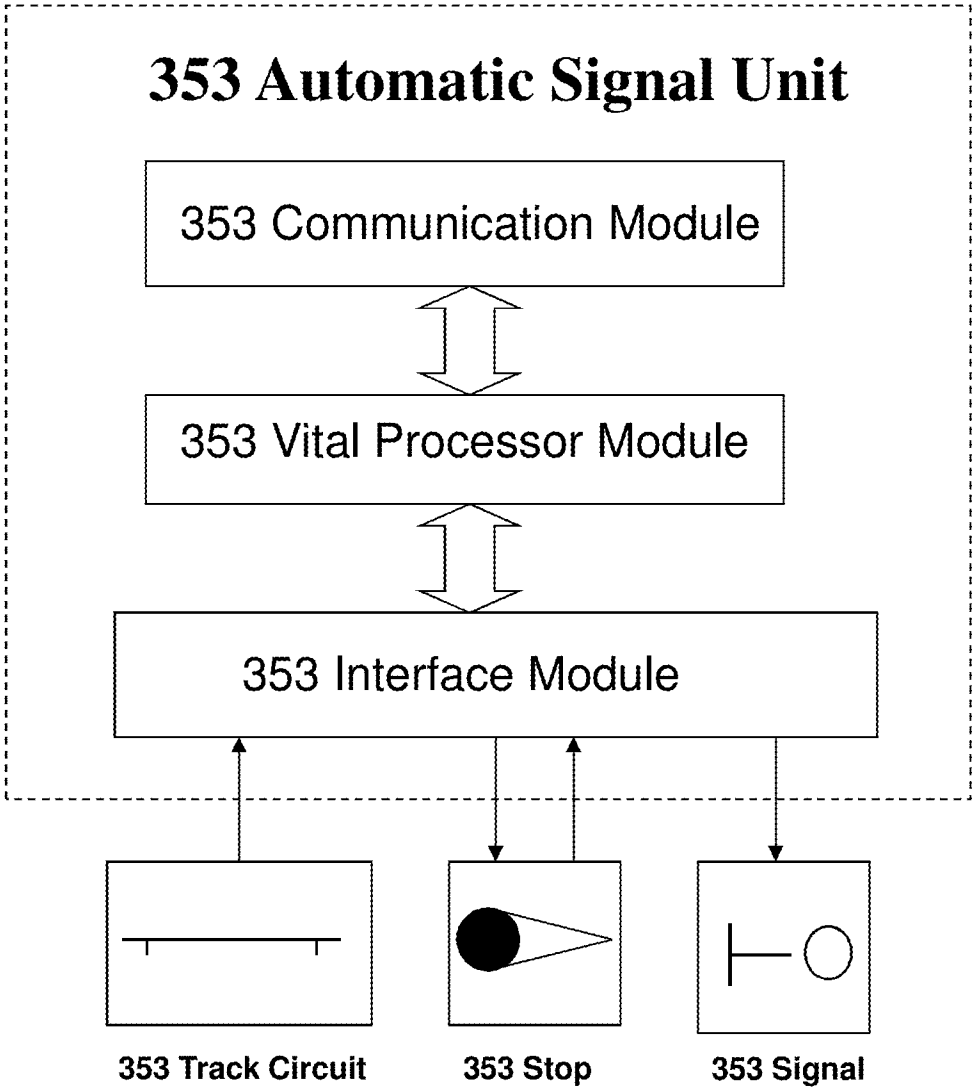
FIG. 4 shows the application of the ISD concept to Automatic Signal Unit 353.

The entire interlocking is then configured into signal units of the types described above. Each signal unit is controlled by an intelligent signal device (ISD), which includes a communication module 32, a vital processor module 34, and an interface module 36 as shown in FIG. 3. The interface module 36 interconnects the processor module 34 with the associated trackside signal equipment 38. It is preferable that an ISD is located at close proximity to the associated trackside equipment in order to minimize the need for line cables. In such a case, all that is needed are local cables to interconnect the ISD with its associated trackside equipment. The ISD's associated with directional traffic signal units 18 could be located either in the field, or in a signal enclosure. For example the ISD's for traffic signals 9, 19, 29 & 39 could be collocated in the same signal enclosure where the PLC and the zone controller are located.

The interface module 36 includes a set of vital I/O boards each of which is designed to interface with a specific type of signal equipment. Typical vital I/O boards known in the art include a signal lighting board, a stop machine board, a switch machine board and a track circuit board. A general purpose vital I/O board is used to provide "dry contact" interface to electromechanical equipment such as relays, contactors, etc. Further, each type of vital I/O board could include a plurality of boards to interface with different versions of trackside equipment 38. For example, a signal lighting board could include low voltage DC board to interface with LED aspects, as well as low voltage AC and high voltage AC boards to interface with incandescent lamp aspects. Similarly, a stop machine board could include a high voltage AC board to drive the stop motor for an all-electric stop machine, and a low voltage DC board to activate the stop valve for an electro-pneumatic stop machine.

As would be appreciated by a person skilled in the art, a vital I/O board could include certain intelligence of its own. For example, it is preferable that the signal lighting board includes intelligence that provides a "Light Out" detection function. Upon the detection of a light out condition in an aspect, the intelligent I/O board provides a signal to the associated ISD, which in turn modifies the indications displayed at other aspects within the associated signal, and activates the appropriate alarm functions. Similarly, a high voltage AC stop machine board could include intelligence that senses a high in-rush current. Further, it desirable that each I/O board is designed to detect any ground conditions on the local copper wiring that interconnects trackside signal equipment with the ISD. Upon the detection of a ground condition, the I/O board is turned off.

In general, the interface module 36 shown in FIG. 3 could be designed as a special purpose vital interface unit that is dedicated to the type of associated signal unit. For example, a special purpose interface module for an automatic signal unit 10 could include an integrated module that interfaces with both signal lighting and stop mechanism. Alternatively, the interface module 36 could be assembled using individual vital I/O modules dependent on the type of signal equipment 38 included in the associated signal unit. Also, it is preferable to employ remote I/O capability. Such feature is required when it is desired to incorporate a signal element within two different signal units. For example, a signal engineer may decide to include track circuit 273 into home signal unit 2/12, as well as switch signal unit 3-5/14. In this case, a remote I/O for the ISD associated with home signal unit 2/12 could be co-located with the ISD associated with switch signal unit 3-5/14. Such remote I/O capability has the added advantage of providing the status of a track circuit to a different location in the event of a failure of the associated ISD. Examples of intelligent signal devices for a 353 automatic signal unit, a 16 approach signal unit, a 2 home signal unit, and a 3-5 switch signal unit are shown in FIGS. 4, 5, 6 and 7.

Figure 8:
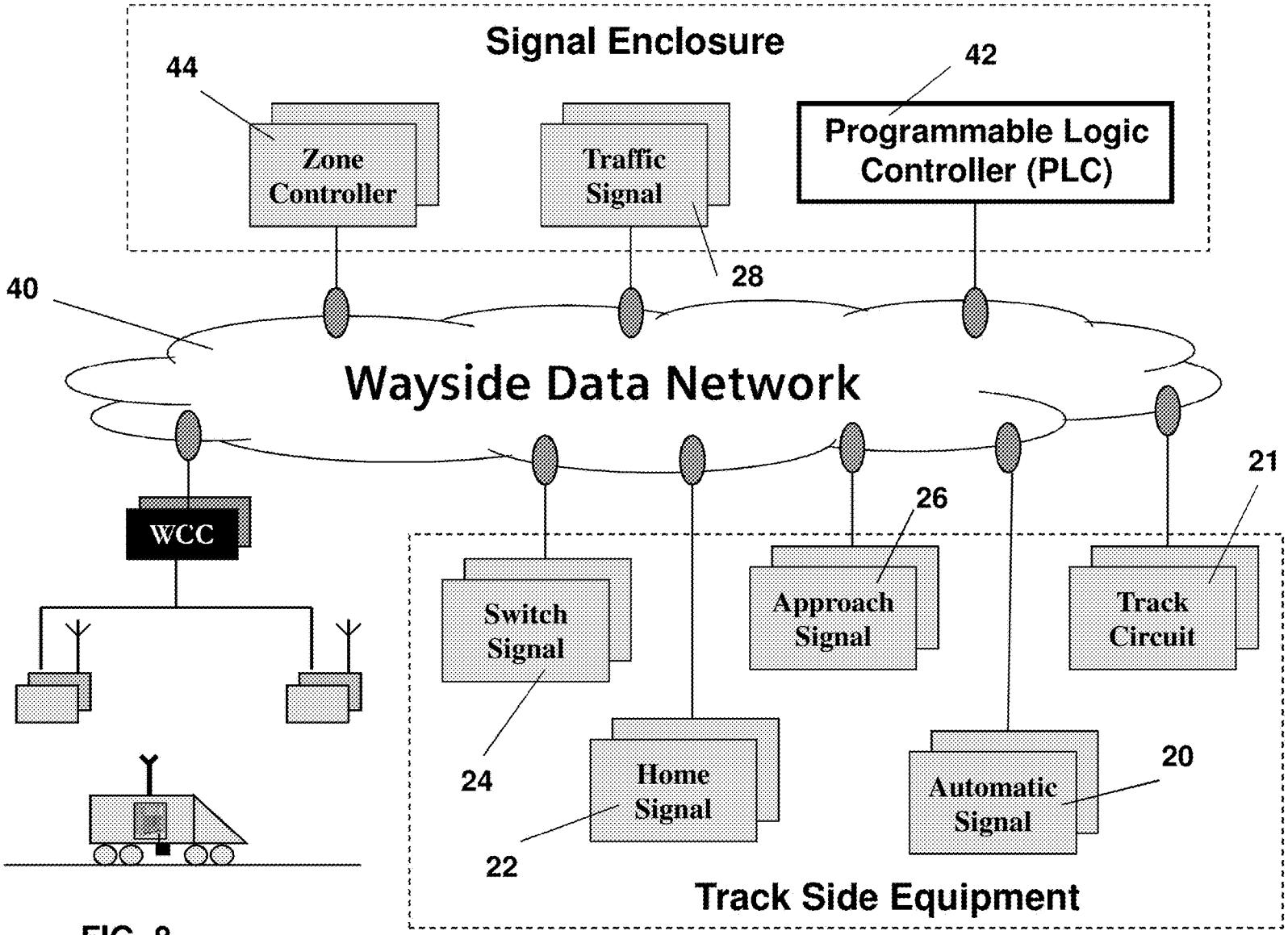
FIG. 8 indicates the wayside data network that interconnects the various signal units for a signal configuration.

As indicated in FIG. 8, the various intelligent signal devices for an interlocking configuration are interconnected by a Wayside Data Network (WDN) 40 that manages the data exchanges between these devices. The WDN 40 then interconnects the automatic signal units 20, the track circuit signal units 21, the home signal units 22, the switch signal units 24, the approach signal units 26, and the directional traffic signal units 28 with each other. The WDN 40 also interconnects the various signal units with the PLC 42 for the interlocking, and the Zone Controller 44 if CBTC is used. In addition, the WDN 40 interconnects the intelligent signal devices with associated remote I/O's.

The generic operation of an ISD consists mainly of receiving data related to the states of other signal units, determining and/or controlling the operational states of associated signal equipment, and communicating said operational states to other signal units. To accomplish these tasks, and ensure efficient data flow between the various ISD's, the vital processor module 34 of an ISD employs two sets of data. The first set is related to the data exchanged with other intelligent signal devices, and is configured as import data, and export data. Further, the import data includes two data fields for each data element. The first field identifies the data element, and the second field identifies its origin (i.e. the ISD location where the data element originated). Similarly, the export data includes a field that identifies a data elements that is generated at the ISD location, and a second field that identifies the destination address(es) for said data element. The second set is related to data exchanged with trackside equipment associated with the ISD location, and is configured as input data and output data. The input data represents the statuses of trackside equipment, such as track circuits, switch machines, stop machines, etc. The input data also includes any data generated by intelligent I/O boards, such as light out conditions for signal aspects. The output data represents the control signals generated by the vital processor module 34, such as signal aspects, stop control signal, switch activation signal, etc.

Figure 9:
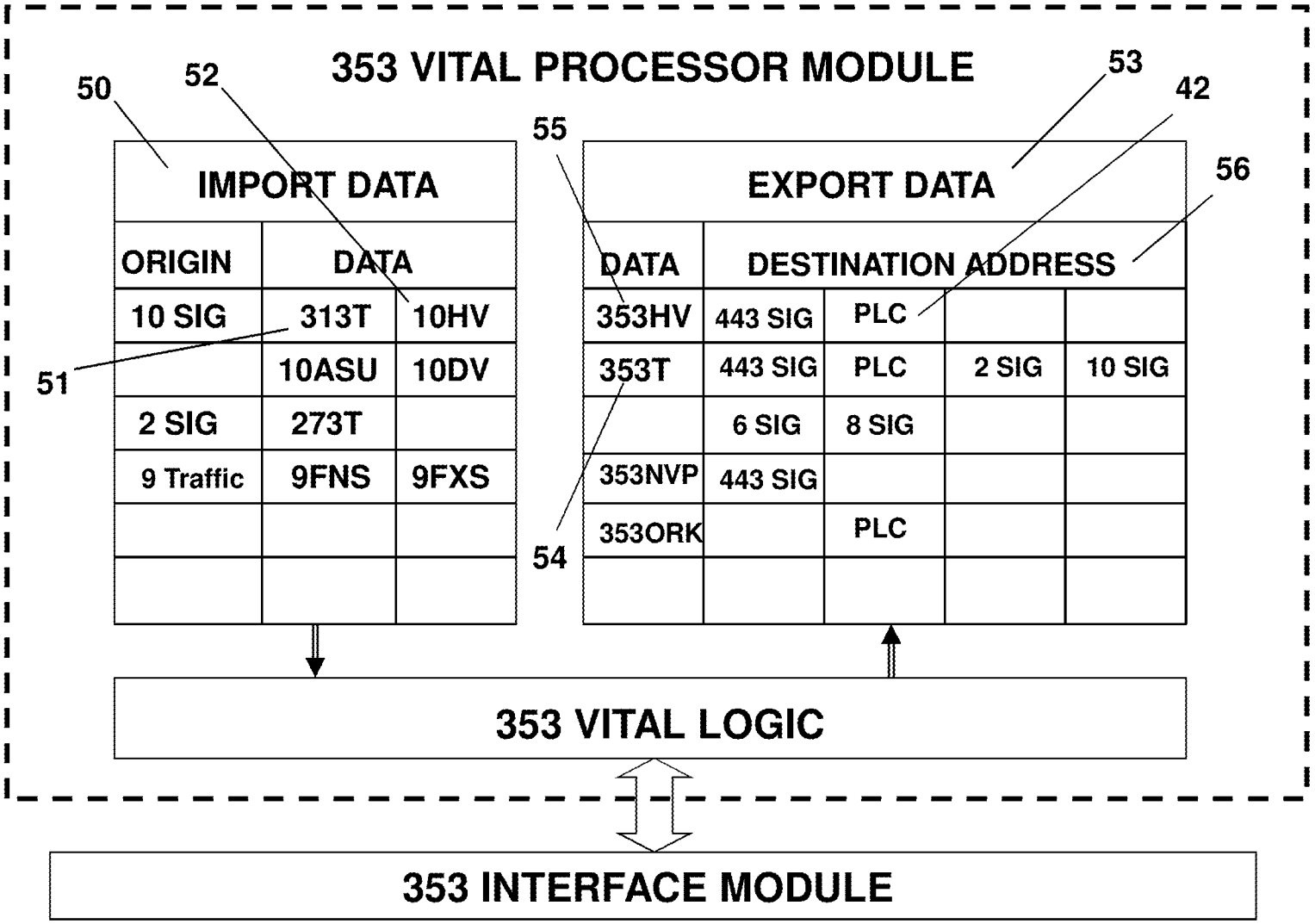
FIG. 9 shows an example of the import and export data fields for automatic signal unit 353.
Figure 10:
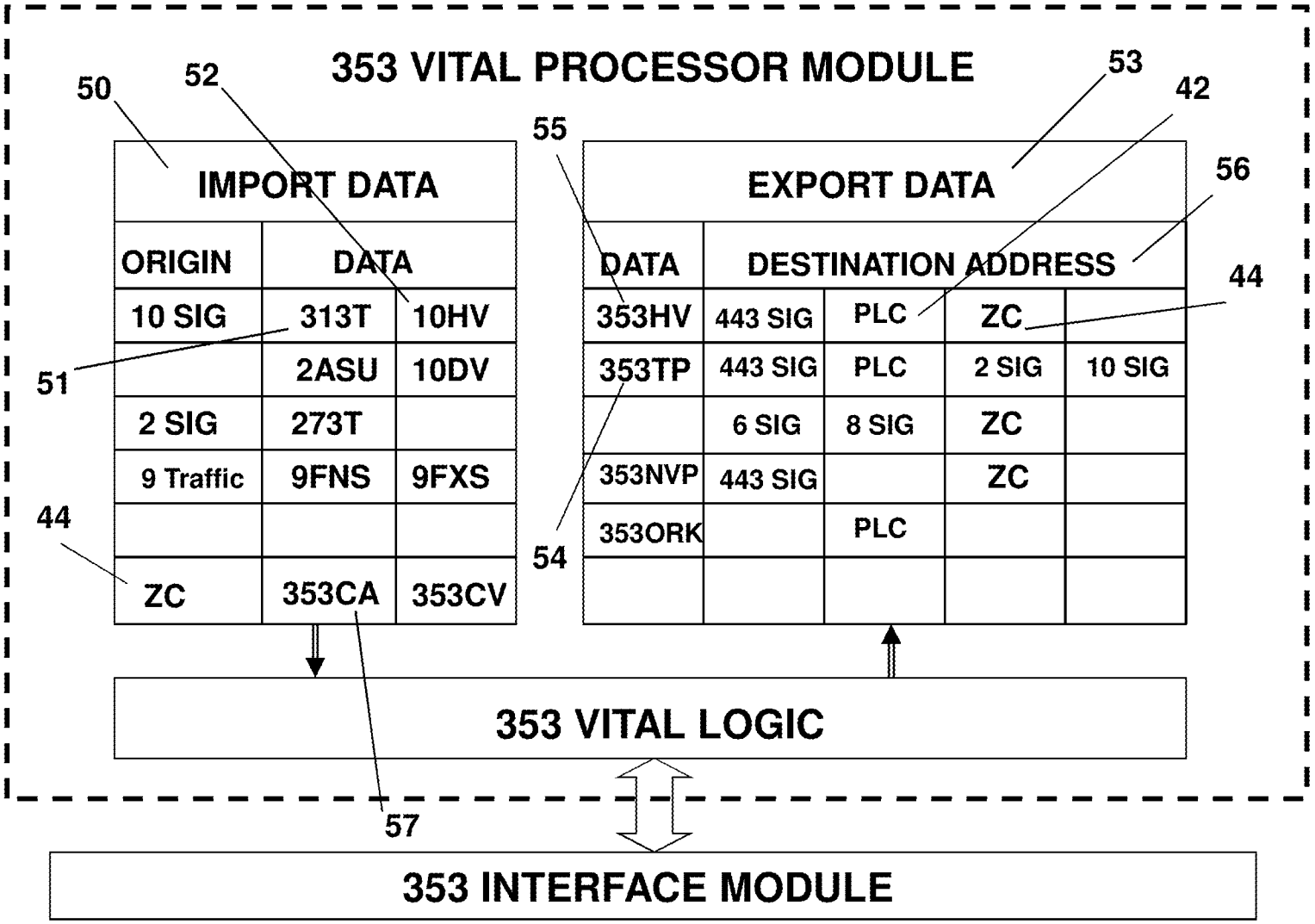
FIG. 10 indicates an example of the changes required in the import and export data fields to interface automatic signal unit 353 with a CBTC zone controller.

An example of import/export data configuration for 353 automatic signal unit is indicated in FIG. 9. The import data 50 includes track circuit statuses data 51 that are needed from other ISD's for the Home "H" control function, and home stop clear repeater data "HV" 52 for the distant control function ("D" or "DV"). The export data 53 includes the status of 353 track circuit 54 as well as the status of 353 home stop clear repeater function ("353 HV") 55. Also, the export data indicates the destination addresses 56 for data elements exported to other ISD's, PLC, etc. This data configuration could be easily modified when a change is made to the signal installation. For example, if CBTC is overlayed on the installation at a later date, then the import/export data configuration will be modified as indicated in FIG. 10. More specifically, the import data is augmented by the addition of the "CA" & "CV" (override functions) 57 from the CBTC zone controller 44. Similarly, various statuses for 353 track circuit, stop and home stop clear repeater functions are transmitted to the zone controller 44.

The above example demonstrates one of the advantages of the ISD concept presented herein related to the simplification of changes, and tie-in tasks. To modify a traditional hard-wired system would normally require the addition of cables/equipment and/or wiring changes. Similarly, to interface a hard wired signal installation with CBTC would normally require the addition of cables, interface racks, as well as wiring changes in the existing equipment. Under the ISD concept, tie-in tasks and/or interfaces with CBTC would require modification to the internal logic of affected ISD's, and changes to the data configuration, thus eliminating the need for additional wiring and equipment and/or wiring changes. Further, if the ISD internal logic is parameterized, then tie-in tasks and/or interfaces with CBTC would require only modification to the data and/or parameter configuration.

Figure 11:
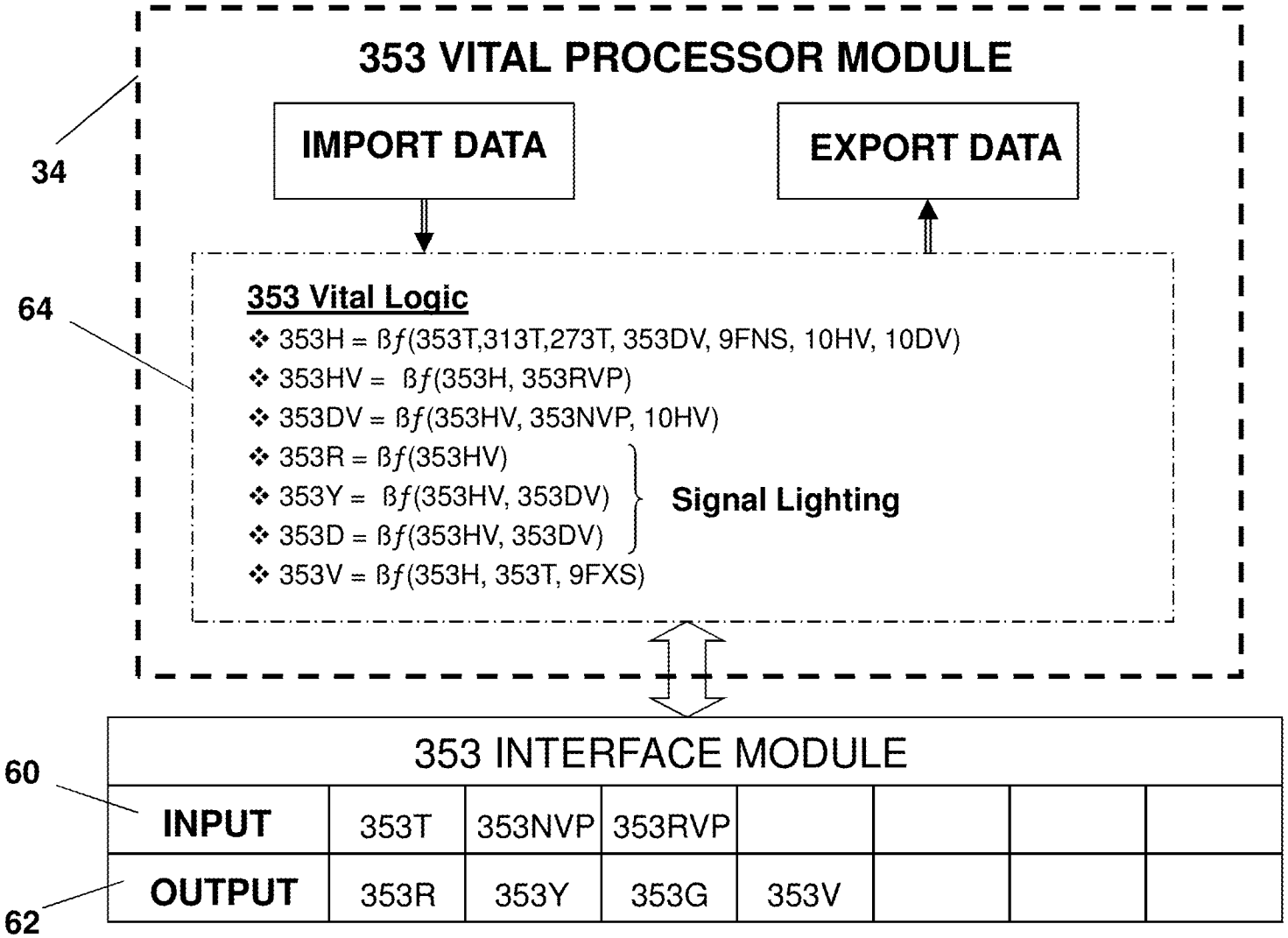
FIG. 11 shows an example of the Boolean control logic required for a basic automatic signal unit, as well as the input and output data fields.

The input/output data configuration for an ISD is structured similar to the import/export data configuration as indicated in FIG. 11. For example, the input data 60 for 353 automatic signal unit includes the status of track circuit 353, and the status of 353 stop ("353NVP" OR "353RVP"). Further, the output data 62 includes the activation data for the green, yellow and red aspects, as well as the control data for 353 stop. As would be appreciated by a person skilled in the art, additional input data could be provided through the use of intelligent I/O boards. For example, data related to light out condition could be provided by an intelligent signal lighting board. Similarly, an intelligent AC stop board could provide input data in the event of a high in-rush current condition.

FIG. 11 also shows an example of the main control logic functions 64 for 353 automatic signal unit. In general, and as would be appreciated by a person skilled in the art, the vital processor module 34 could be programmed using Boolean equations that are derived from equivalent relay circuit logic, or could be programmed using a set of rules that describe the safety requirements, and operation of the signal equipment associated with the intelligent signal device. Further, the vital processor module could be programmed using ladder logic. In the example provided in FIG. 11, the vital processor module for 353 automatic signal unit is programmed using a plurality of Boolean equations that are derived from equivalent relay logic circuits for an automatic signal location. More specifically, the vital control functions include Boolean equations for the Home control ("H"), home stop clear repeater ("HV"), the distant control ("DV"), the stop ("V"), and the signal lighting functions.

One of the main characteristics of the ISD concept is that the control logic that resides within an ISD is dedicated to a specific type of signal element, and is segregated from the control logic of other types of signal equipment. For example, the control logic 64 for 353 automatic signal unit, shown in FIG. 11, is entirely related to automatic signal 353, its associated stop and track circuit. Further, said control logic 64 is completely isolated and segregated from the control logic for approach signal unit 26, home signal unit 22, switch signal unit 24, and traffic signal unit 28. Such segregation of control logic has a number of advantages and benefits. For example, a failure of an ISD unit would have limited impact on train operation, and would be mainly confined to the associated signal equipment. But the main advantage of this segregation is that it would be possible to develop generic intelligent signal devices for various types of signal units.

A generic ISD incorporates the logic for all possible functions, and site specific features for a type of signal equipment. The ISD also incorporates a plurality of internal vital parameters that are integrated with said logic to provide a means for selecting the desired functions and features at a particular location. There are two types of parameters used in this ISD concept. The first type is related to a parameter that activates a function or a feature. The second type is related to a parameter that enables a function or a feature. Both types of parameters are set by a signal engineer at the time an ISD is programmed, or is customized to a particular location. An activating parameter is set to either "TRUE," i.e. "ACTIVATED," or "FALSE," i.e. "NOT ACTIVATED." Similarly, an enabling parameter is set to either "TRUE," i.e. "ENABLED," or "FALSE," i.e. "NOT ENABLED." A function or a feature that is enabled can be activated and de-activated by a user input, typically from an operating console. In effect, a parameter is used to either select or bypass a logic module in a parameterized logic configuration.

To customize an ISD to a particular location, a programming tool with a display device is used. A graphic user interface (GUI) is provided to enable a designer, or a signal engineer to select & activate parameters, and enter the required site specific data. The signal engineer is presented with a series of screens that include the various parameters related to the type of signal equipment controlled by the ISD. The design of the programming kit is such that upon the selection of general or high level parameters, additional screens are presented to the signal engineer to further customize the ISD to the specific site or location. There are two sets of graphic user interface screens. The first set is related to the signal control logic for the ISD, and enables the signal engineer to define the functional requirements of the location, and identify the required site specific data. The second set of screens is related to the communication logic for the ISD, and enables the signal engineer to define the import and export data, as well as the origination and destination addresses. In addition, and as would be appreciated by a person skilled in the art, the design for the programming kit could incorporate safety checks, plausibility determinations, and cross checks to detect the selection of contradictory parameters, or obvious errors in the parameterization configuration of the device.

Figure 12:
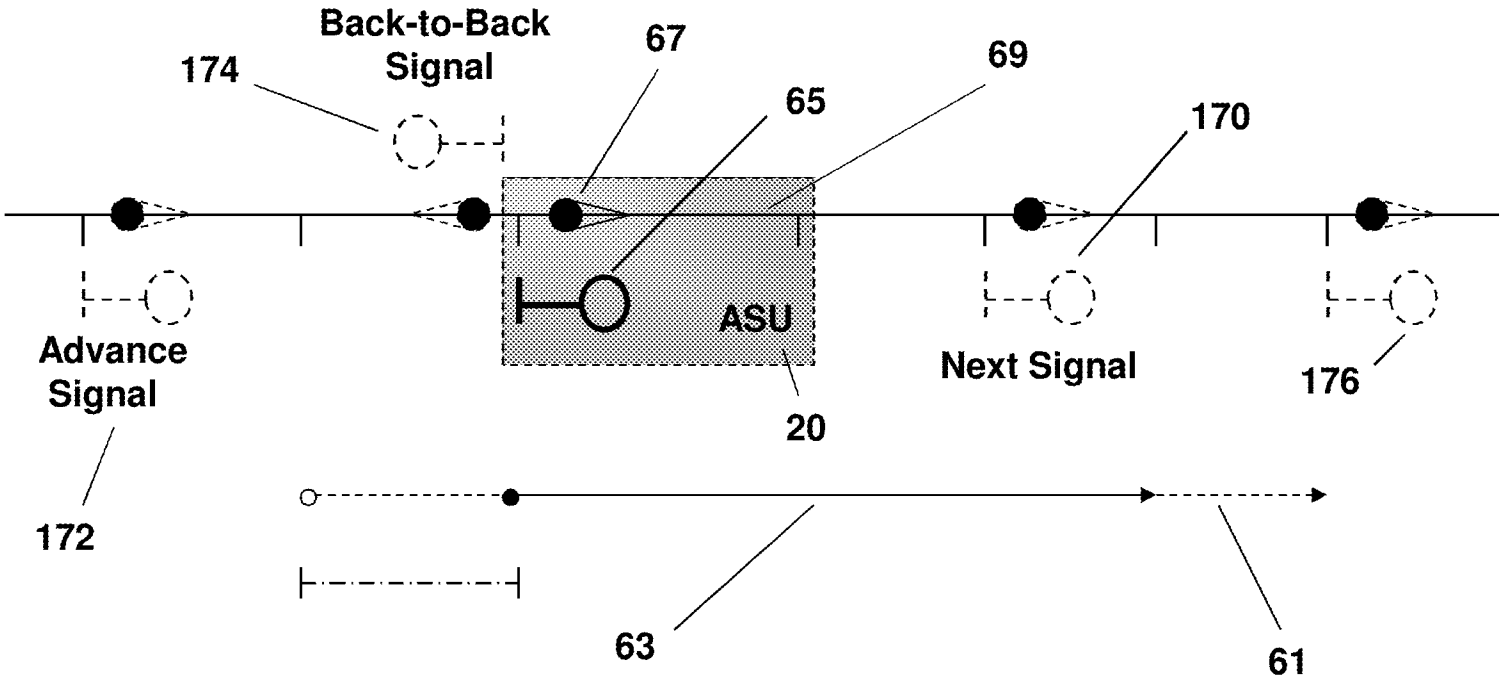
FIG. 12 indicates a generic automatic signal unit location, as well as various signal elements that normally interact with it.
Figure 13:
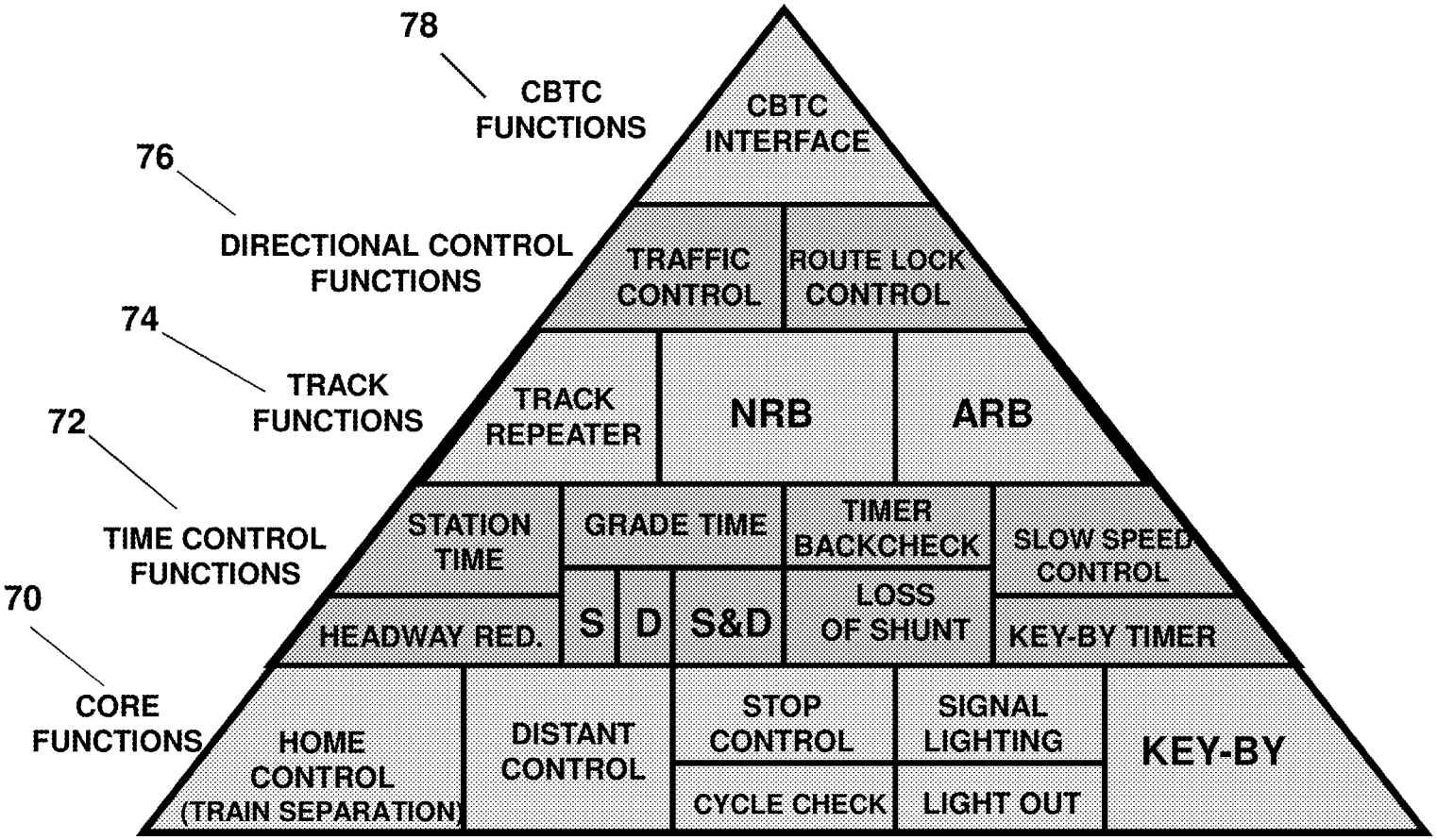
FIG. 13 shows all the signal functions that could be implemented at an automatic signal unit.
Figure 14:
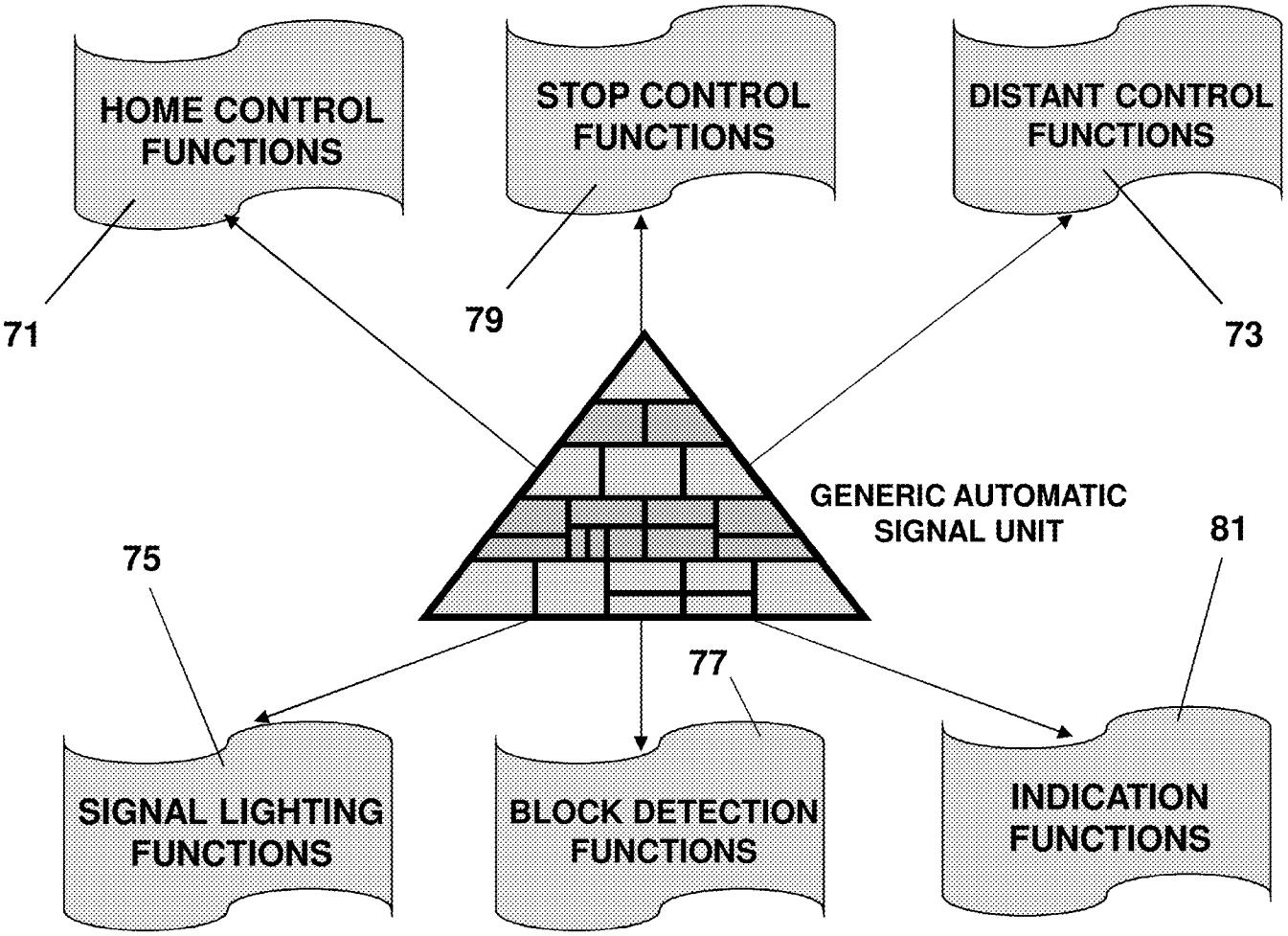
FIG. 14 indicates the mapping of various signal functions into six (6) main function categories.

To demonstrate the concept of generic intelligent signal devices, an example of a generic ISD for an automatic signal unit is disclosed for the preferred embodiment. FIG. 12 shows an automatic signal unit (ASU) 20, it includes the wayside signal 65, its associated stop 67, and the track circuit associated with the detection block 69 ahead of the signal 65. FIG. 13 indicates all the possible functions for an automatic signal location. These functions include the core functions 70 for the automatic signal, as well as a plurality of signal control features that could be required at various signal locations. These features include time control functions 72, track circuit functions 74, directional control functions 76, and CBTC functions 78. Further, there is a plurality of indication functions that could be provided at an automatic signal location. In the preferred embodiment, the core functions, and all possible features are mapped into six (6) primary signal control functions as shown in FIG. 14. The primary functions include the "Home Control" functions 71, the "Distant Control" functions 73, the "Signal Lighting" functions 75, the "Detection Block" functions 77, the "Stop Control" functions 79, and the "Indication" functions 81.

FIG. 15 to FIG. 51 indicate examples of the various logic diagrams and associated graphic user interface screens for an automatic signal unit. It is not the intent of this disclosure to describe every single detail of these logic diagrams. These diagrams, however, illustrate one of the new concepts presented herein of using a plurality of parameters to develop a generic signal device that could be easily customized to a particular location. The diagrams are presented in relay logic format in order to facilitate the understanding of the concepts described herein. Even though the following description of the primary functions for an automatic signal unit will not include all of the details of these diagrams, periodic examination of the diagrams may prove to be helpful to the reader hereof.

Figure 15:
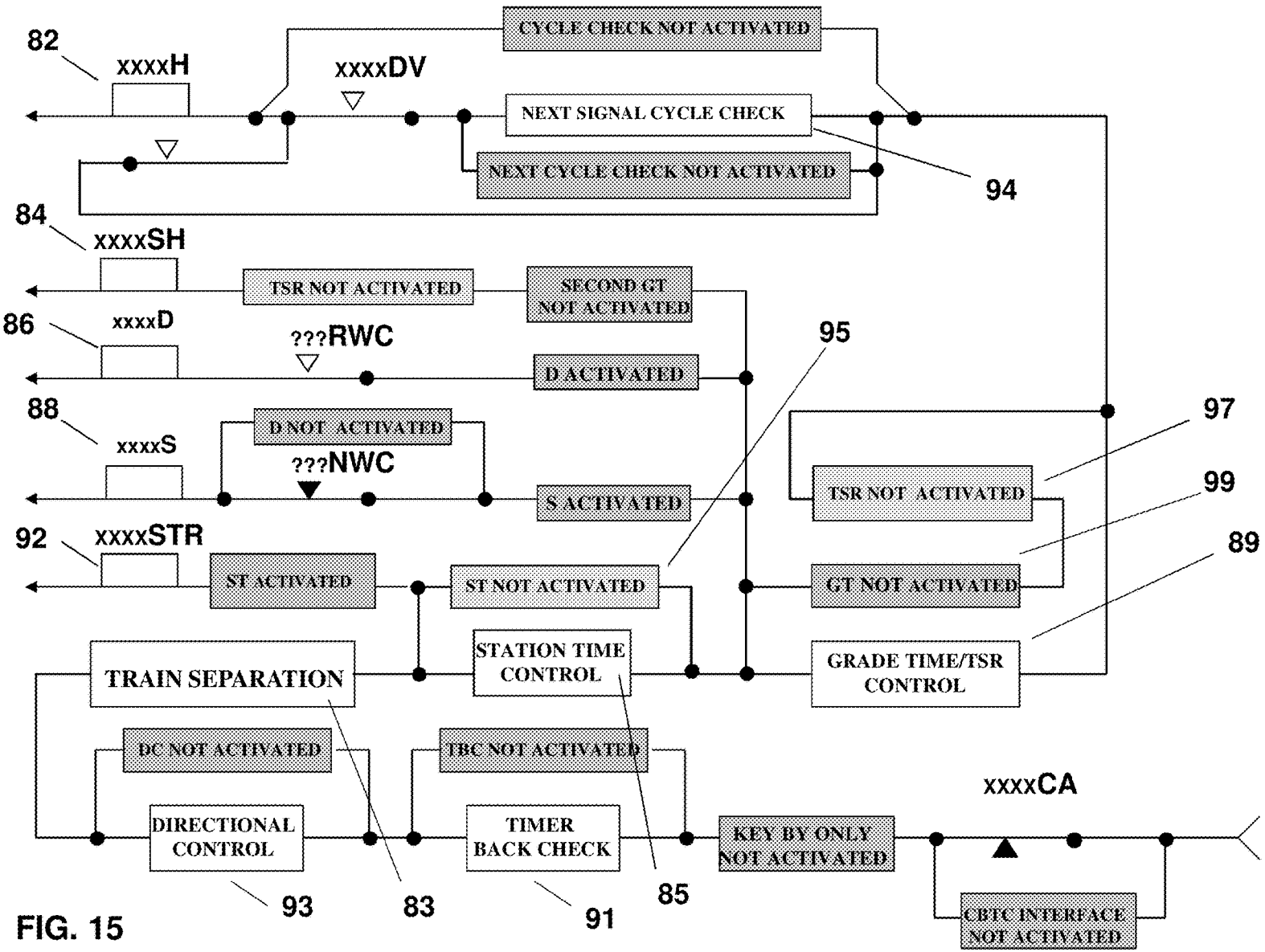
FIG. 15 shows an example of a parameterized relay logic diagram for the home control function of a generic automatic signal unit.
Figure 16:
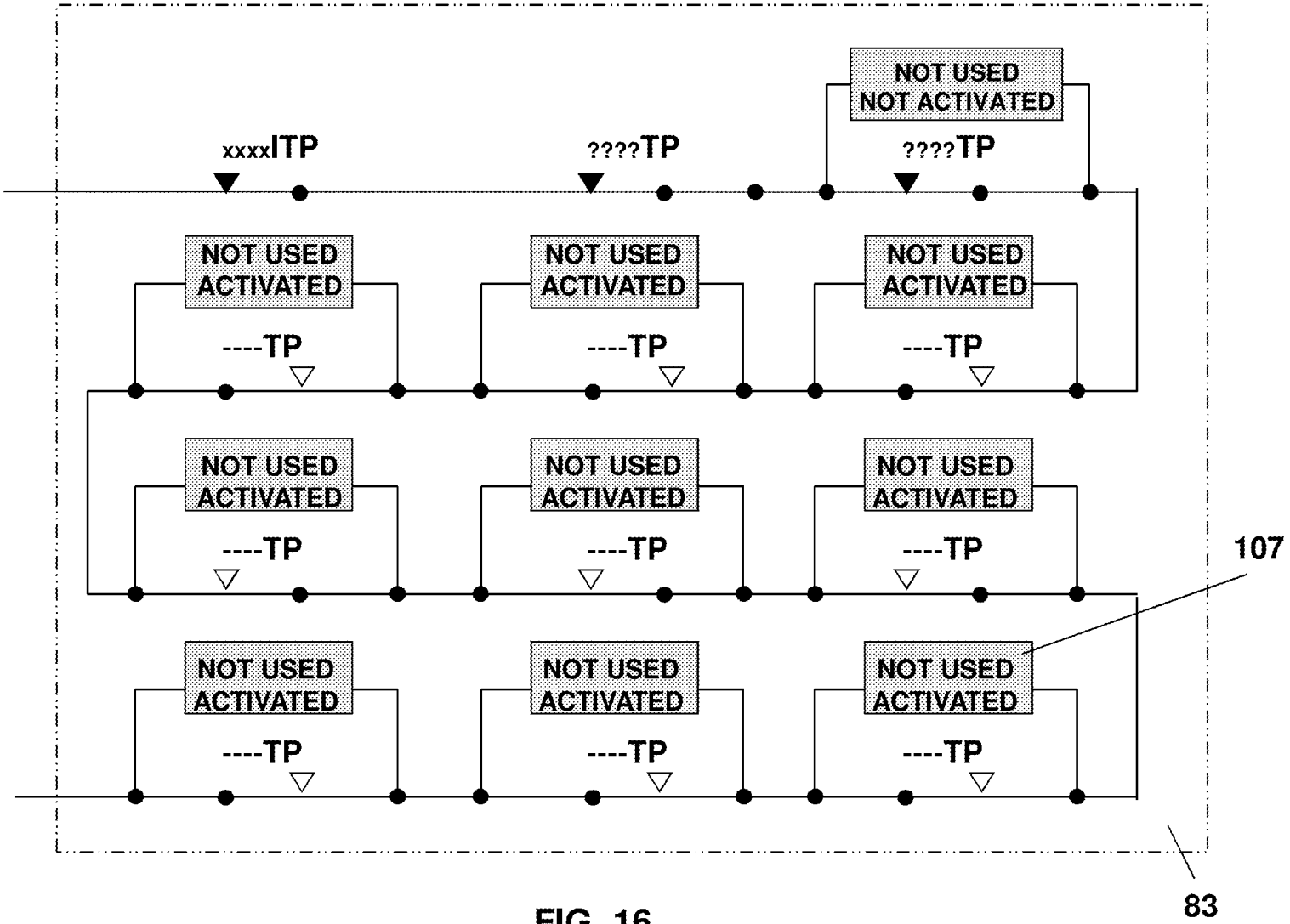
FIG. 16 indicates an example of a parameterized relay logic diagram for the train separation function of an automatic signal unit.
Figure 17:
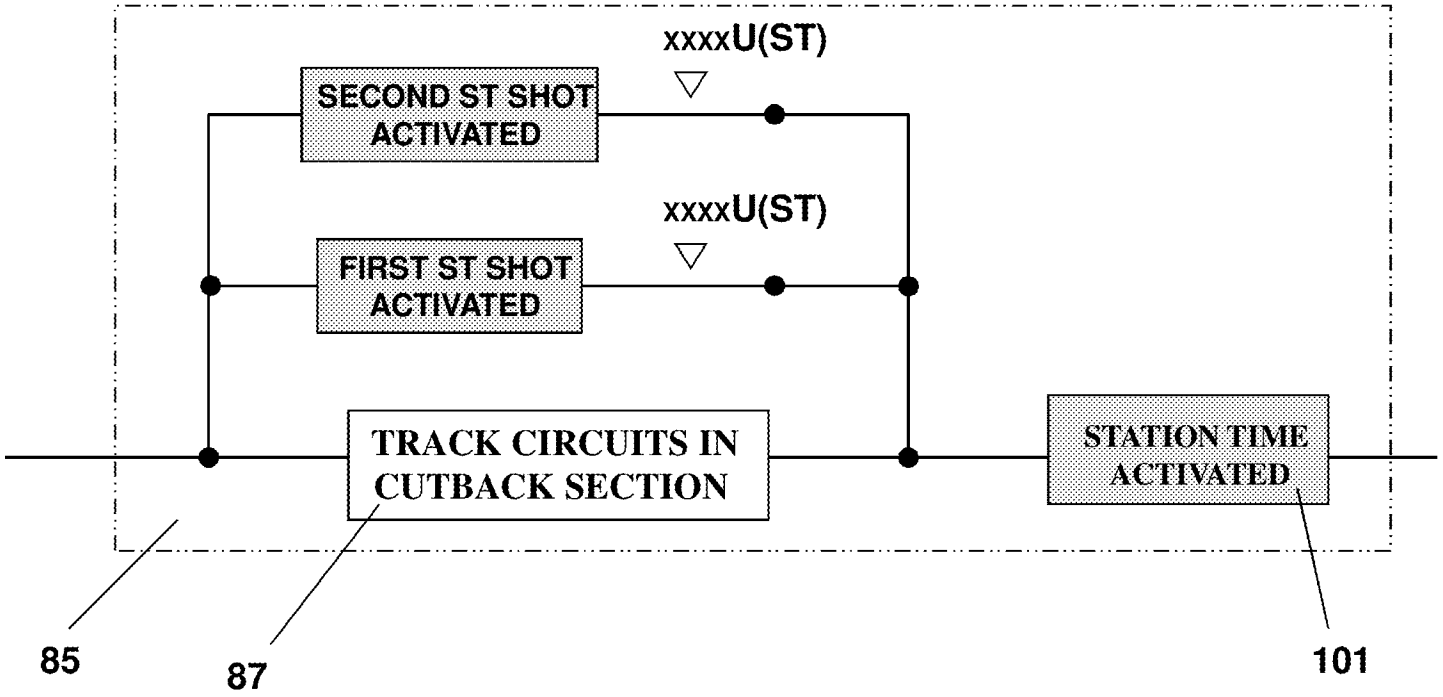
FIG. 17 indicates an example of a parameterized relay logic diagram for the station time control function of an automatic signal unit.
Figure 18:
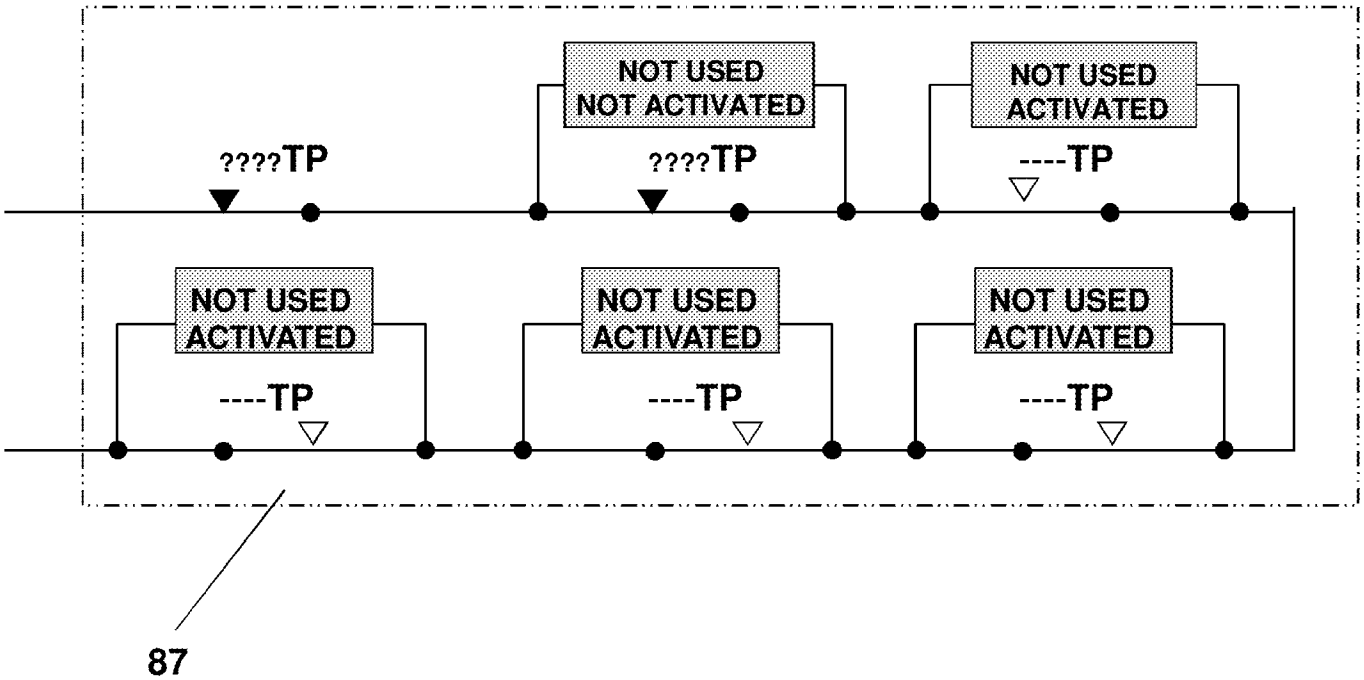
FIG. 18 indicates an example of a parameterized relay logic diagram for the cut back section of station time control line for an automatic signal unit.

An example of the parameterized diagram for the "Home Control" functions is shown in FIG. 15. This diagram includes the logic for all secondary functions and features associated with the "H" Control 82. It also includes the "SH" 84, "S" 86, "D" 88 & "STR" 92 functions that control the various aspects for the signal. The parameterized diagram is designed in a modularized fashion using a plurality of logic modules, wherein each module performs the logic for a specific secondary function or feature. For example, the train separation logic block 83, which is shown in FIG. 16, reflects logic based on the track circuits in the solid portion of the control line 63 for the automatic signal location shown in FIG. 12. Similarly, the station time control logic 85, which is shown in FIG. 17, includes logic 87 based on the track circuits in the cutback portion of the control line 61, and associated timers. In turn, an example of the logic for the cutback section 87 is shown in FIG. 18. Examples of other logic modules for secondary functions that are indicated in FIG. 15 include Grade Time/TSR control function 89, Timer Back Check function 91, and Directional Control function 93.

FIG. 15 also shows the various parameters that activate, or inactivate the various logic modules for the "Home Control" functions in order to customize the ISD to a particular location. These parameters are indicated by shaded blocks, and are integrated into the logic so that a parameter is either in series or in parallel with a logic module. A series parameter must have a "TRUE" value in order to activate its associated module. Conversely, a parallel parameter must have a "FALSE" value in order to activate its associated logic module. For example, if the "ST NOT ACTIVATED" parameter 95, is set to "TRUE" then the "STATION TIME CONTROL" logic module 85 is bypassed. Similarly, if the "TSR NOT ACTIVATED" parameter 97 is set to "TRUE," and the "GT NOT ACTIVATED" parameter 99 is also set to "TRUE," then the "GRADE TIME/TSR CONTROL" logic module 89 is bypassed.

These parameters are also integrated in the logic modules for the secondary logic functions. For example, in FIG. 17 the control logic for the "STATION TIME CONTROL" function 85 is activated only if the "STATION TIME ACTIVATED" parameter 101 is set to "TRUE." Similarly, in FIG. 19, if the "TSR ENABLED" parameter 103 is set to "TRUE" then upon a request by the user to establish temporary speed restriction 104, the "TSR ACTIVATED" parameter 105 is set to "TRUE." In turn, as shown in FIG. 20, when the "TSR ACTIVATED" parameter 105 is set to "TRUE," the temporary speed restriction logic 106 is placed in effect. Other logic modules for secondary logic include the train separation logic 83 indicated in FIG. 16, the timer back check logic 91 shown in FIG. 21, The directional control logic 93 indicated in FIG. 22, the next signal cycle check logic 94 shown in FIG. 23, and the timer control logic shown in FIGS. 24 and 25.

Figure 27:
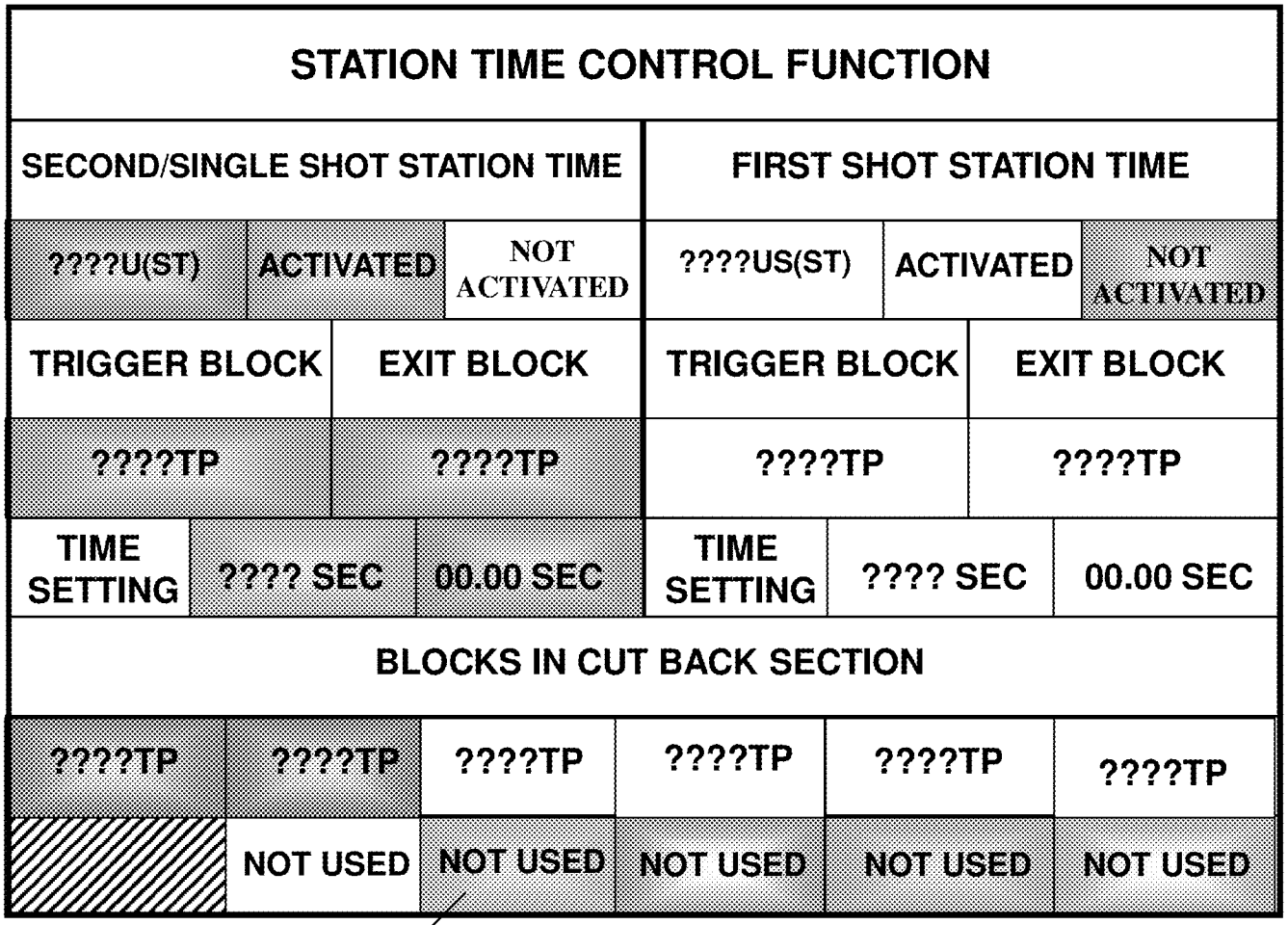
FIG. 27 shows an example of a graphic user interface diagram of the various parameters incorporated in the station time control function of an automatic signal unit.
Figure 28:
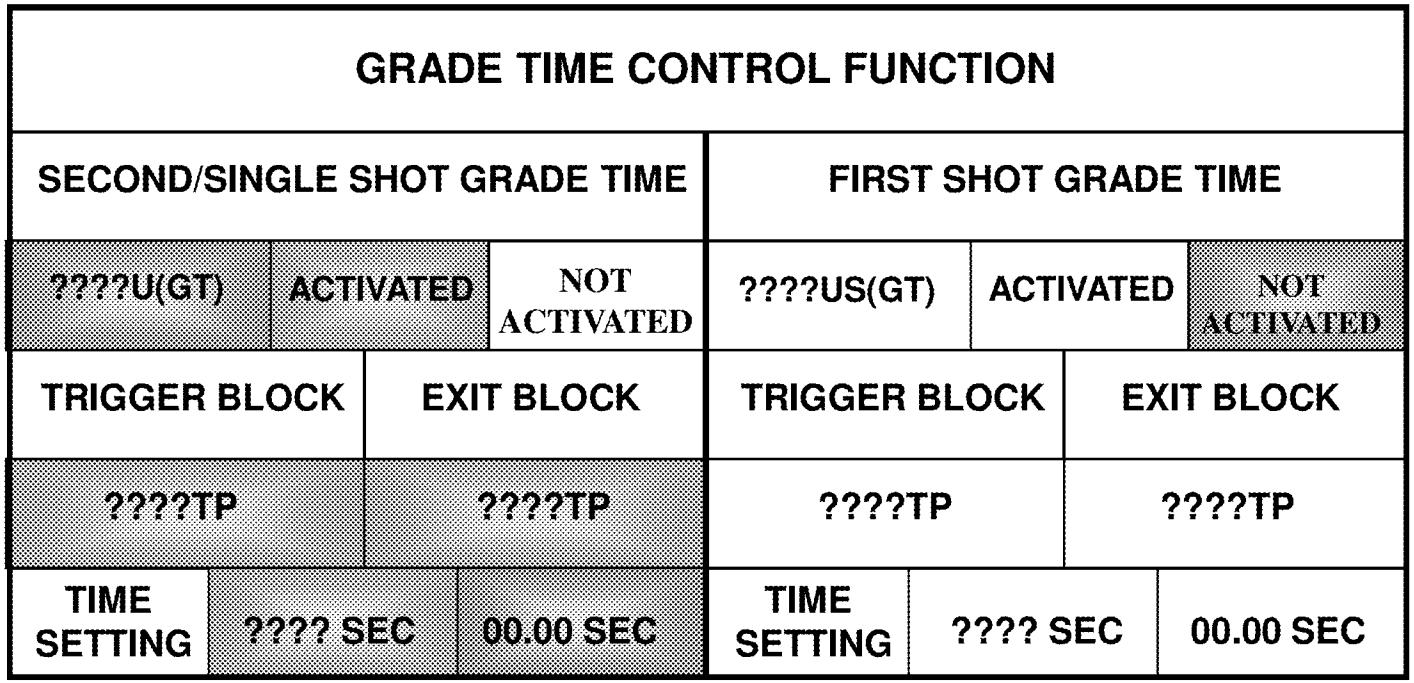
FIG. 28 shows an example of a graphic user interface diagram of the various parameters incorporated in the grade time control function of an automatic signal unit.
Figure 29:
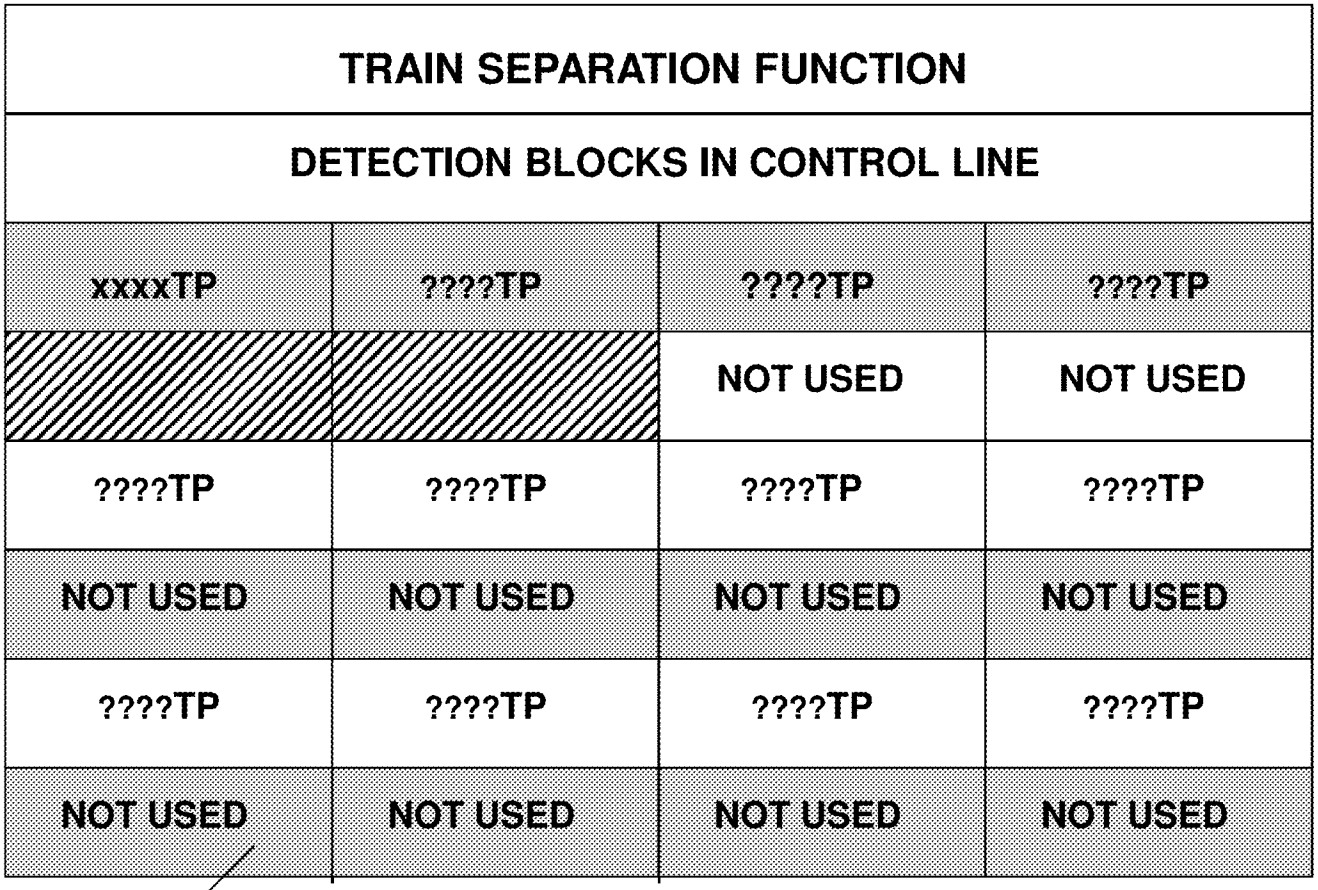
FIG. 29 shows an example of a graphic user interface diagram of the various parameters incorporated in the train separation function of an automatic signal unit.
Figure 30:
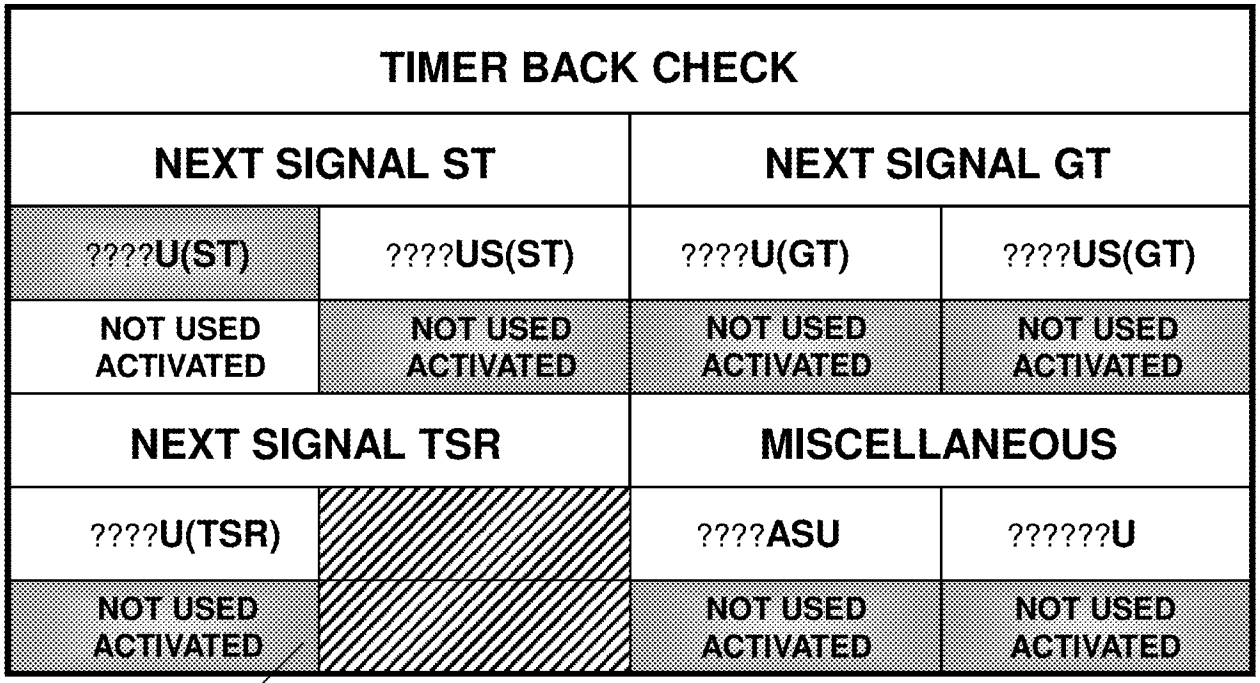
FIG. 30 shows an example of a graphic user interface diagram of the various parameters incorporated in the timer back check function of an automatic signal unit.

To set the activating & enabling parameters for the "Home Control" functions, the signal engineer is presented with a series of graphic user interface screens that indicate all of the available parameters. First, the signal engineer is instructed to activate the desired secondary control functions for the "Home Control" as shown in FIG. 26. Then upon the selection of said secondary control functions, the signal engineer is presented with a series of additional screens that indicate the detailed parameters, and required data fields for each of the activated secondary control functions. Examples of additional screens include station time control function in FIG. 27, the grade time control function in FIG. 28, the train separation function in FIG. 29, and the timer back check function in FIG. 30. For each of these screens, the signal engineer is instructed to set the appropriate parameters for the automatic signal location, and enter the nomenclatures for the required data fields. Further, as indicated in FIGS. 27, 29 and 30, the "NOT USED" parameter 107 is provided to enable the signal engineer to, for example, establish the number of track circuits in the train separation function 83.

Figure 31:
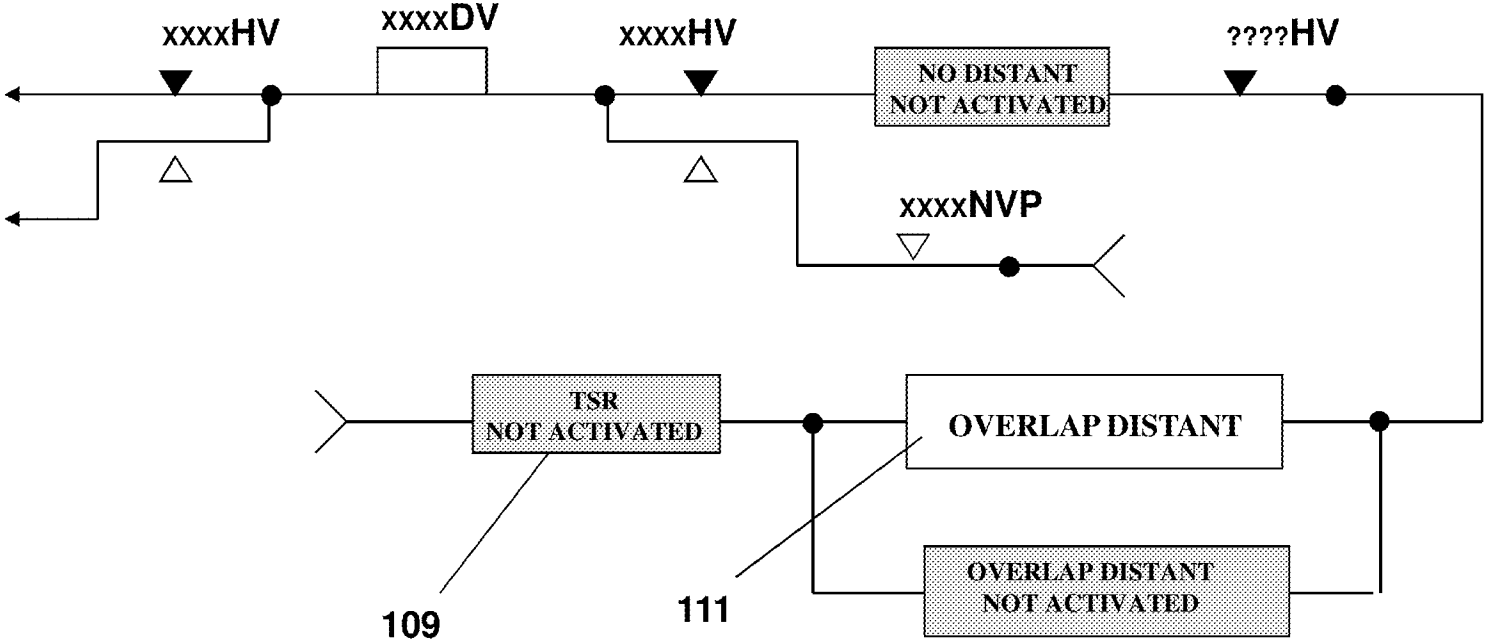
FIG. 31 indicates an example of parameterized relay logic diagram for the distant control function at an automatic signal unit.
Figure 32:
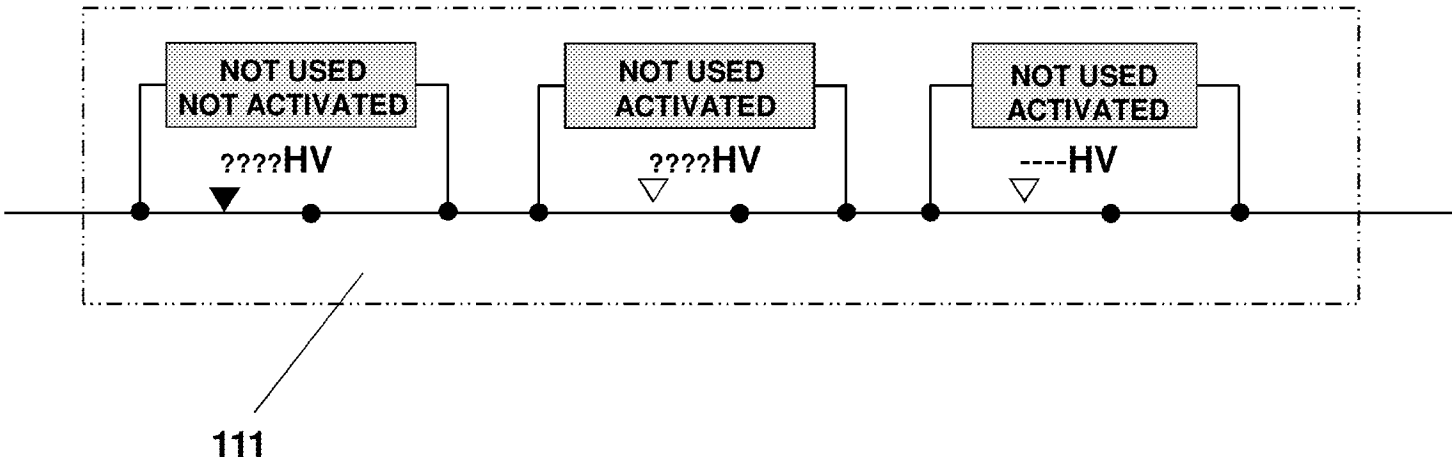
FIG. 32 indicates an example of parameterized relay logic diagram for an overlap distant control at an automatic signal unit.
Figure 33:
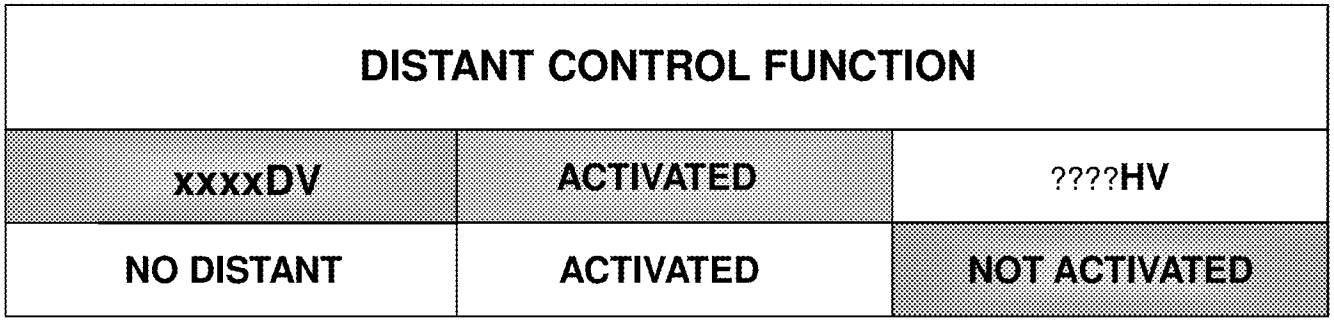
FIG. 33 shows an example of a graphic user interface diagram of the various parameters incorporated in the distant control function of an automatic signal unit.
Figure 34:
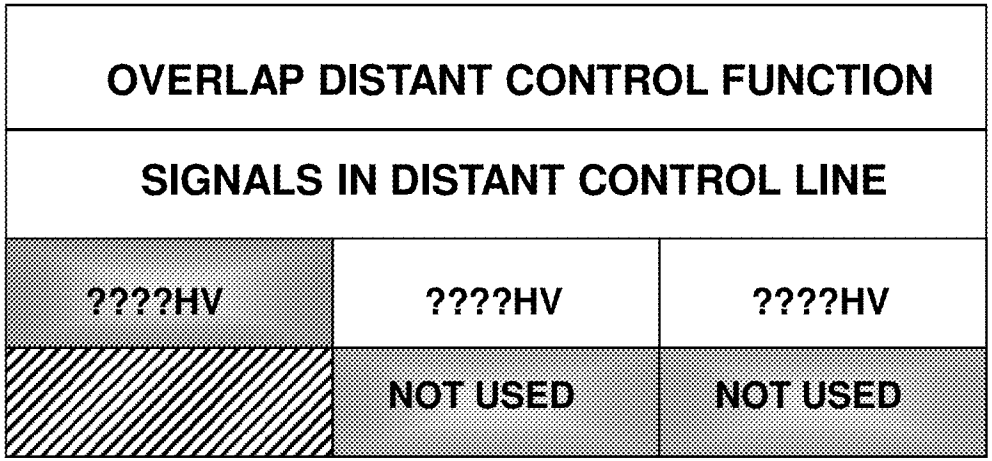
FIG. 34 shows an example of a graphic user interface diagram of the various parameters incorporated in the overlap distant control function of an automatic signal unit.

Similar to the "Home Control" function, an example of the parameterized diagram for the "Distant Control" function is shown in FIG. 31. In turn, the logic for the "Overlap Distant" control function 111 is shown in FIG. 32. One of the parameters used in the "Distant Control" function is the "TSR NOT ACTIVATED" parameter 109, which must be set to "TRUE" for the "Distant Control" function to be in effect. When the "TSR NOT ACTIVATED" parameter is set to "FALSE," i.e., the temporary speed restriction is activated, then the automatic signal location will be limited to yellow and red indications. Also, examples of the graphic user interface screens associated with the "Distant Control" function are shown in FIGS. 33 and 34.

Figure 35:
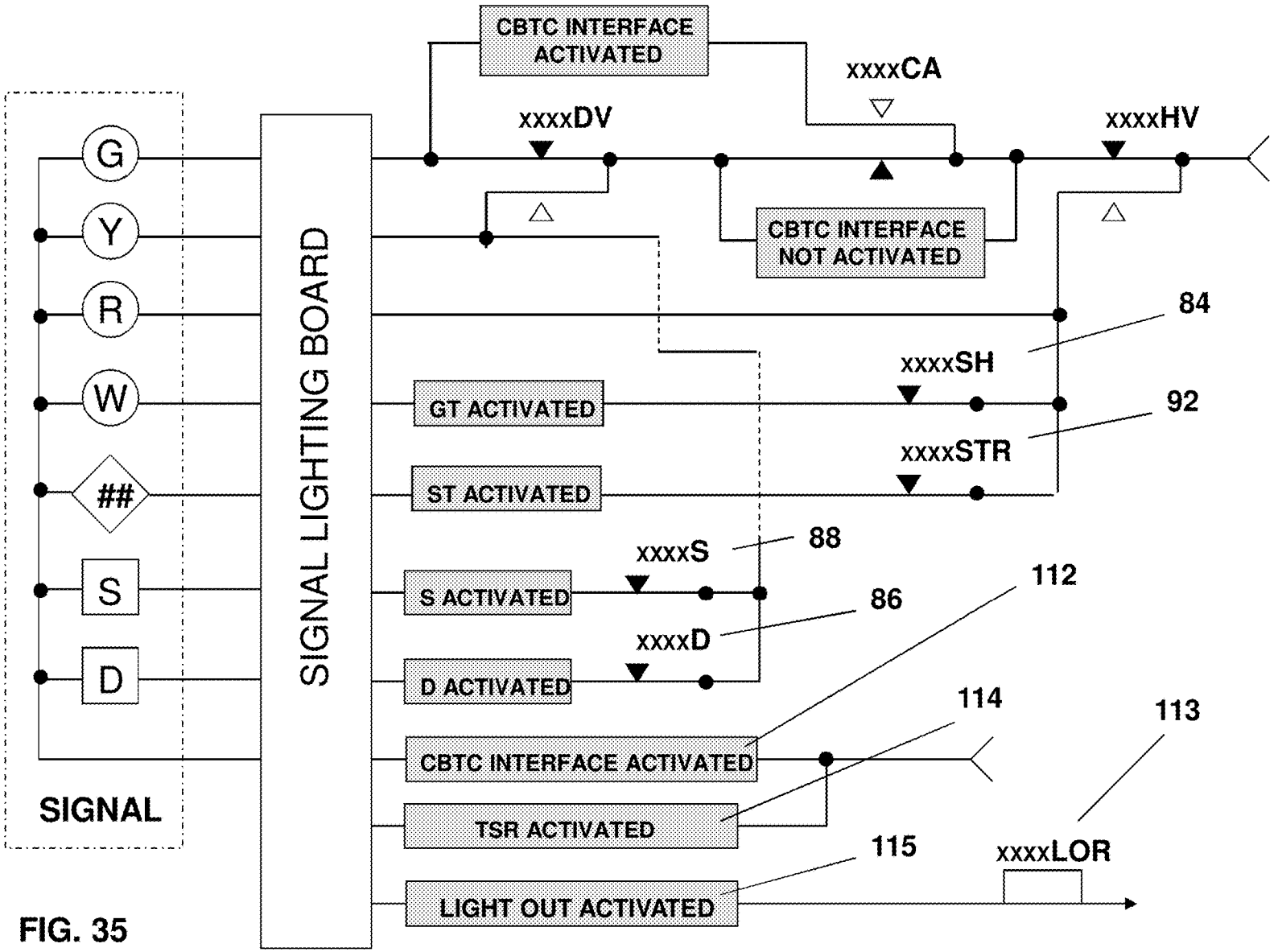
FIG. 35 indicates an example of parameterized relay logic diagram for the signal lighting function at an automatic signal unit.

An example of the parameterized diagram for the "Signal Lighting" function is shown in FIG. 35. One of the parameters used in the "Signal Lighting" function is the "LIGHT OUT ACTIVATED" parameter 115, which must be set to "TRUE" for the light out function 113 to be in effect. Other parameters include the "CBTC INTERFACE ACTIVATED" parameter 112, and the "TSR ACTIVATED" parameter 114. If either of these two parameters is set to "TRUE," then the aspect selected by the remaining logic of the "Signal Lighting" function is flashed. Also, an example of the graphic user interface screen associated with the "Signal Lighting" function is shown in FIG. 36.

Figure 37:
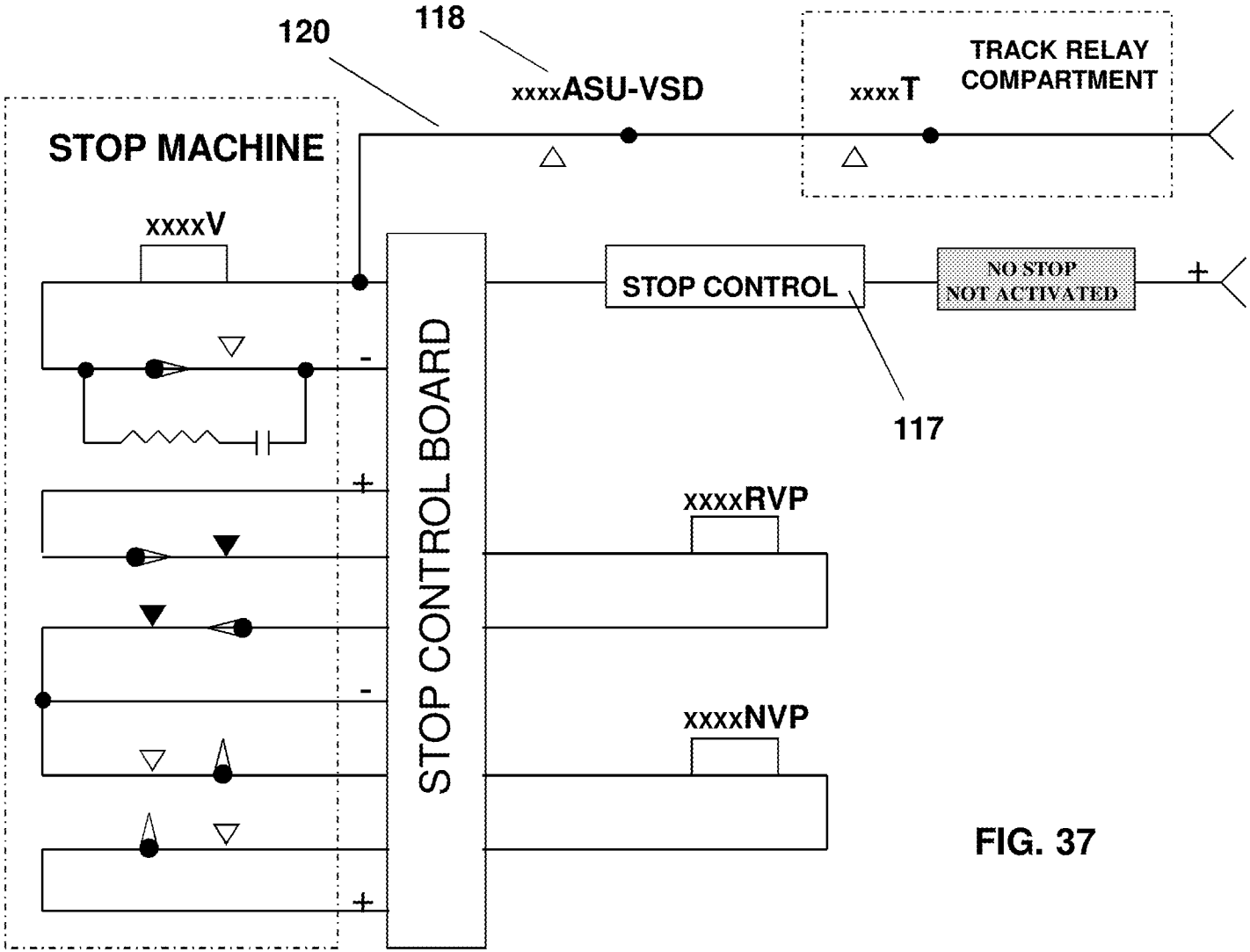
FIGS. 37 and 38 indicate an example of parameterized relay logic diagrams for the automatic stop control functions at an automatic signal unit.
Figure 38:
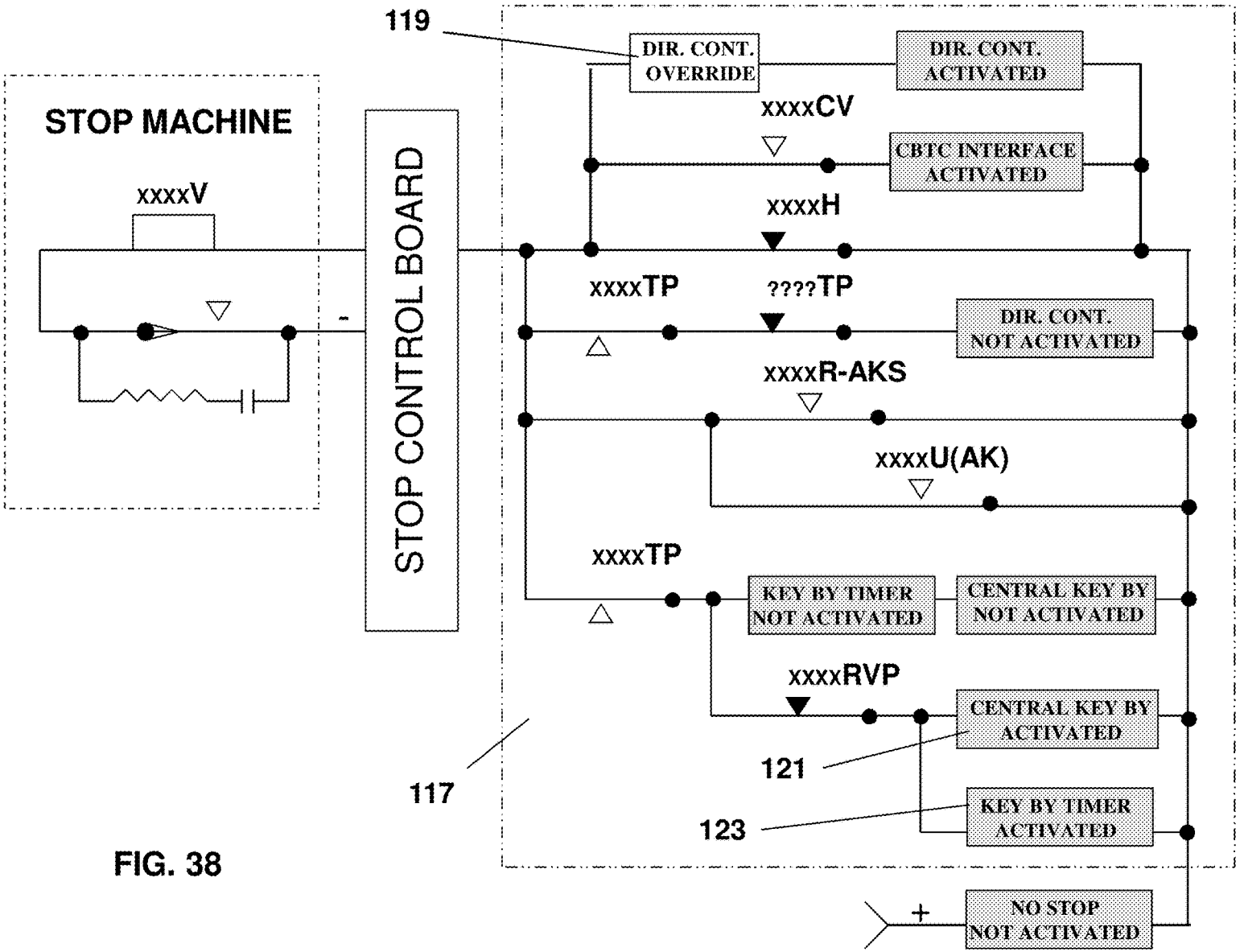
Figure 39:
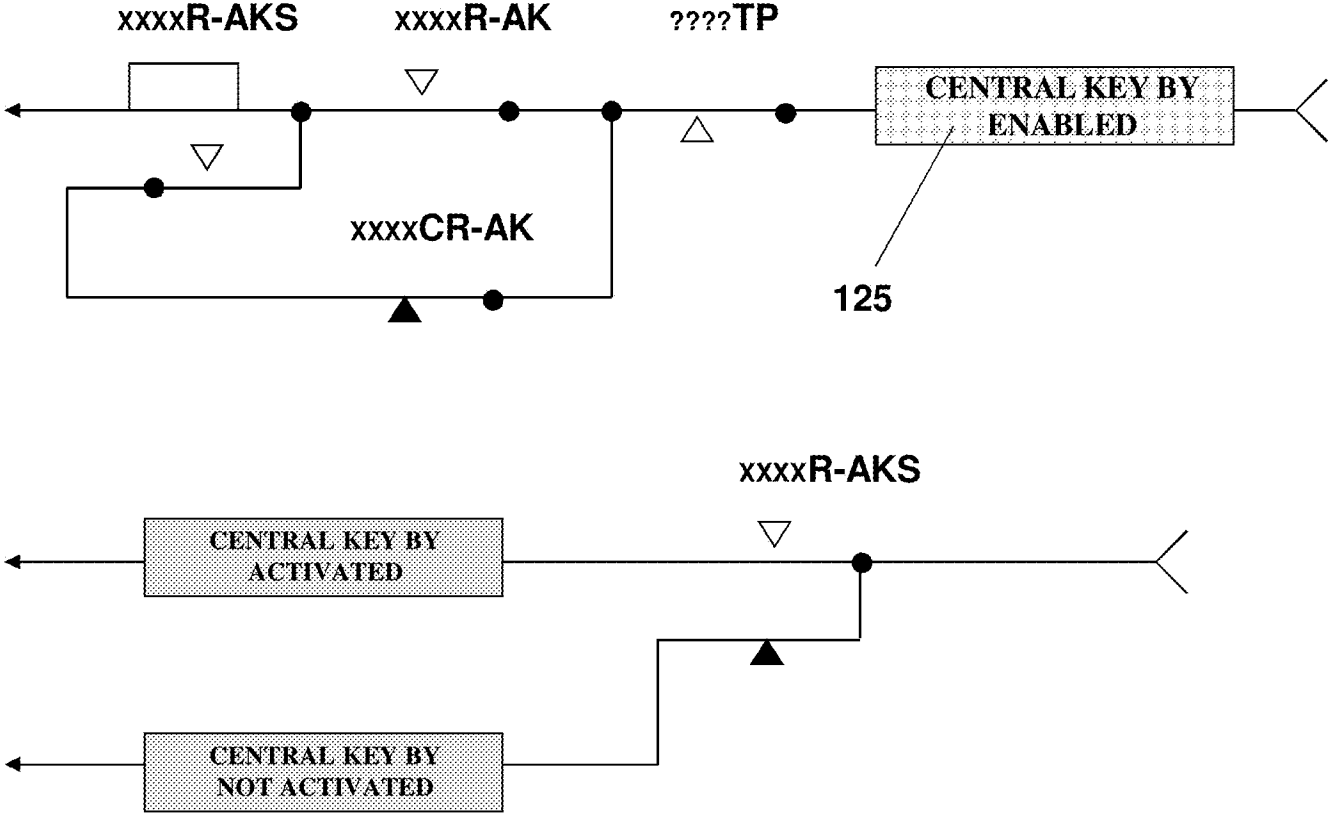
FIG. 39 shows an example of an enabling parameter for the central key-by control function at an automatic signal unit.
Figure 40:
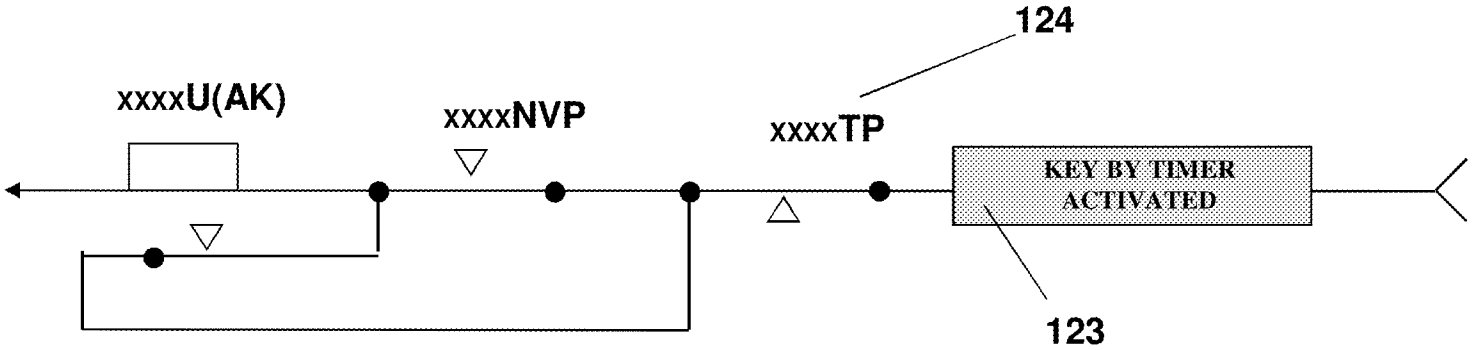
FIG. 40 indicates an example of parameterized relay logic diagram for the key-by timer function at an automatic signal unit.
Figure 41:
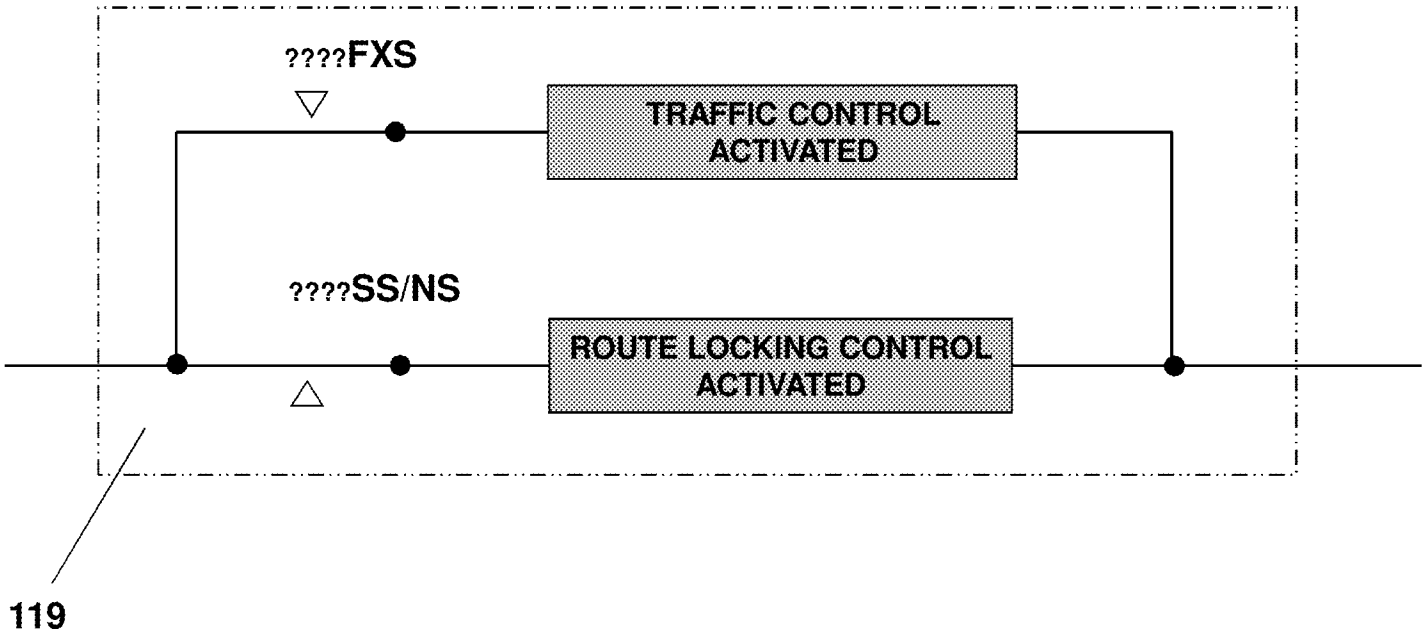
FIG. 41 indicates an example of parameterized relay logic diagram for the directional control segment for the automatic stop control function at an automatic signal unit.
Figure 42:
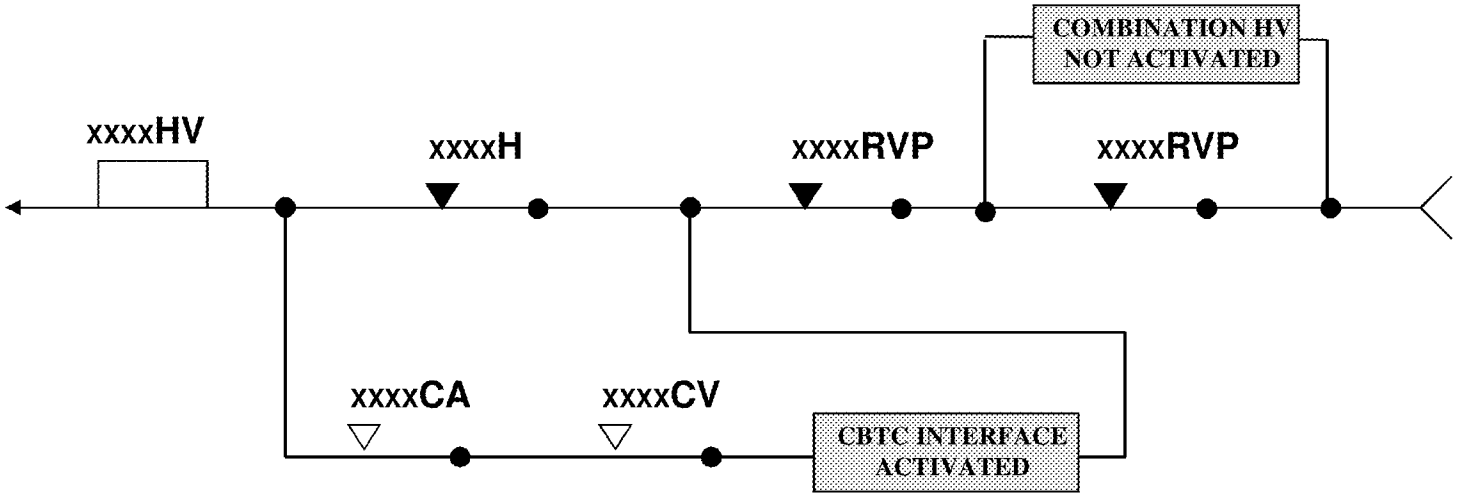
FIG. 42 indicates an example of parameterized relay logic diagram for the home stop clear repeater function at an automatic signal unit.
Figure 44:
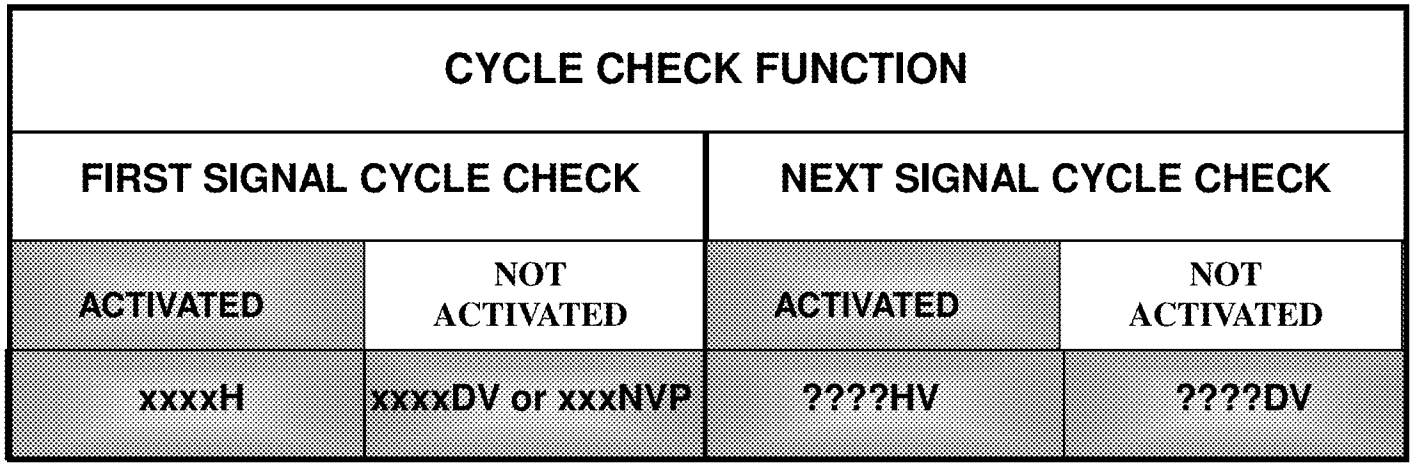
FIG. 44 shows an example of a graphic user interface diagram of the various parameters incorporated in the cycle check function of an automatic signal unit.
Figure 45:
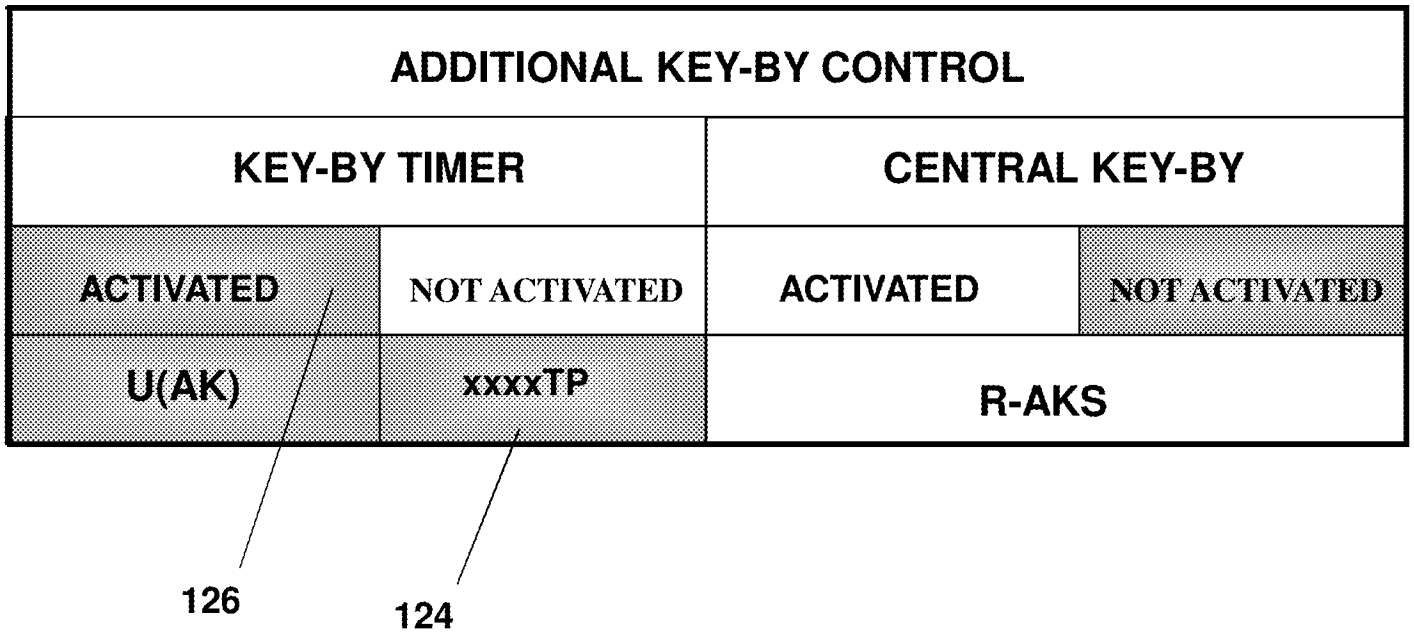
FIG. 45 indicates an example of a graphic user interface diagram of the various parameters incorporated in the additional key-by control functions of an automatic signal unit.

An example of the parameterized diagram for the "Stop Control" functions is shown in FIGS. 37 and 38. A hard wired by-pass circuit 120 is used to provide a manual key-by function in the event of a vital shutdown 118 of the ISD that controls the automatic signal unit. Examples of the parameters used in the "Stop Control" diagram 117 are the "CENTRAL KEY BY ACTIVATED" parameter 121, and the "KEY BY TIMER ACTIVATED" parameter 123. These two parameters provide alternate means to control the Key-By function. The central key-by logic is shown in FIG. 39, and employs the "CENTRAL KEY BY ENABLED" parameter 125. The key-by timer logic is shown in FIG. 40, and is placed in effect by the "KEY BY TIMER ACTIVATED" parameter 123. Other logic modules for the "Stop Control" functions are shown in FIGS. 41 and 42. Also, examples of the graphic user interface screens associated with the "Stop Control" function are shown in FIGS. 43, 44 and 45.

Figure 46:
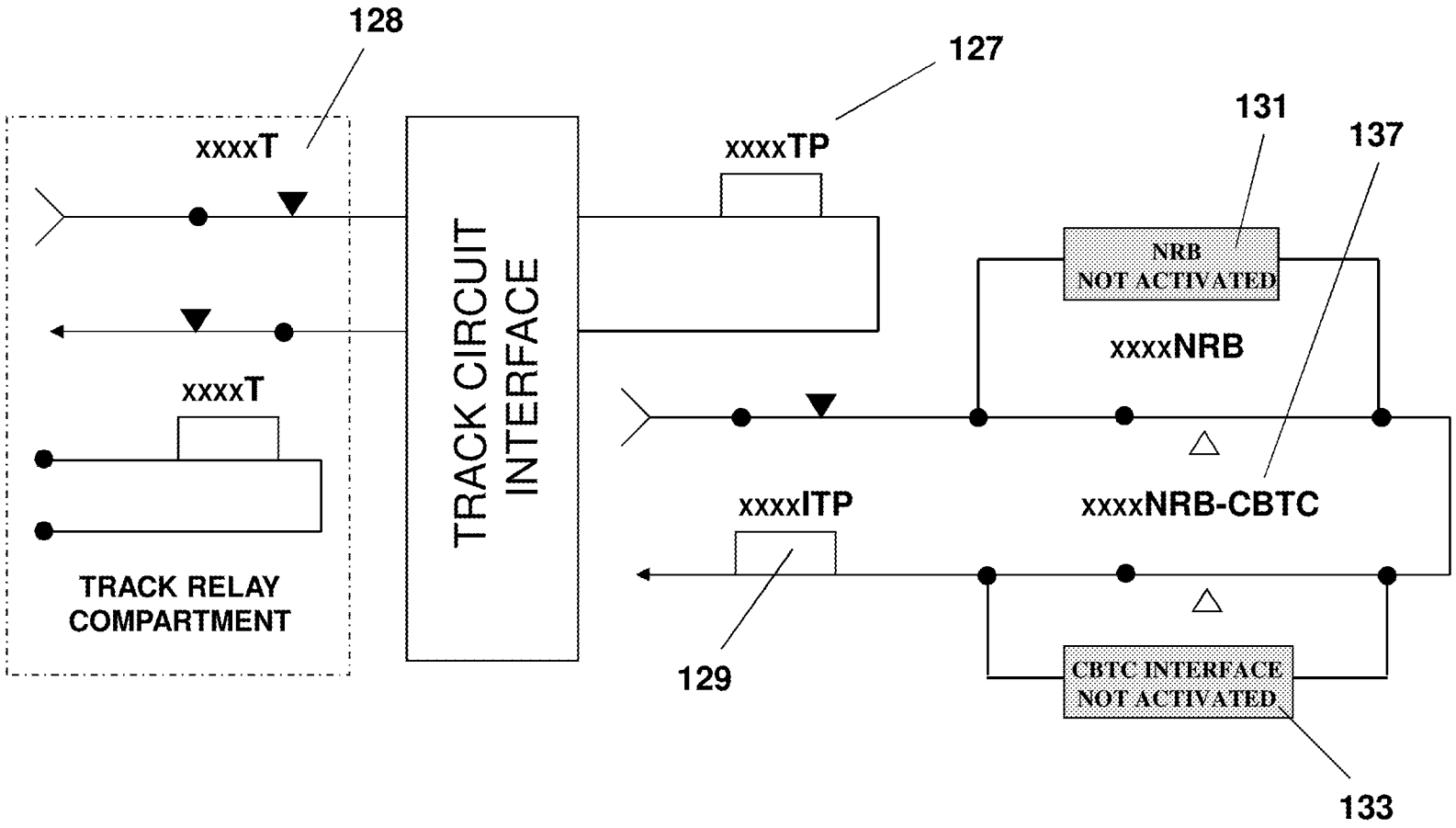
FIGS. 46 and 47 indicate an example of parameterized relay logic diagrams for the train detection (track circuit) functions at an automatic signal unit.
Figure 47:
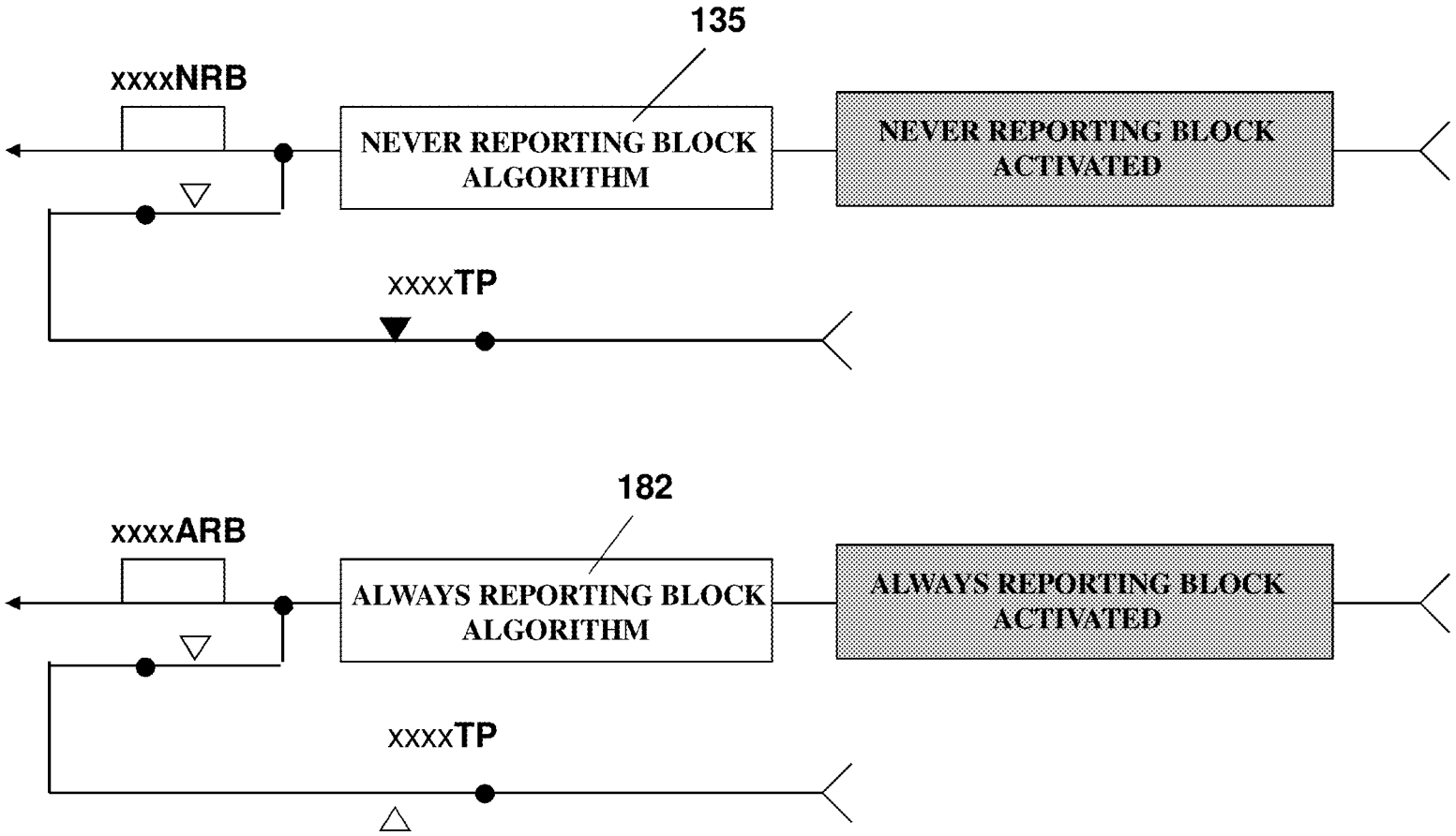

An example of the parameterized diagram for the "Block Detection" functions is shown in FIGS. 46 and 47. These functions include the conventional track repeater (TP) function 127, and the "Intelligent Track Repeater" (ITP) function 129. The ITP function is controlled by two alternate parameters, namely the "NRB NOT ACTIVATED" parameter 131, and the "CBTC INTERFACE NOT ACTIVATED" parameter 133. Unlike the conventional TP function 127 that simply repeats the status of the track relay, the ITP function 129 is set to "FALSE" if the ISD detects a "Never Reporting Block" (NRB) condition 135, even if the rack relay 128 is energized. The NRB condition could also be detected by CBTC 137. The graphic user interface screen associated with the "Block Detection" function is shown in FIG. 48.

Figure 49:
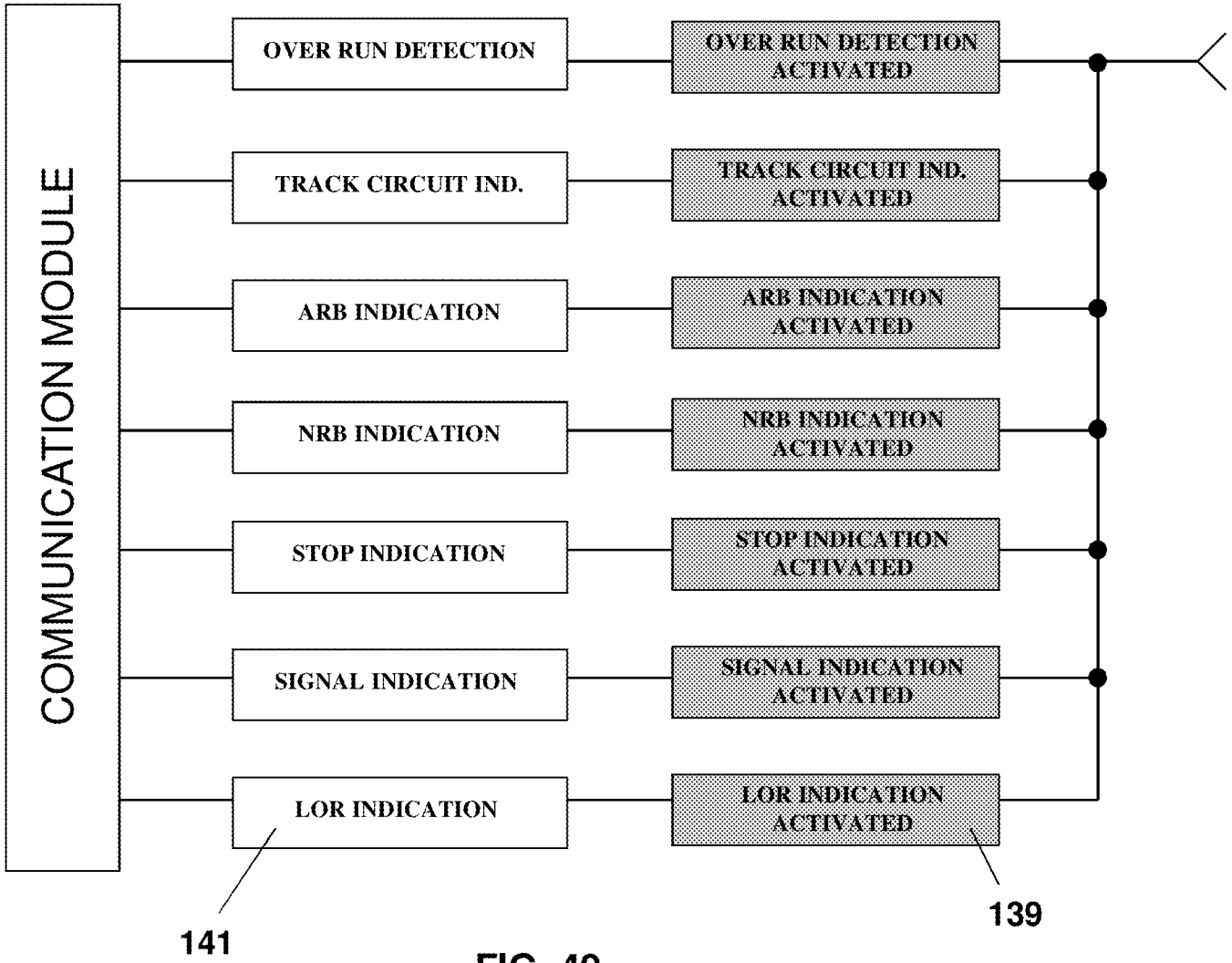
FIG. 49 indicates an example of parameterized relay logic diagram for the various indication functions at an automatic signal unit.

An example of the parameterized diagram for the "Indication" functions 81 is shown in FIG. 49, and includes a plurality of activating parameters 139, each of which activates a particular indication function 141. An example of the associated graphic user interface screen is indicated in FIG. 50.

Figure 51:
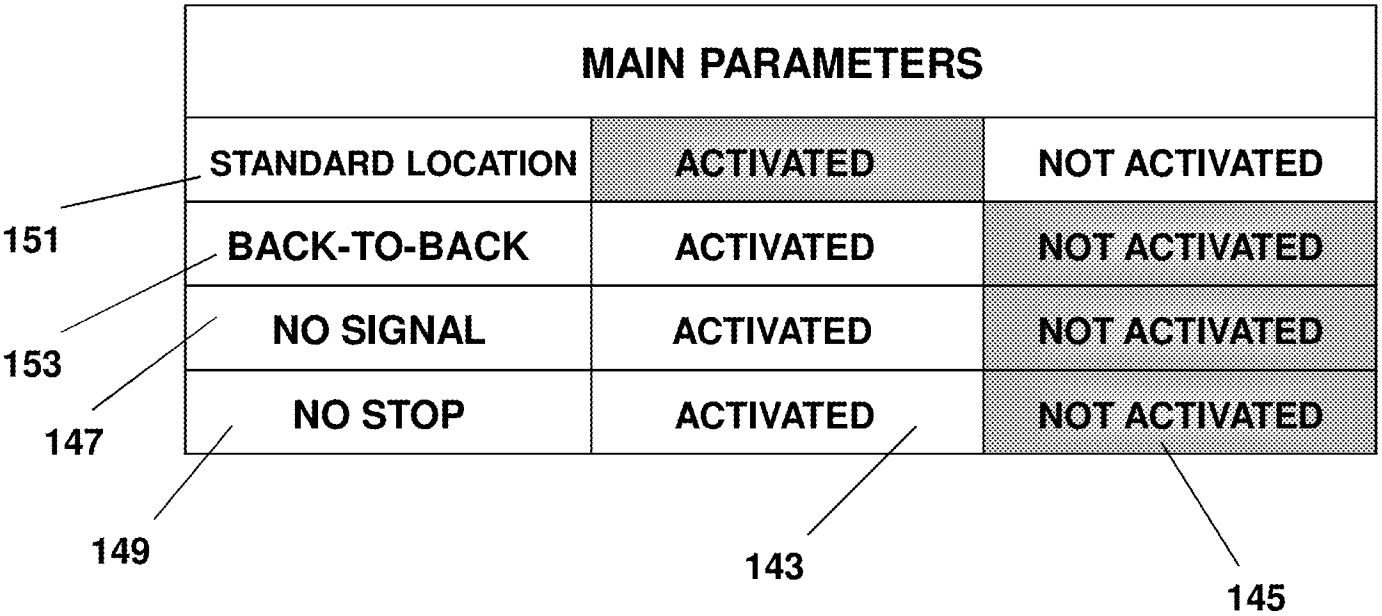
FIG. 51 shows an example of a graphic user interface diagram of the main parameters incorporated at an automatic signal unit.

In addition to the above described six (6) primary signal control functions, there are a number of main parameters that define the signal equipment present at an automatic signal location. Examples of these parameters are shown in FIG. 51, and enable a signal engineer to define if the location is a standard signal location (i.e. includes a signal head and an automatic stop mechanism), if it is a blind stop location (i.e. no signal head), if it does not include an automatic stop mechanism, and/or if it is a "back-to-back" signal location. The signal engineer establishes the desired parameter for a location by selecting either the "ACTIVATED" 143, or the "NOT ACTIVATED" 145 buttons on the GUI screen.

The design of the programming kit is such that it detects obvious errors, and inconsistent selections by the signal engineer. For example, with respect to the main parameters shown in FIG. 51, the consistency check will not permit the simultaneous activation of "NO SIGNAL" 147 and "NO STOP" 149. Similarly, the activation of "STANDARD LOCATION" 151 prevents the activation of "NO SIGNAL" 147 or "NO STOP" 149. As would be appreciated by one skilled in the art, consistency checks could be provided to ensure that there are no contradictions between the parameters activated for the various primary functions. For example, the "Combination HV" parameter 122 indicated in FIG. 43, will be enabled only if the "Back-to-Back" parameter 153 shown in FIG. 51 is activated. Further, the design of the programming kit is such that upon the activation of one parameter for a primary function, other parameters associated with different primary functions are set automatically. For example, if the "Grade Time Control" parameter 108 shown in FIG. 26 is not activated, then both the "FIRST SHOT GRADE TIME" and the "SECOND/SINGLE SHOT GRADE TIME" parameters indicated in FIG. 28 will be automatically set to "NOT ACTIVATED." Similarly, certain data fields are automatically provided upon the activation of a parameter. For example, upon the activation of the "KEY BY TIMER" parameter 126, shown in FIG. 45, the trigger track circuit data field 124 for the key-by timer will be automatically filled.

It should be noted that different and/or additional detailed parameter screens are presented to the signal engineer based on which parameters were activated in previous screens. For example, the detailed parameter screen for the "STATION TIME CONTROL" function shown in FIG. 27 is presented to the signal engineer if the "STATION TIME CONTROL" function 102 shown in FIG. 26 is activated.

The second set of graphic user interface screens is related to the configuration of import and export data. Similar to parameterized logic, a parameterized data configuration simplifies the effort required to identify the import data, and their origins, as well as the export data, and their destination addresses. Because most of the data exchanged takes place between the ASU 20 indicated in FIG. 12, the next signal ahead 170, the signal in advance of it 172, and a back-to-back signal 174 if applicable, these signals are identified and categorized separately in the proposed data configuration screens.

Figure 57:
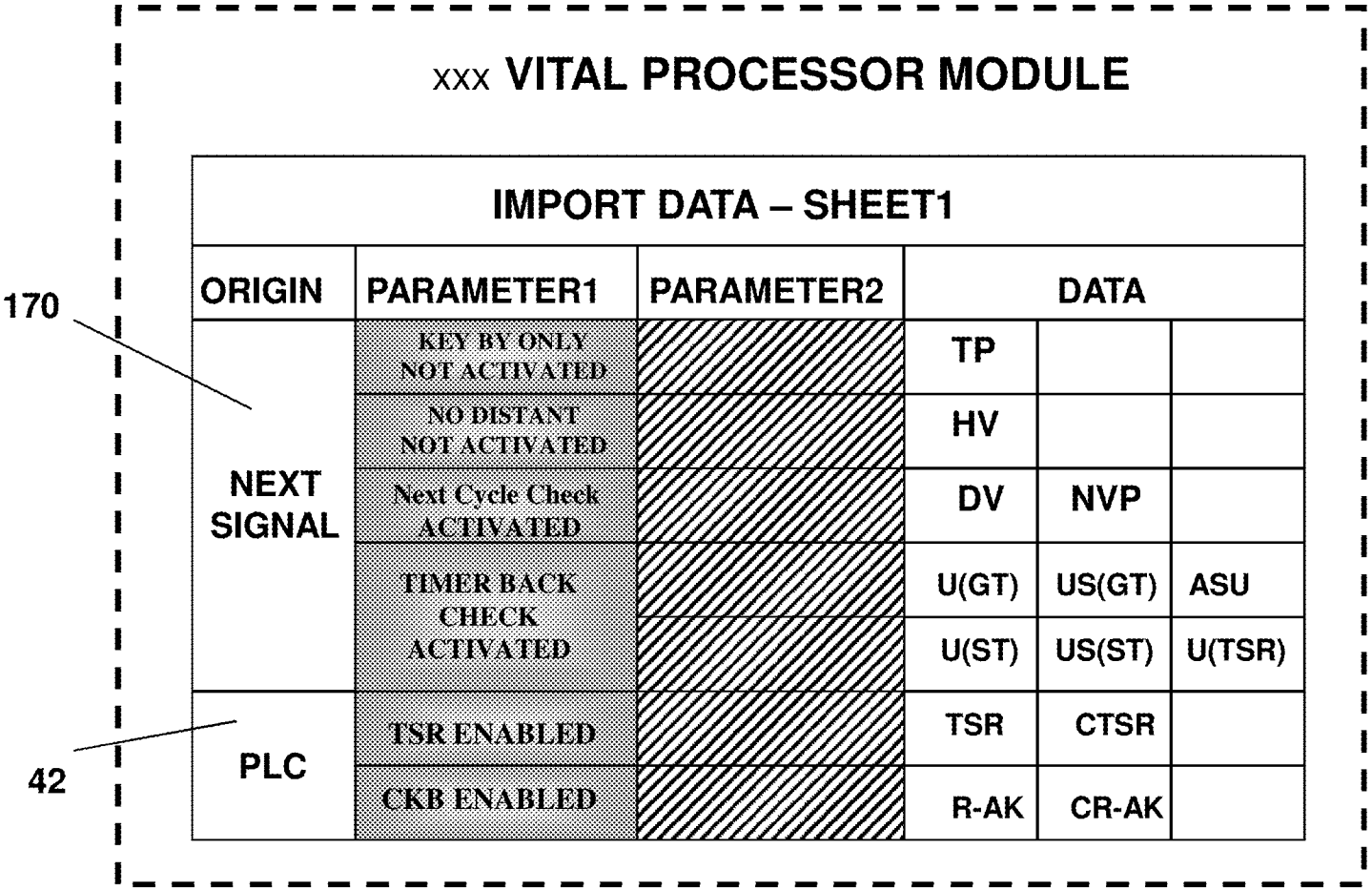
FIGS. 57-59 indicate an example of parameterized import data configuration for an automatic signal unit.
Figure 58:
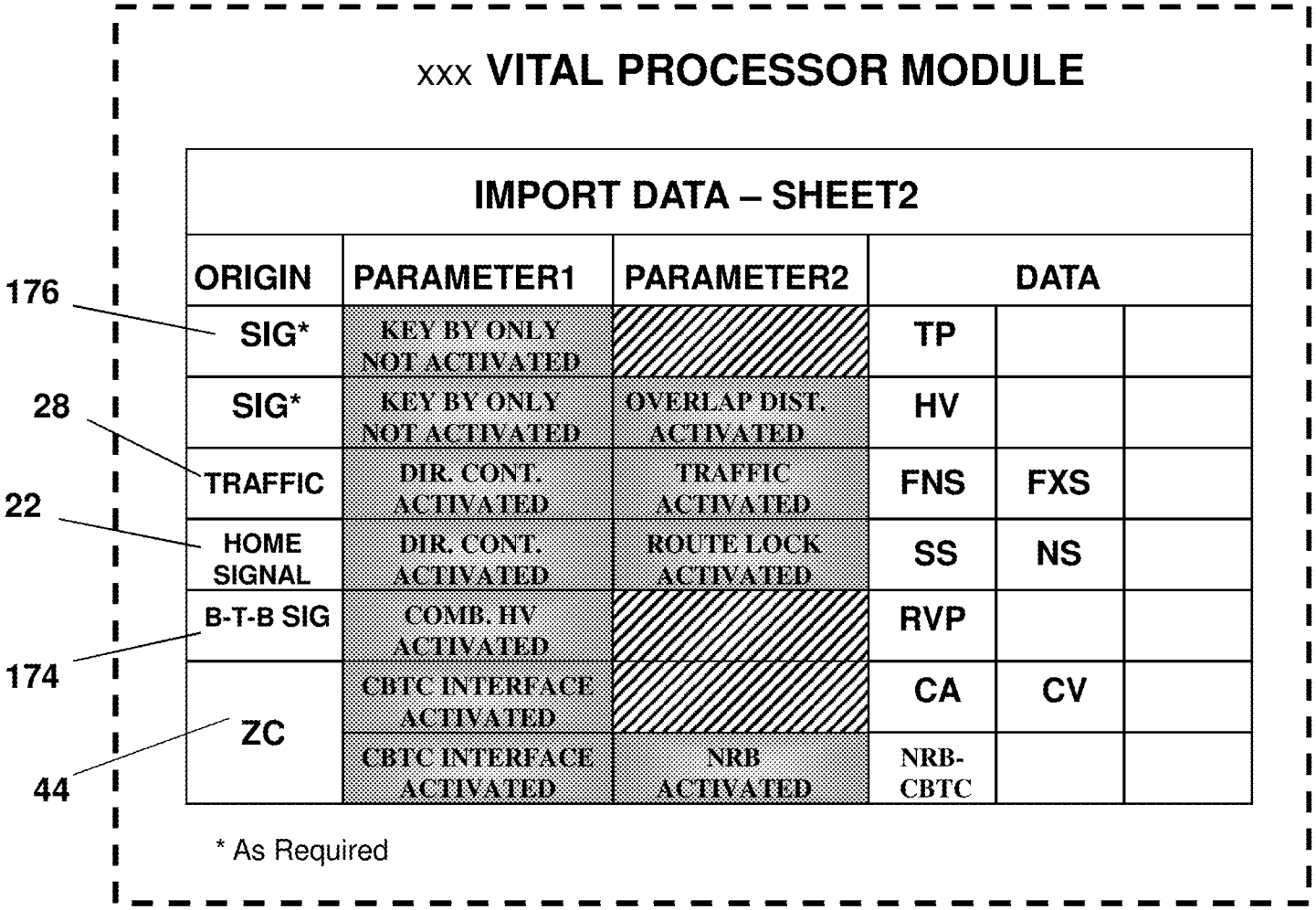
Figure 59:
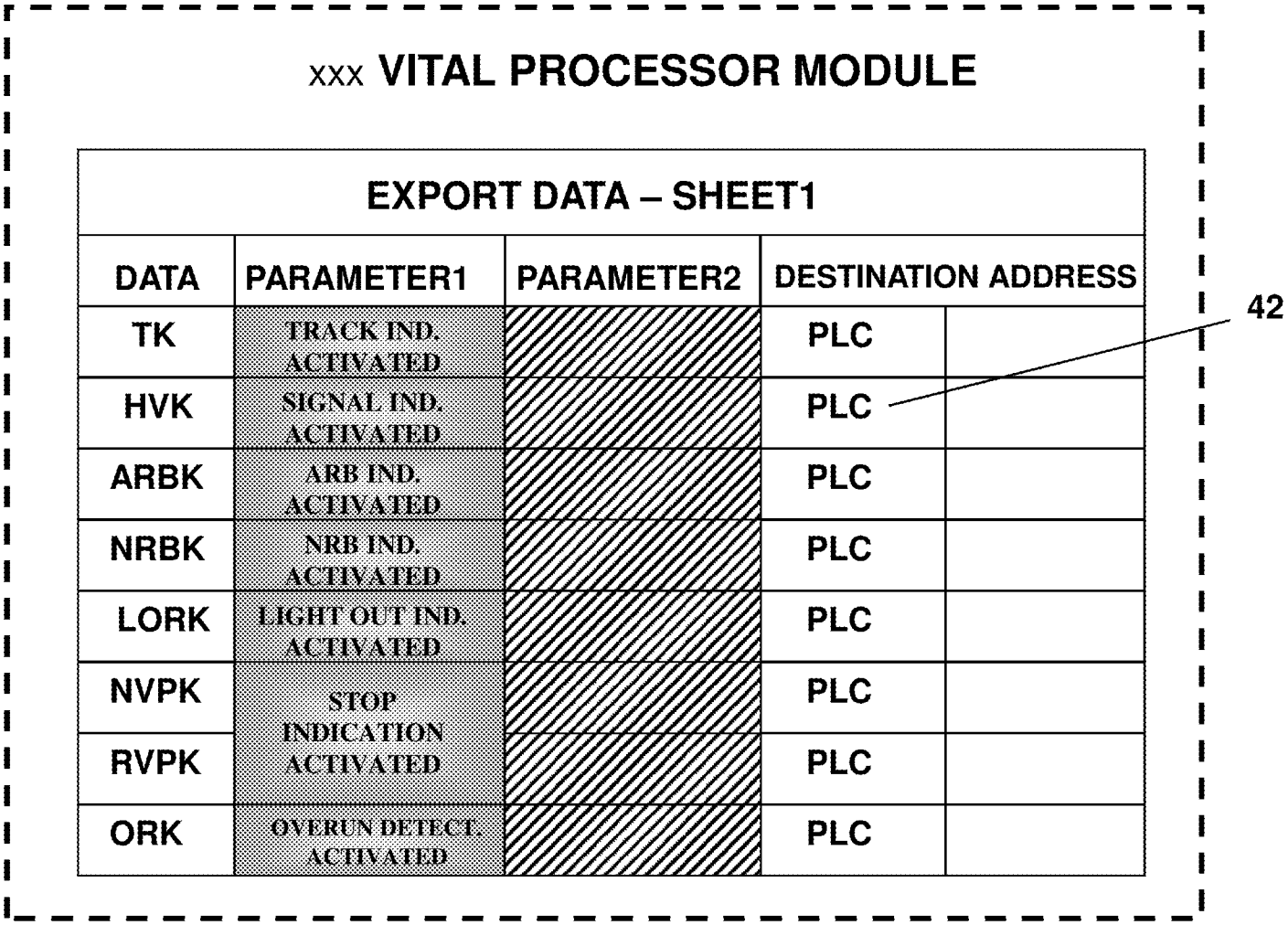
Figure 60:
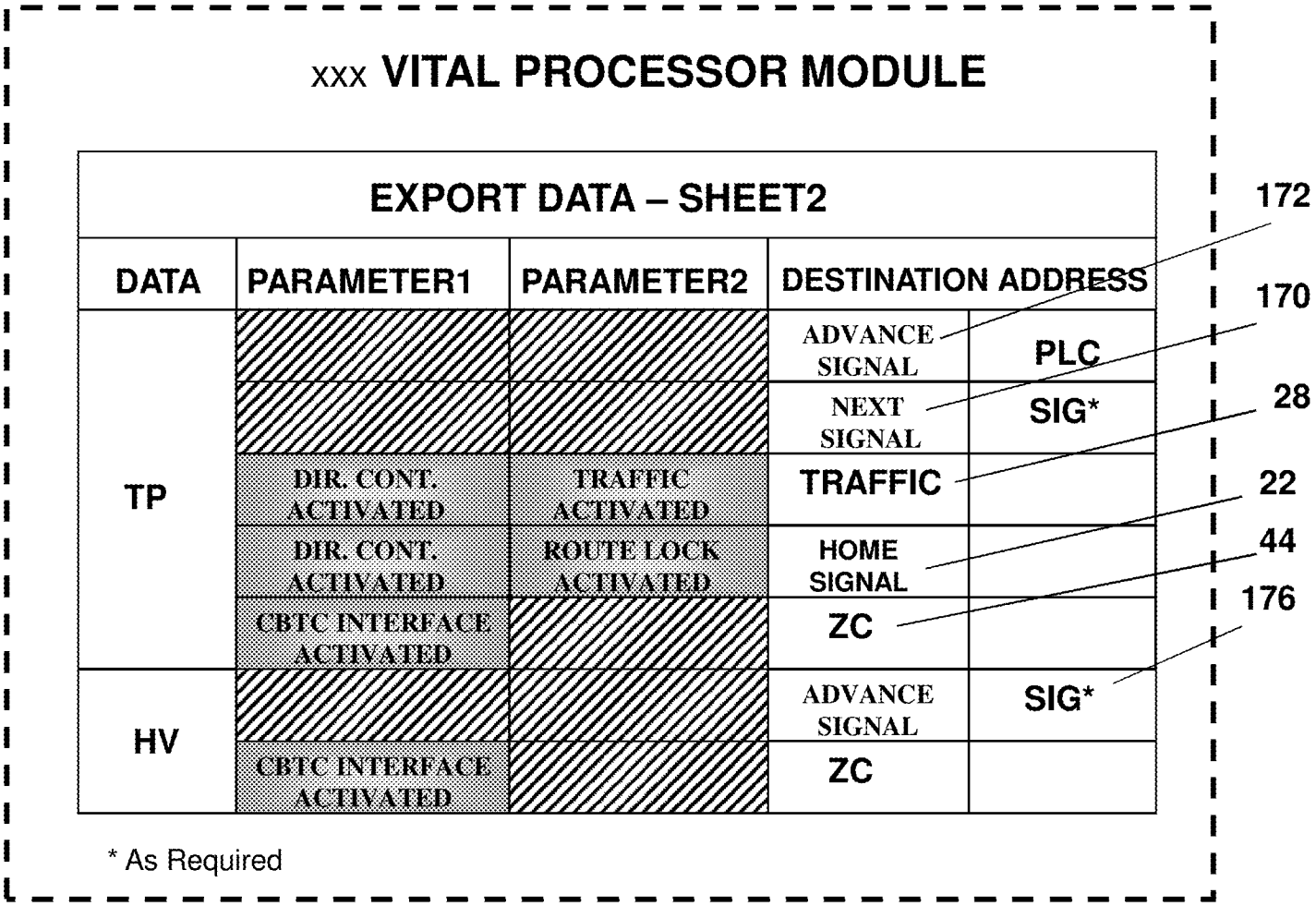
Figure 61:
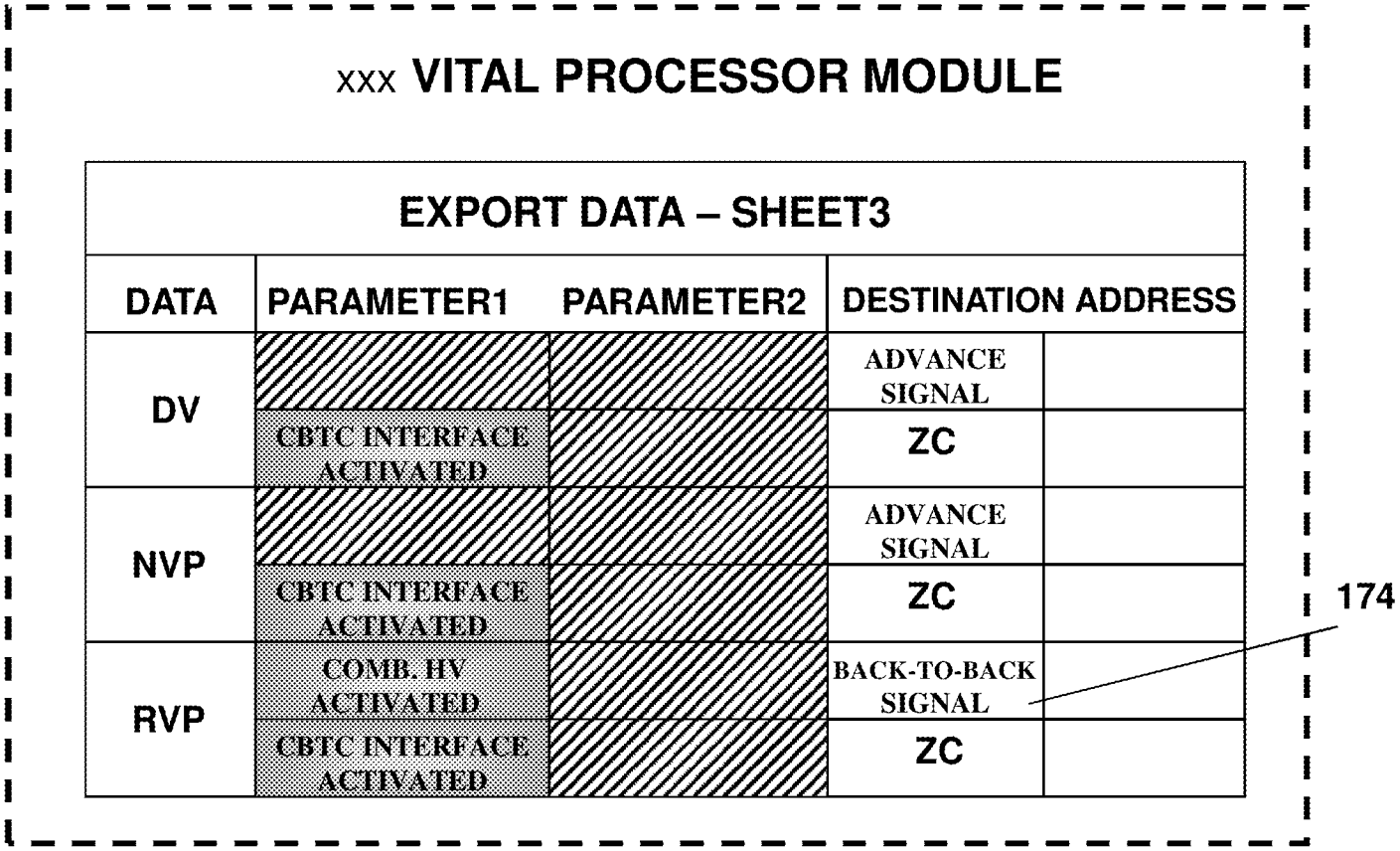

FIGS. 57 and 58 show an example of the general configuration for the import data. The data is configured based on the origination addresses, which include the "next signal" 170, "Back-to-Back Signal" 174, other signals as required 176 (for track circuits in the "H" control line, and/or "HV" function in the distant control line), home signal 22, traffic signal 28, PLC 42, and ZC 44. In this example, up to two parameters are used for each origination address to determine if the associated data fields are required or not.

Similarly, FIGS. 59 to 62 show an example of the general configuration for the export data. The data is configured by the type of functional data generated within the ASU, i.e. TP, HV, DV, etc. In this example, up to two parameters are used for each type of data to determine if the data should, or should not be generated, and if it should be exported to associated destination address(es). The destination addresses include next signal 170, advance signal 172, back-to-back signal 174, zone controller 44, PLC 42, home signal 22, traffic signal 28, and other signal locations as required 176.

As would be understood by those skilled in the art, different or alternate parameterized diagrams could be used. Further, different logic diagrams than those indicated in FIGS. 15 to 51 may be based on the particular signal design standards for a transit or railroad property. The logic and parameterized diagrams shown in FIGS. 15 to 51 are only one example of how to implement the new general concept of integrating a plurality of parameters into logic diagrams for the purpose of developing a generic signal device that could be customized to a particular location with minimum design efforts. It is also to be understood that the foregoing detailed description has been given for clearness of understanding only, and is intended to be exemplary of the invention while not limiting the invention to the exact embodiment shown. Obviously certain subsets, modifications, simplifications, variations and improvements will occur to those skilled in the art upon reading the foregoing.

Figure 5:
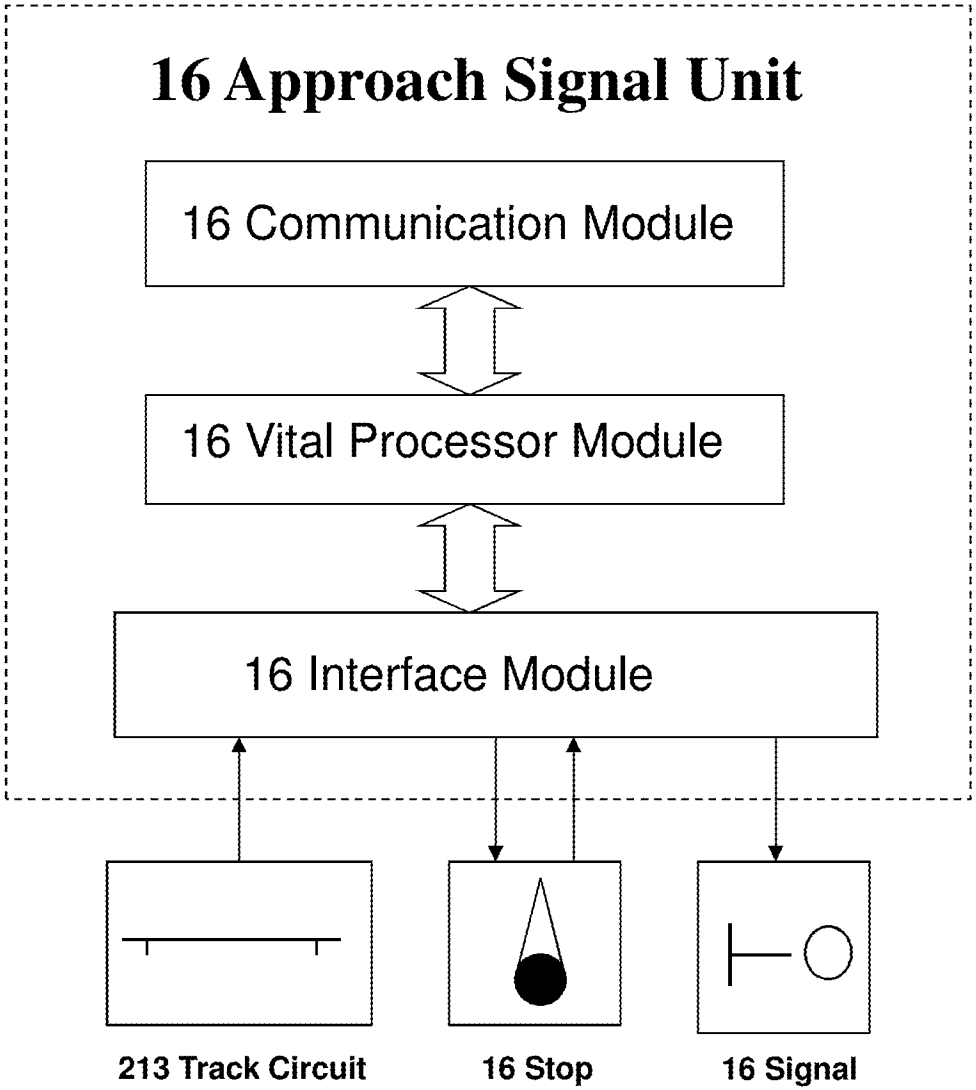
FIG. 5 shows the application of the ISD concept to Approach Signal Unit 16.
Figure 6:
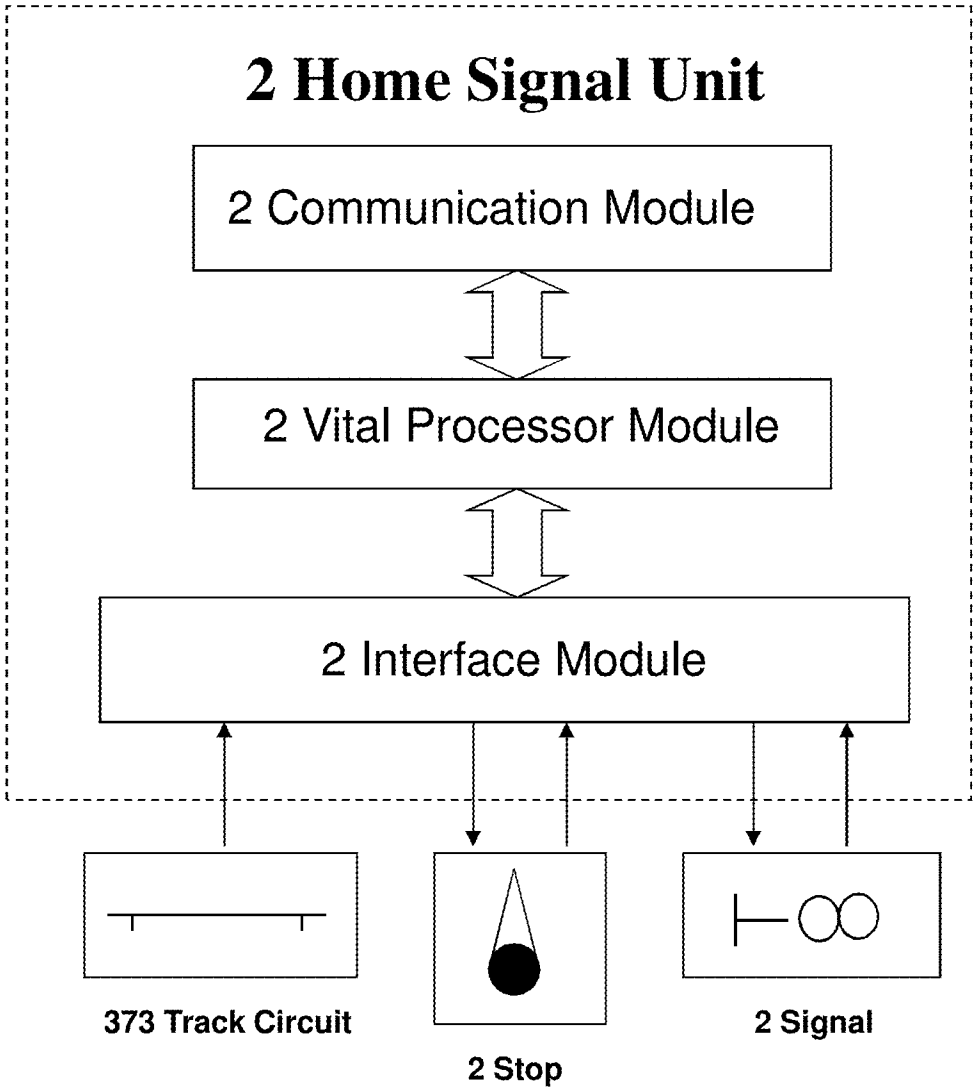
FIG. 6 shows the application of the ISD concept to Home Signal Unit 2.
Figure 7:
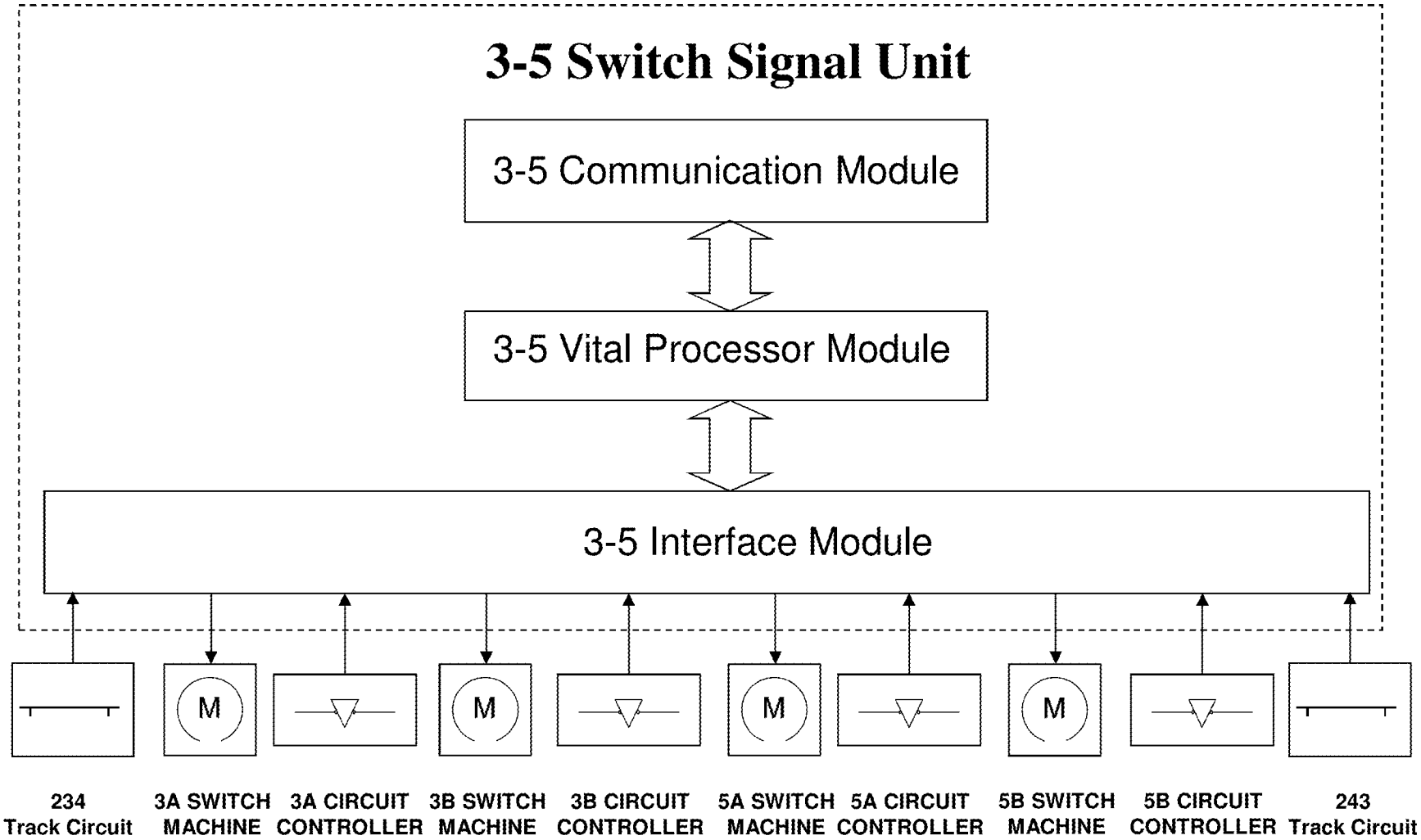
FIG. 7 shows the application of the ISD concept to switch Signal Unit 3-5.

FIGS. 15 to 51 illustrate in details how to use the ISD, and the new concepts disclosed in this invention to develop a generic and intelligent Automatic Signal Unit. As shown in FIGS. 5, 6 and 7, the ISD concept could also be used to provide a generic Approach Signal Unit (PSU), a generic Home Signal Unit (HSU), and a generic Switch Signal Unit (SSU). As would be appreciated by one skilled in the art, the methodology, and process needed to develop these signal units are very similar to the process described above for the Automatic Signal Unit (ASU). Tabulations of the main parameters required for a generic PSU, a generic HSU, and a generic SSU are shown in FIGS. 52, 53 and 54.

The WDN 40 is designed to provide a resilient and fault tolerant backbone that enables high speed data exchange between the various intelligent signal devices that form an electronic interlocking. It is preferable that the network employs a fiber optic backbone with appropriate equipment to provide layer 2 communication services between the various elements of the interlocking, as well as layer 3 communication service (routing) to interface the elements of the electronic interlocking with the ATS server, and/or with operator consoles at dispatcher locations.

Figure 55:
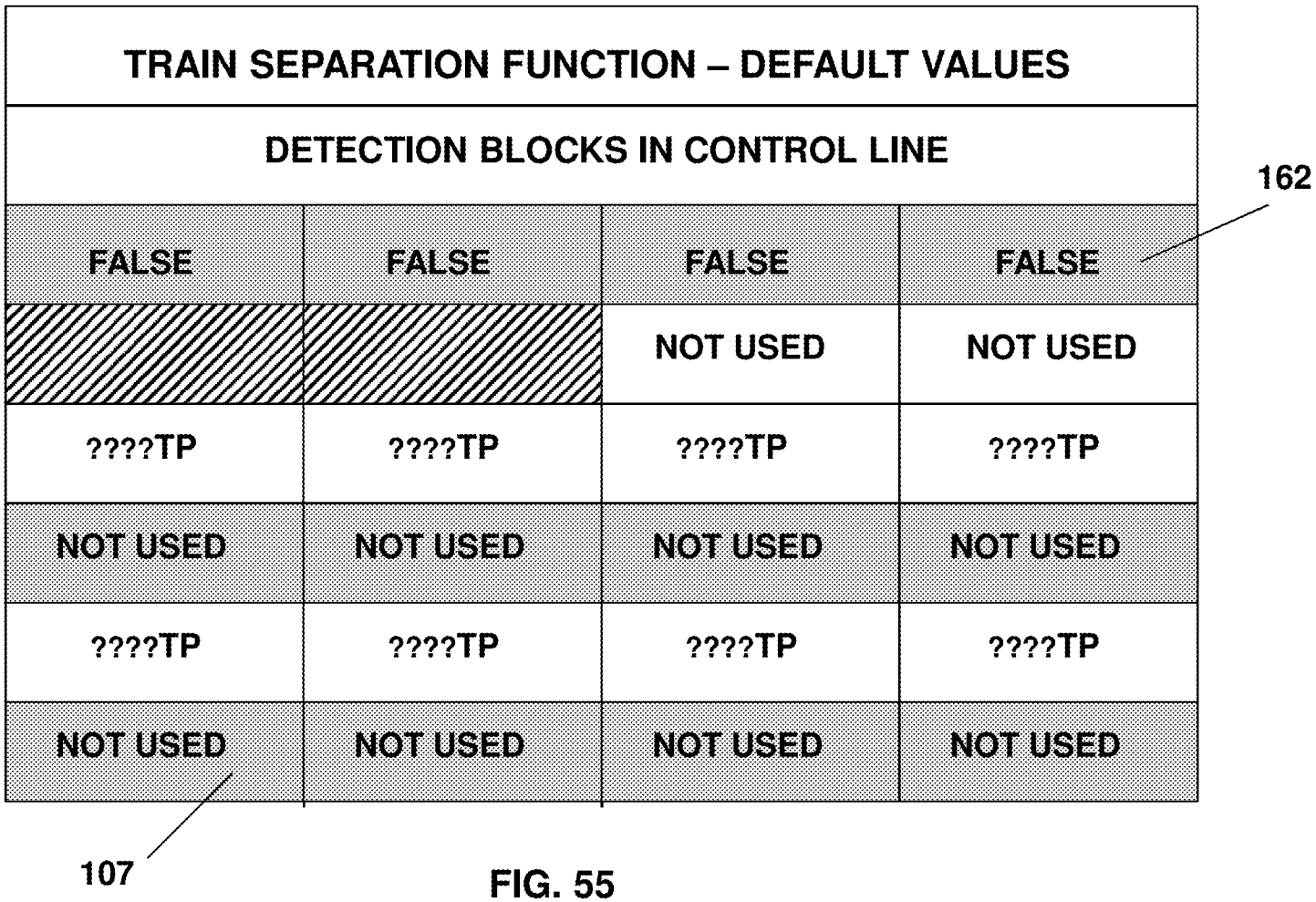
FIG. 55 shows an example of the default values configuration for the train separation function of an automatic signal unit.
Figure 56:
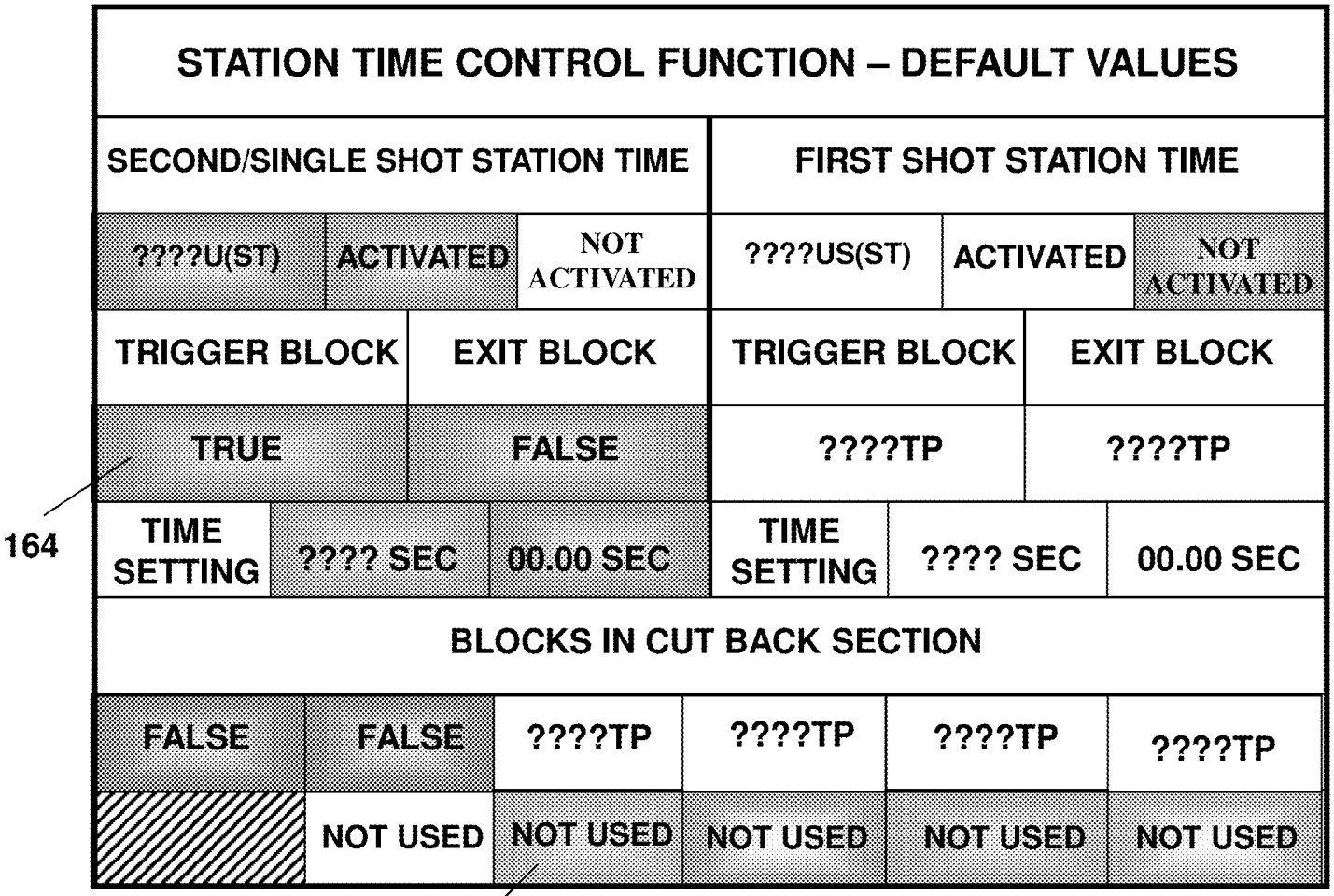
FIG. 56 shows an example of the default values configuration for the station time control function of an automatic signal unit.

All data messages exchanged between the various intelligent signal devices are time stamped, and are processed by vital processor modules to ensure freshness of data received. In the event of communication interruption, or a determination that the data received is not fresh, then default values are assigned to affected import data. Such default values are based on the safe state for each affected input variable. For example, the import data for the status of a track circuit 162 will default to "occupied" ("FALSE") upon loss of communication, or a determination that the received status does not comply with the freshness threshold as shown in FIG. 55. Alternatively, the import data for the status of a track circuit 164 that is used to activate or trigger a timing function (such as grade time or station time) will default to "vacant" ("TRUE") upon loss of communication, or a determination that the received status does not comply with the freshness threshold as indicated in FIG. 56. This means that an import variable could have two different default values if it is used in two different applications.

It should be noted that, and as would be appreciated by one skilled in the art, the wayside data network could be implemented by wireless means using Real Time Communication (RTC) protocols. In such case, each ISD is equipped with a data network that effectively establishes communication through appropriate network architecture to enable the exchange of data between the various ISD's. Such wireless approach has the added advantage of enabling direct communication between CBTC equipped trains, and Intelligent Signal Devices.

Figure 63:
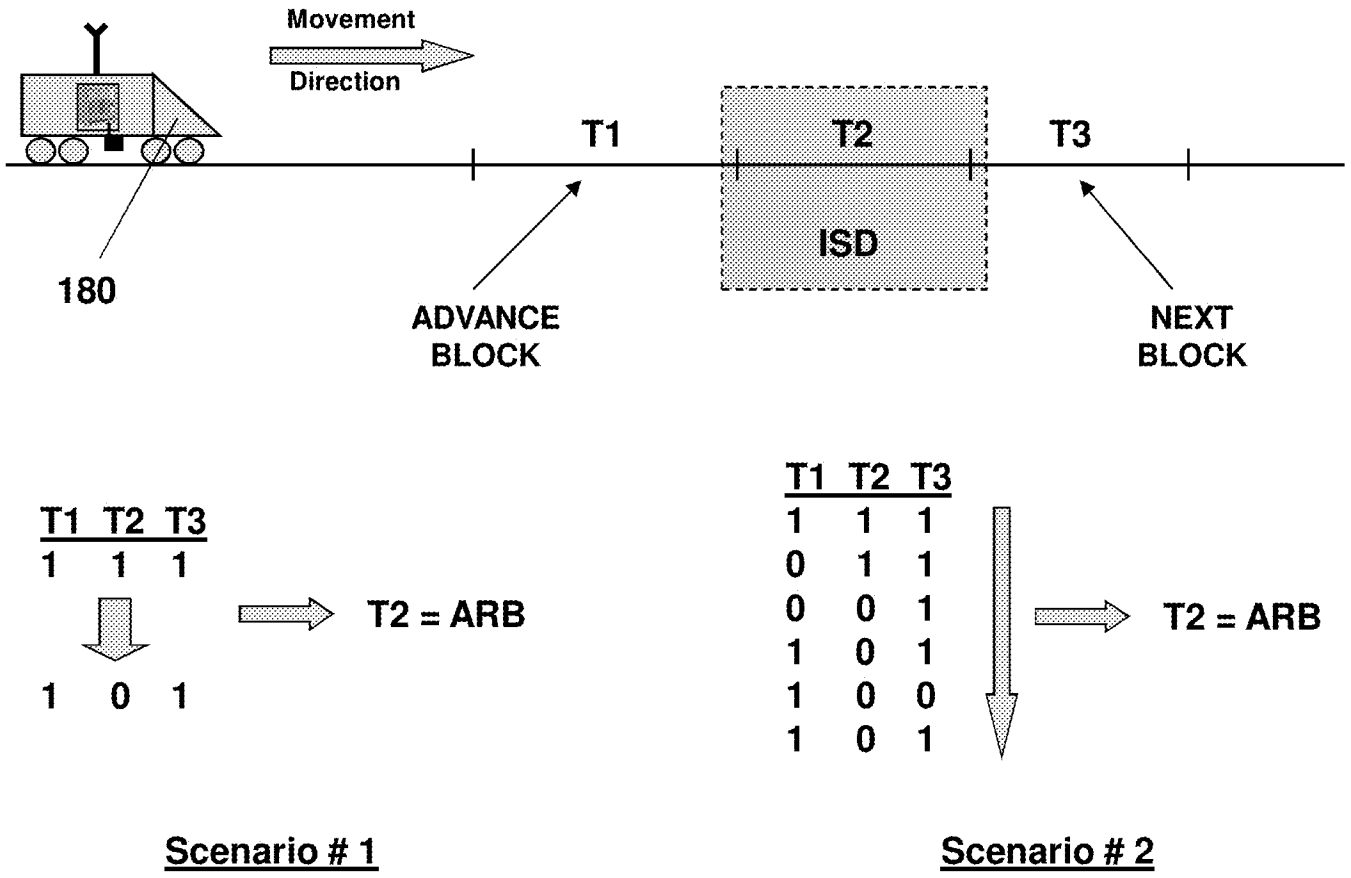
FIG. 63 shows two examples of logic rules (scenarios) for the detection of an always reporting block (ARB) condition for a track circuit.

The allocation of dedicated vital computing resources to specific types of signal equipment, and the concept of intelligent signal devices, makes it feasible to enhance the safety, and operational flexibility of signal installations. The automatic signal unit described in the preferred embodiment provides a number of safety enhancements to train detection, and automatic signal operation. For example, using the computing resources that are dedicated to an automatic signal unit, it is feasible to provide an intelligent track repeater function as shown in FIGS. 46 and 47. It would be possible under certain conditions to differentiate between an actual train in a block, and a failed track circuit. For example, a simple algorithm that detects an "Always Reporting Block" (ARB) condition could be based on comparing sequences of dropping, and activating a plurality of adjacent track circuits. Two simple scenarios are shown in FIG. 63. The two scenarios assume that the length of the train 180 is shorter than each of the three blocks T1, T2 & T3. Also, for the second scenario, the condition that the train 180 was split over T2 (i.e. left one or more cars on T2) is being treated as an ARB condition. Scenario #2 also discounts the unlikely condition that T3 experienced a "Never Reporting Block" condition during the time when the train 180 was spanning both T2 & T3. The ARB algorithm 182 shown in FIG. 47 would include a large number of scenarios that take into account minimum and maximum length of trains, the length of detection blocks T1, T2 & T3, and travel direction. Further, the algorithm would include the appropriate filters to filter out any momentary loss of shunt.

Figure 64:
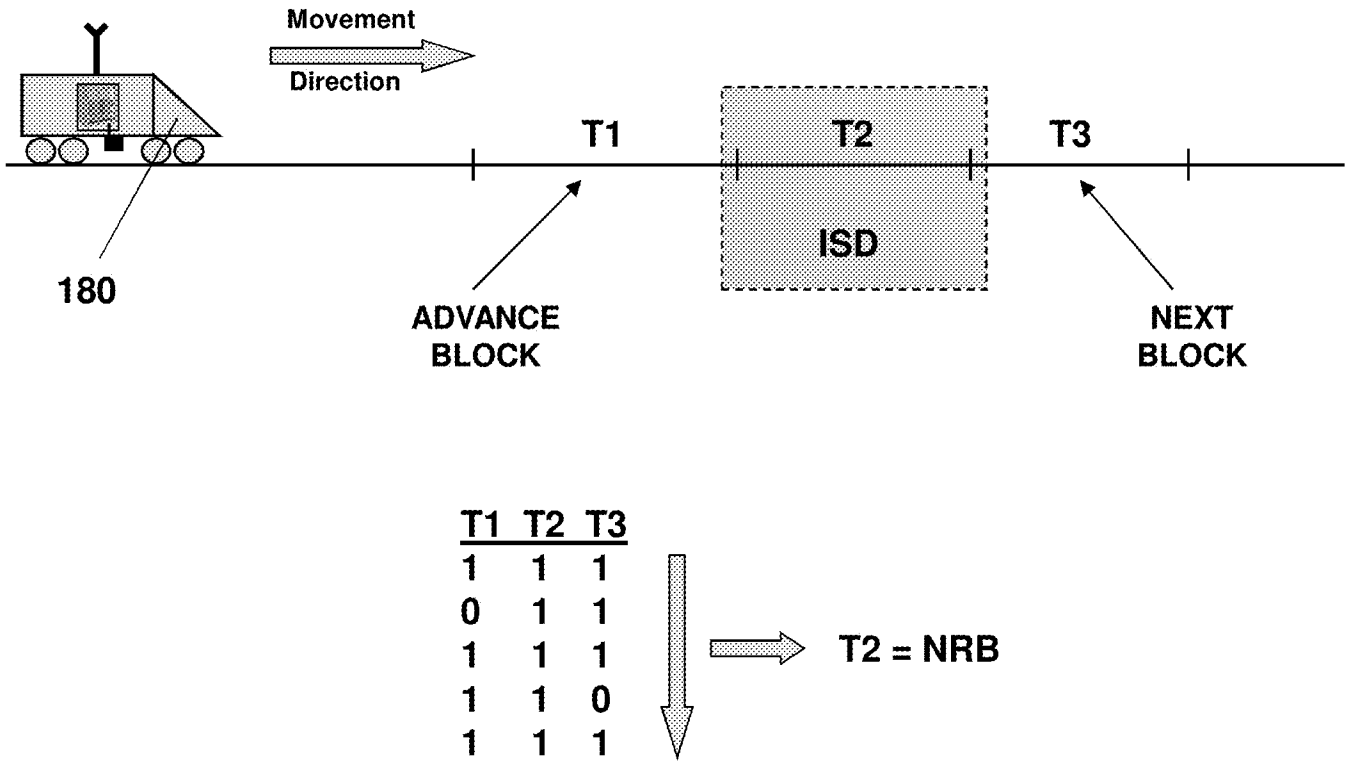
FIG. 64 shows an example of logic rules for the detection of a never reporting block (NRB) condition for a track circuit.

Similarly, it would be possible under certain conditions to detect a "Never Reporting Block" (NRB) by comparing sequences of dropping, and activating a plurality of adjacent track circuits. The example shown in FIG. 64 demonstrates a simple scenario for an NRB condition. The NRB algorithm 135 shown in FIG. 47 would include a large number of scenarios that take into account minimum and maximum length of trains, the length of detection blocks T1, T2 & T3, and travel direction. Also, the algorithm would include the appropriate filters to filter out any momentary loss of shunt. Upon the detection of an NRB condition, the intelligent track repeater relay (ITP) 129 is de-energized as shown in FIG. 46. In that respect, the operation of the NRB function is fail safe. However, it would be very challenging to develop an NRB algorithm that detects 100% of all possible NRB conditions.

Figure 19:
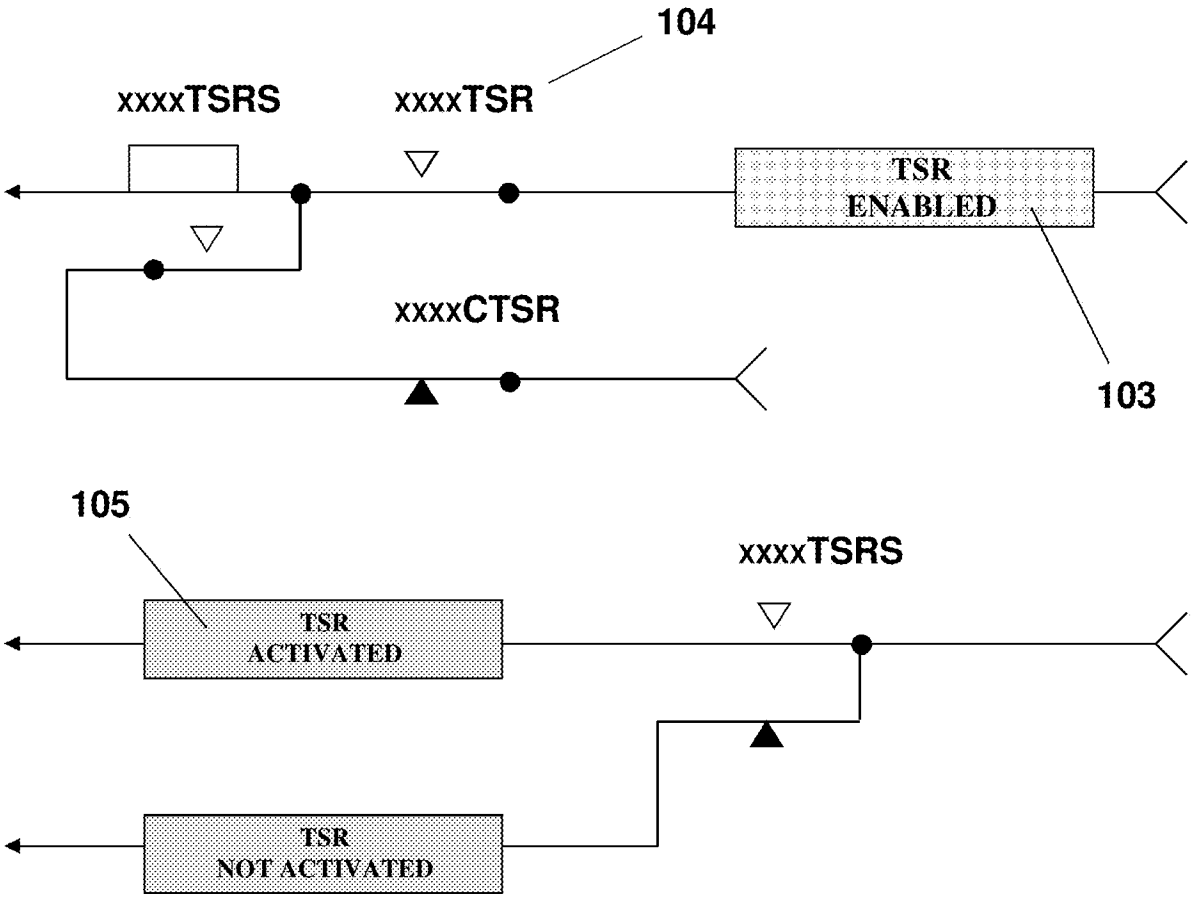
FIG. 19 shows an example of an enabling parameter for a relay logic diagram that provides temporary speed restriction function at an automatic signal unit.
Figure 20:
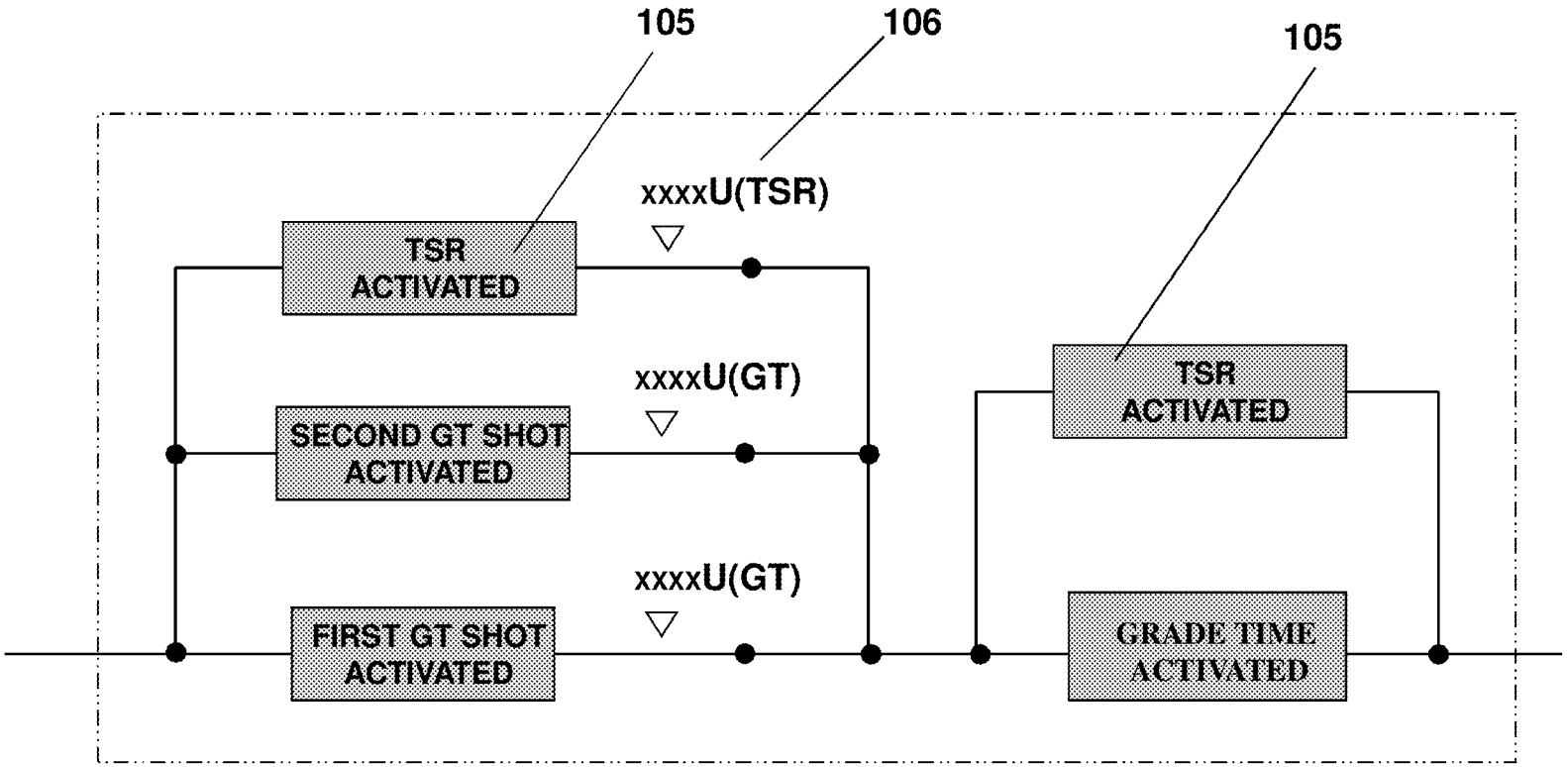
FIG. 20 indicates an example of a parameterized relay logic diagram for the grade time/temporary speed restriction function at an automatic signal unit.
Figure 21:
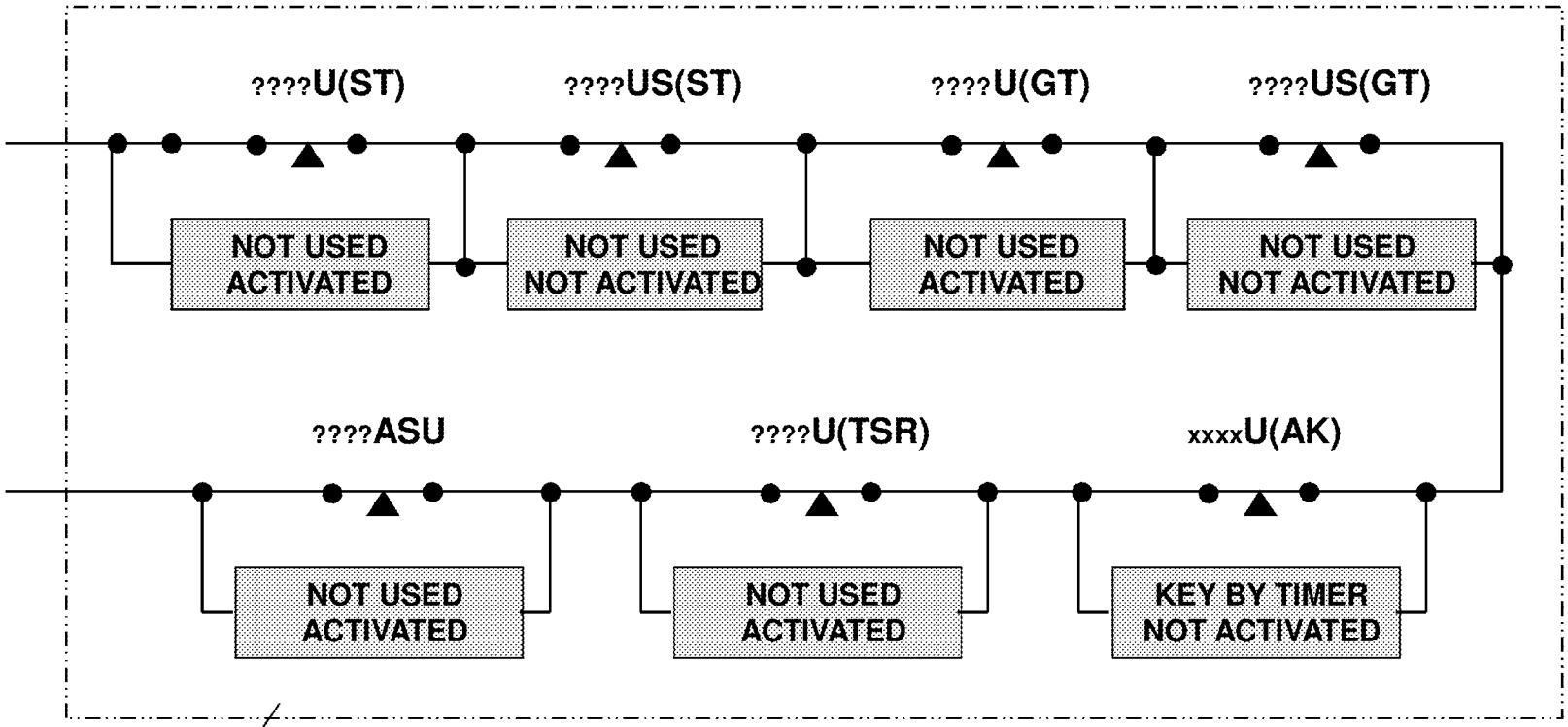
FIG. 21 indicates an example of a parameterized relay logic diagram for a back check timer function at an automatic signal unit.
Figure 22:
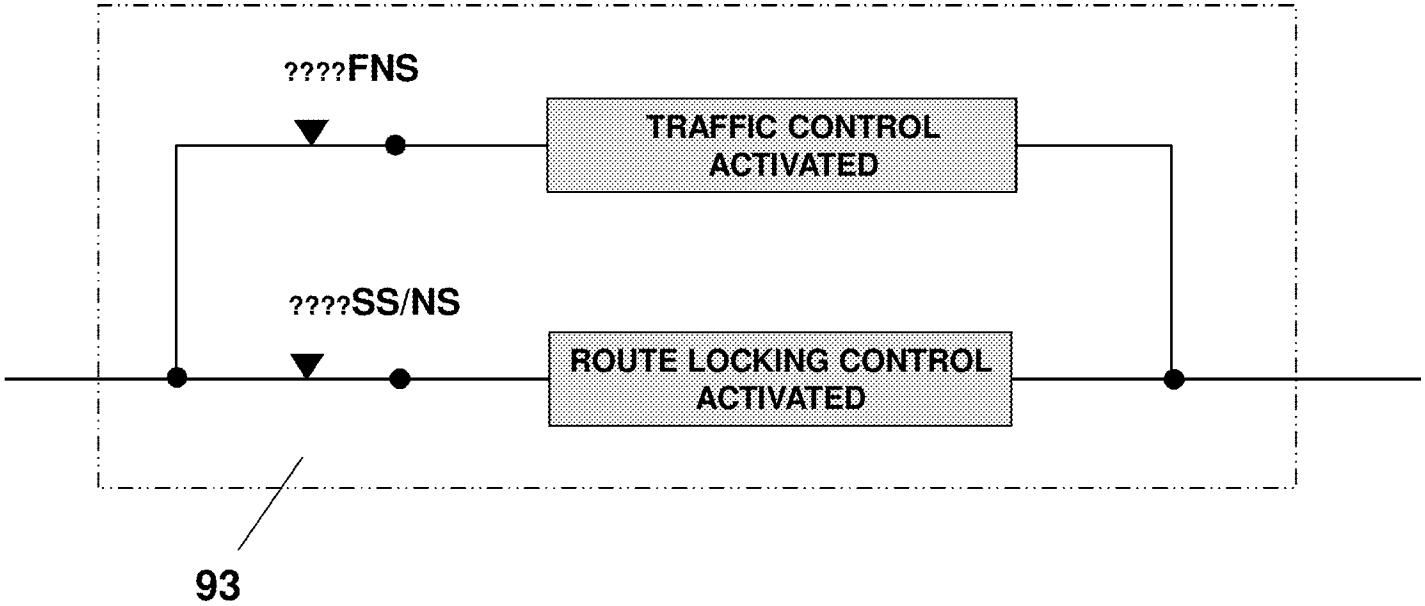
FIG. 22 indicates an example of a parameterized relay logic diagram for a directional control function at an automatic signal unit.
Figure 23:
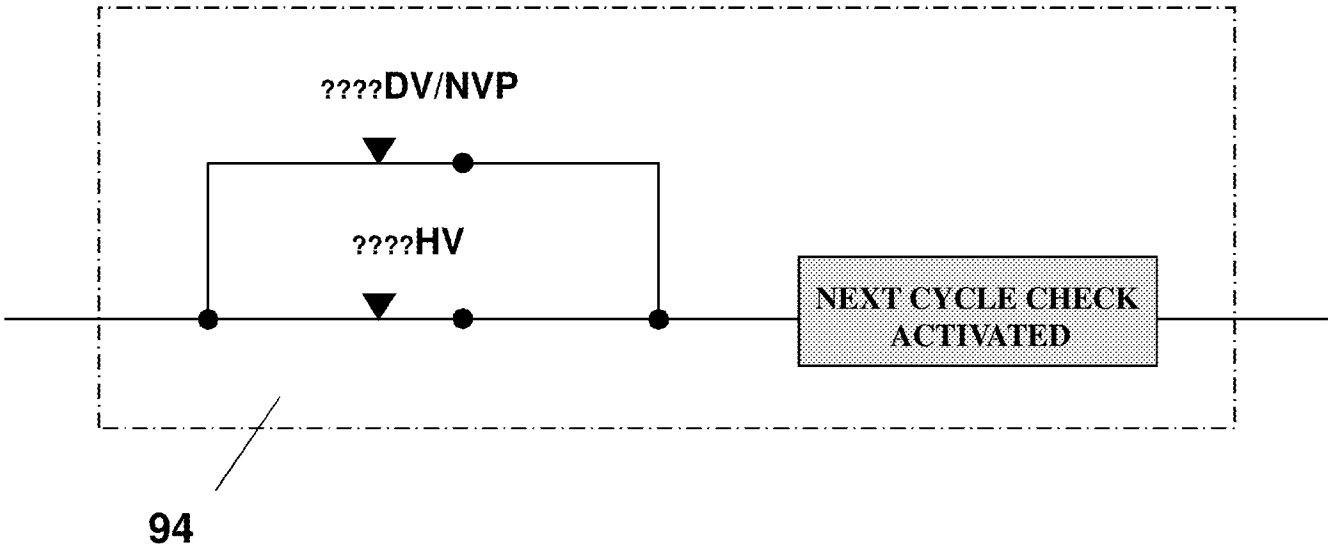
FIG. 23 indicates an example of a parameterized relay logic diagram for a cycle check function at an automatic signal unit.
Figure 24:
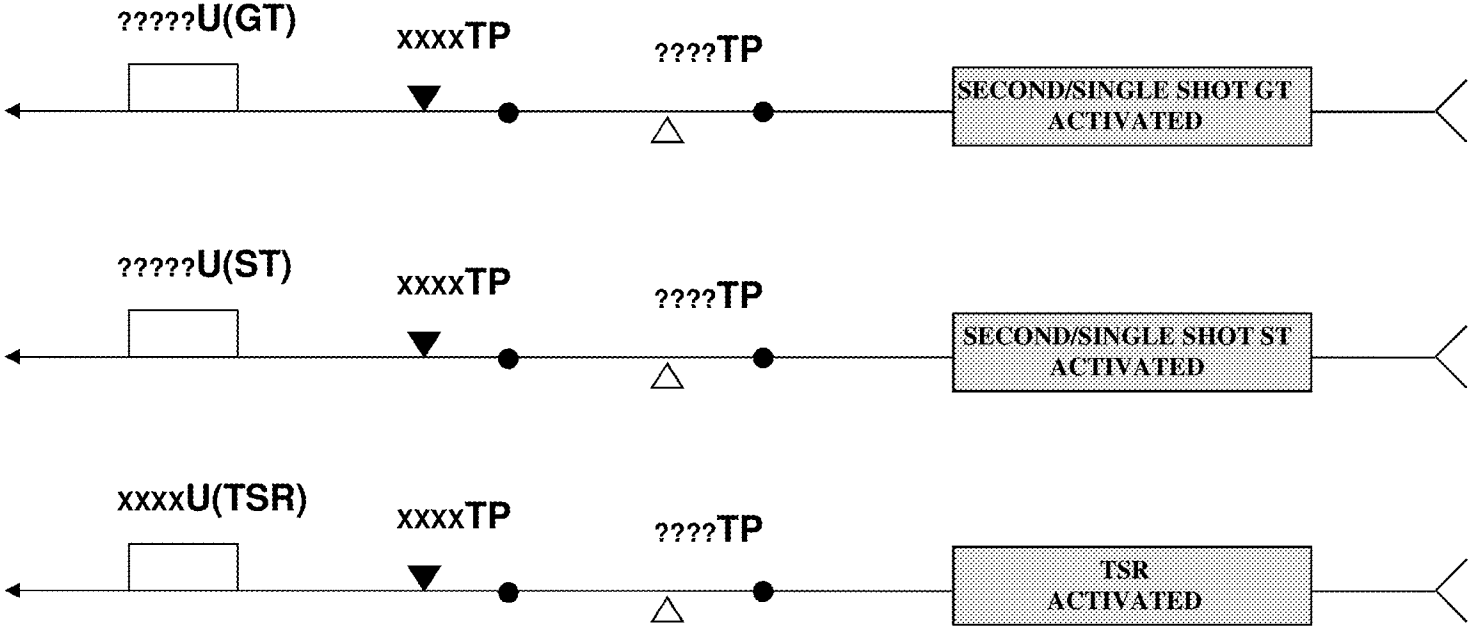
FIG. 24 indicates examples of parameterized relay logic diagrams for various speed control (timer) functions at an automatic signal unit.
Figure 25:
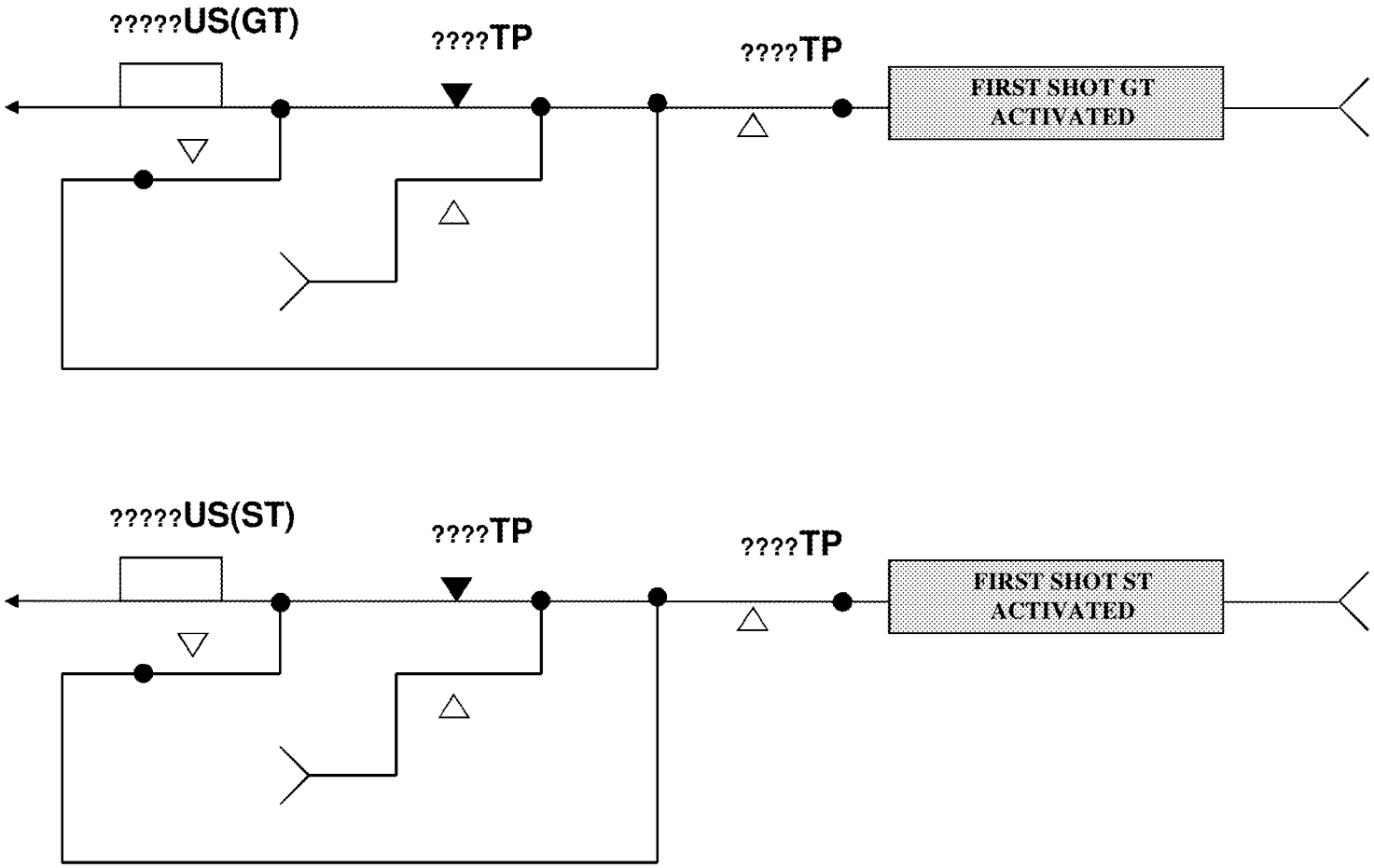
FIG. 25 shows examples of parameterized relay logic diagrams for station time and grade time speed control (timer) functions at an automatic signal unit.

Other safety and operational enhancements provided by the ISD that control the ASU described above include the temporary speed restriction shown in FIG. 19, and the remote key-by capability shown in FIG. 39. Because of the data exchange capability between the ASU and the PLC, it would be possible to enable and disable the key by function from a centralized location, and apply & remove temporary speed restrictions.

Figure 65:
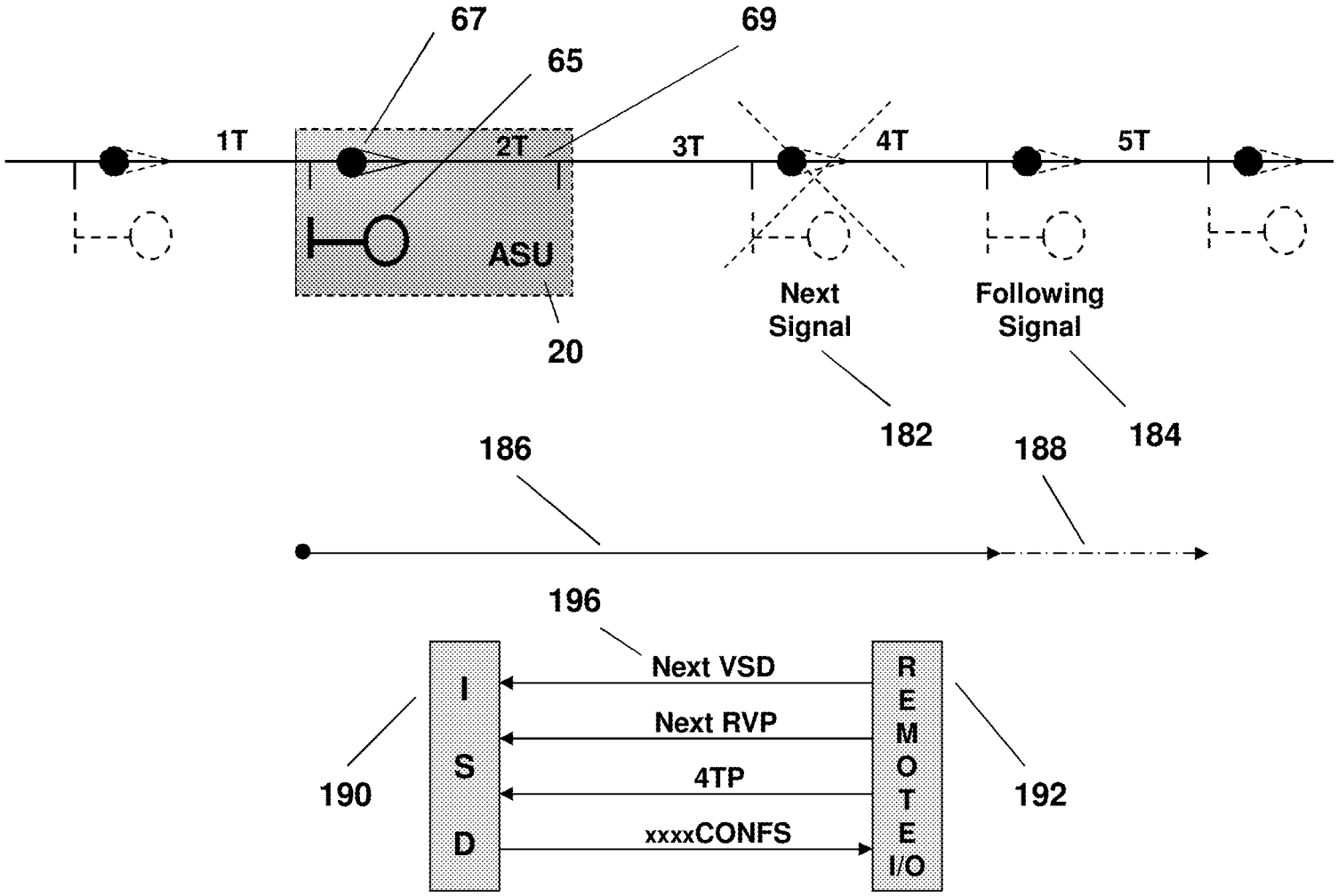
FIG. 65 indicates a failure recovery configuration using a remote I/O of the ISD at an automatic signal unit.
Figure 66:
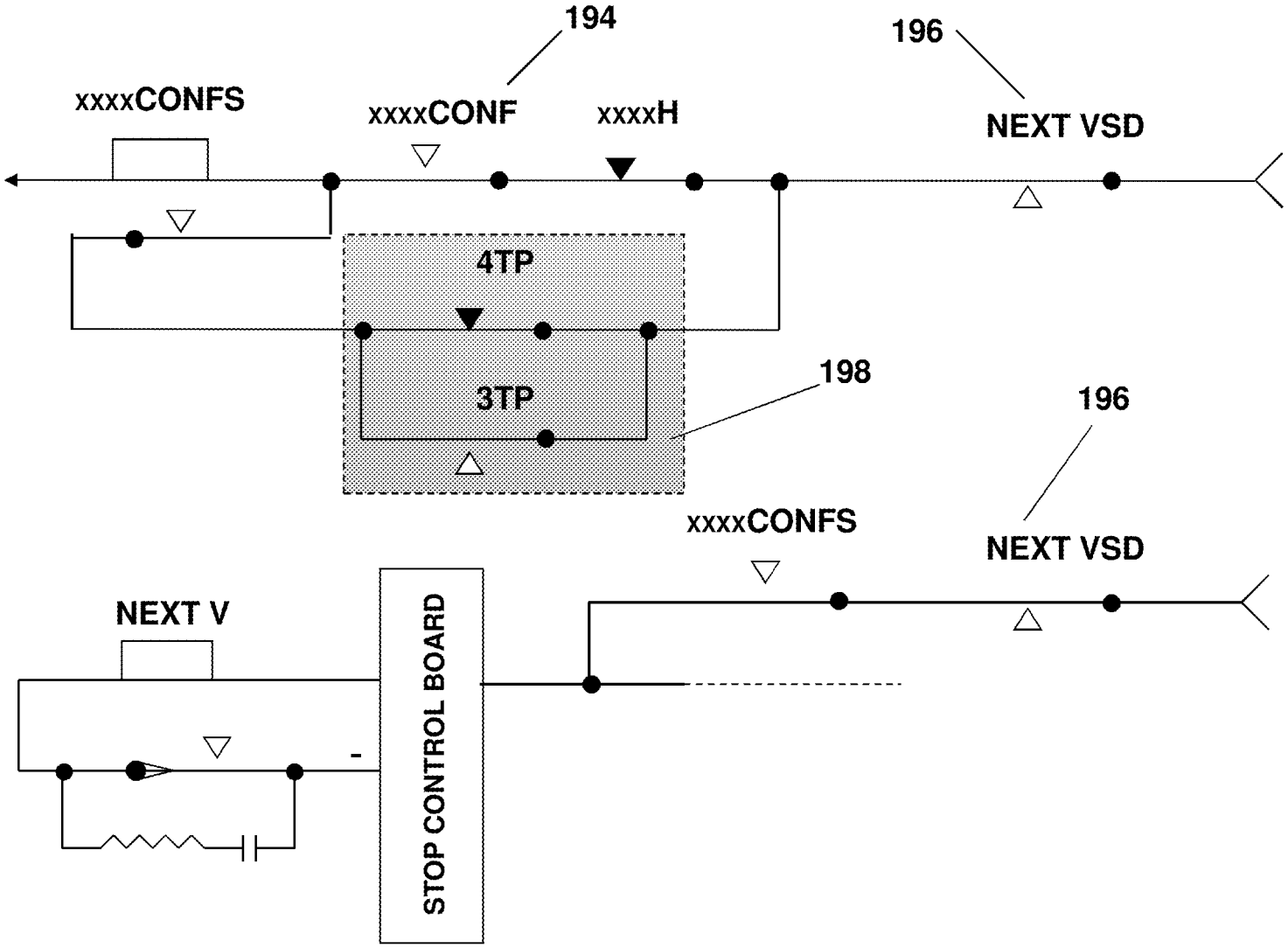
FIGS. 66 and 67 show relay logic control circuits for the implementation of a failure recovery concept at an automatic signal unit.
Figure 67:
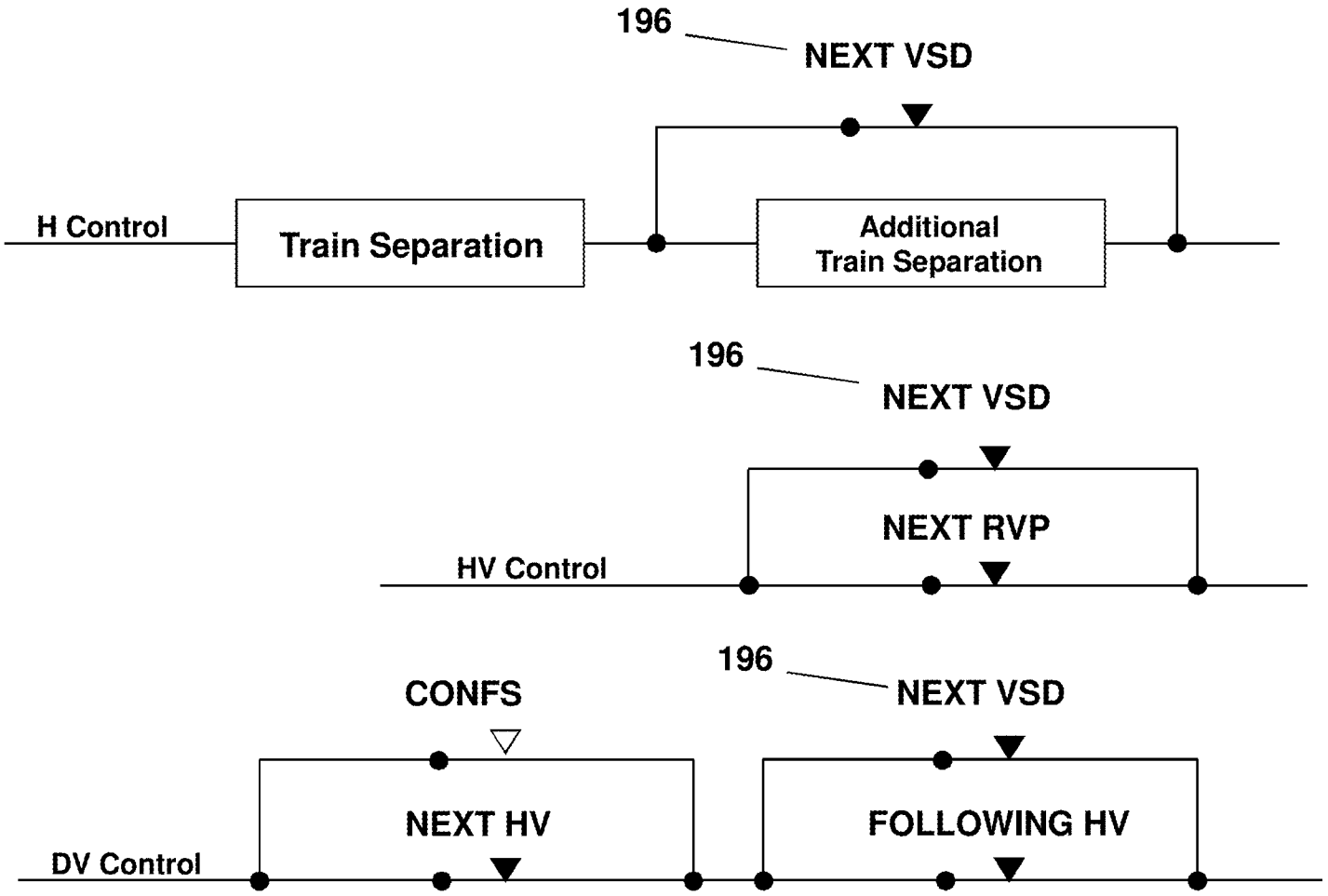

Further, the ISD concept would enable the implementation of dynamic home and distant control functions as illustrated in FIGS. 65, 66 and 67. The dynamic home and distant control functions are based on the new concept of enlarging safe train separation, and extending the distance control limits in real time under certain conditions. For example, as shown in FIG. 65, if the "Next" signal 182 is removed from service (due to failure or other operating reason), then the control line 186 for the automatic signal unit 20 is extended by an appropriate section 188. In such a case the braking distance that governs the length of said extended section 188 is determined by the maximum attainable speed at the following signal 184. This new concept can also be used to increase train separation upon the detection of low adhesion condition.

To implement these dynamic functions, a remote I/O device 192 that is associated with the ISD device 190 at the ASU location is used to exchange data between the ASU location and the "Next" signal location as shown in FIG. 65. The dynamic functions are automatically initiated by the dropping of the vital shut down relay ("Next VSD") 196 at the "Next" signal location as shown in FIGS. 66 and 67. However, to complete the dynamic reconfiguration of the home and distant control functions, a user input "CONF" 194 is required as shown in FIG. 66. A parallel combination of "3TP" and "4TP" 198 is added to the retaining portion of the "CONFS" diagram to ensure that a user input is provided for each train. The modifications to the H, HV & DV controls at the ASU location are indicated in FIG. 67.

The dynamic reconfiguration described herein provides a mean to quickly recover from certain types of failure, and enables train service to continue at normal speed, but with longer headway in the affected area. Another application to this dynamic reconfiguration is to extend both the home and distant controls for all signals in an area upon the detection of low adhesion condition. In such a case, upon the activation of a central control command, dedicated logic at each ASU location will first check that the new home control limit for the signal is clear before implementing the extended home control. This will ensure that the signal is not flashed to a stop aspect when this function is implemented.

It should be noted that the concept of employing a remote I/O device 192 to exchange data between one ASU location and the "Next" signal location (FIG. 65) is being disclosed herein for the purpose of describing the preferred embodiment. As would be appreciated by one skilled in the art, an auxiliary ISD can be used at each ASU location to provide the failure recovery functions, and to communicate with adjacent locations in the event of a failure of the primary ISD at the location. In such a case the auxiliary ISD will communicate the statuses of the track circuit and the train stop to other location, as well as to operate the stop mechanism either for key-by operation, or during the dynamic reconfiguration process. The auxiliary ISD will also provide the vital shutdown function for the main ISD.

It should also be noted that the concept of segregating the vital control logic for a specific type of signal element from the vital control logic of other types of signal elements could be implemented without the use of individual intelligent signal devices. For example, the vital control logic for an interlocking could be configured as a plurality of segments or processes, wherein each segment or process provides the entire logic for a particular signal unit. Also, a separate logic segment would be required for each signal unit location. Further, although said plurality of segments or processes could run on the same hardware resources, they must be logically, and vitally isolated from each other. The only link between these segments is a communication structure that provides a means to exchange data between the segments. Similar to the hardware implementation of intelligent signal devices, each segment or process includes import and export data configurations, as well as input and output data configuration for associated trackside devices. A separate I/O interface module could be provided for each segment or process, and such module could be remotely located in the vicinity of the associated trackside equipment. Furthermore, the process or software segment for each type of signal equipment could be parameterized in order to minimize design and engineering tasks.

Obviously, this configuration of separate software segments on centralized hardware resources will not provide all the benefits provided by intelligent signal devices, however, such configuration has the advantage of providing a structured approach for testing or retesting of a signal installation after the disarrangement of an interlocking. In both the ISD implementation, and the in a centralized configuration that employs isolated software segments, a Vital Change Management Process (VCPM) could be used to determine testing requirements after a modification is made to an existing signal installation.

Figure 68:
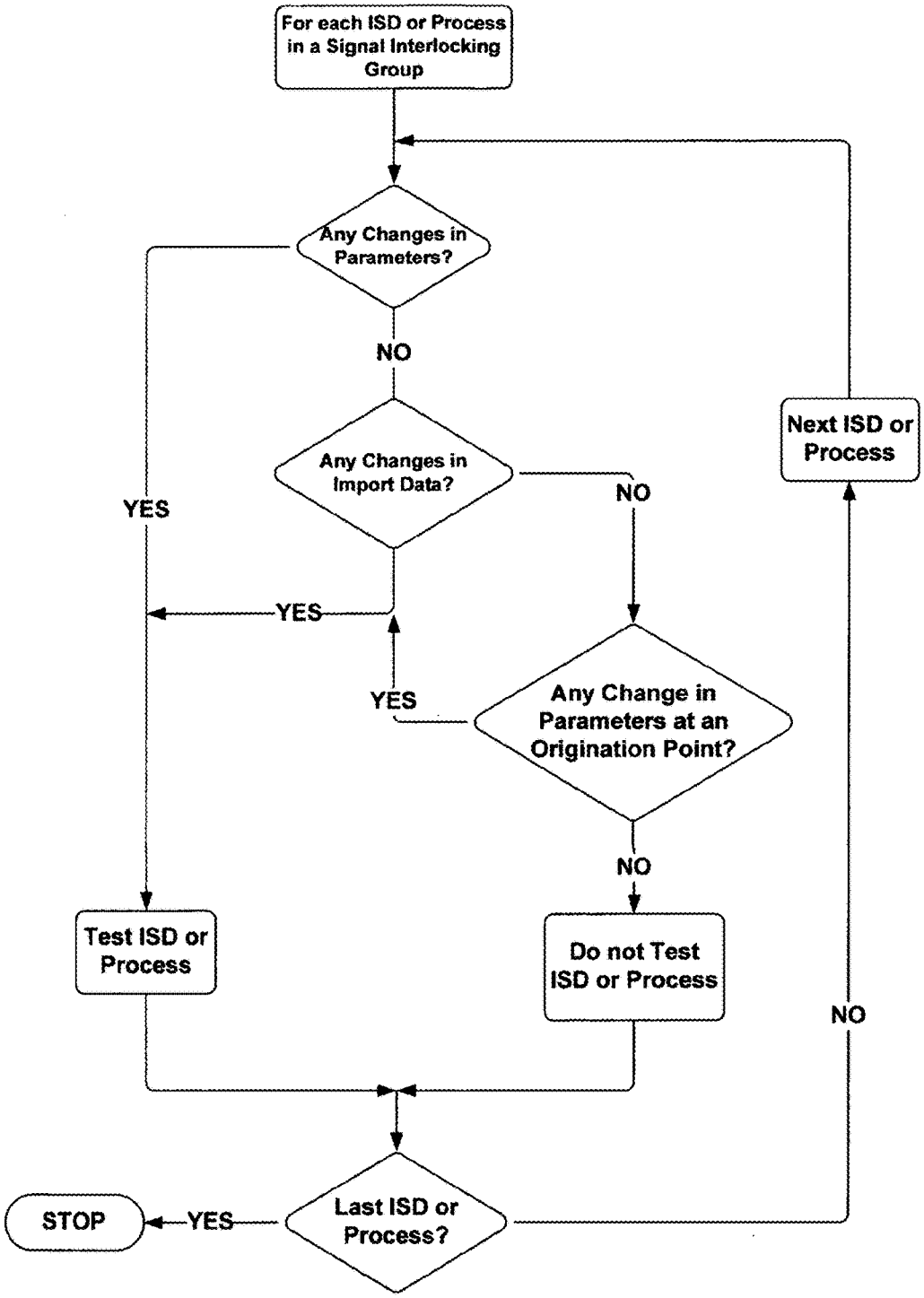
FIG. 68 indicates a logic flow diagram that determines when a particular intelligent signal device or a process needs to be tested after disarrangement of an interlocking.

FIG. 68 provides an example of the logic used to determine which ISD or software segment should be tested after a disarrangement of an interlocking. Because of the logical isolation between the various hardware and/or software segments of a signal installation, only those signal elements that experienced a change in parameters or internal vital logic, a change in the import data configuration, or a change in the parameter configuration or internal logic of one of its providers of import data need to be retested.

As would be understood by those skilled in the art, alternate embodiments could be provided to implement the new concepts described herein. For example, different diagrams could be derived for the control logic associated with an automatic signal unit. Also, different parameters could be used to provide a generic automatic signal unit. Furthermore, many programs may be utilized to implement the logic presented in the various figures herein. Obviously these programs will vary from one another in some degree. However, it is well within the skill of the signal engineer to provide particular programs for implementing each logic for the functions disclosed herein. Further, the concept of using a plurality of parameters to develop a generic signal device could be used with any signal device such as an approach signal, a home signal, a switch, etc. It is also to be understood that the foregoing detailed description has been given for clearness of understanding only, and is intended to be exemplary of the invention while not limiting the invention to the exact embodiments shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. An electronic signal control device that interfaces with wayside signal equipment, which includes at least one of a plurality of signal aspects, an automatic train stop mechanism, a train detection block apparatus, a track switch machine and a traffic controller, comprising:

a data communication module to exchange data with another signal control device, an automatic train supervision server, a programmable logic controller and a computer onboard an approaching train, the programmable logic controller providing non-vital functions, an interface module to interface the device with associated signal equipment, the interface module comprising a plurality of vital I/O boards, each vital I/O board configured to interface with associated signal equipment, the plurality of vital I/O boards including a signal lighting board configured to interface with a signal aspect, the signal lighting board comprising light-out detection function for detection of a light out condition in the signal aspect, and a vital processor with a computer-readable medium encoded with a computer program to monitor an operational state of the associated signal equipment, and to control operation of the associated signal equipment.

2. The electronic signal control device as recited in claim 1, wherein the electronic signal control device communicates the operational state of the associated signal equipment to said approaching train.

3. The electronic signal control device as recited in claim 1, wherein the wayside signal equipment includes a track switch machine, and wherein the electronic signal control device communicates a position of the track switch machine to the approaching train.

4. The electronic signal control device as recited in claim 1, wherein the wayside signal equipment includes a track switch machine, and wherein the electronic signal control device communicates a locking status of the track switch machine to the approaching train.

5. The electronic signal control device as recited in claim 1, wherein the wayside signal equipment includes a plurality of signal aspects, and wherein the electronic signal control device communicates status of the plurality of signal aspects to the approaching train.

6. The electronic signal control device as recited in claim 1, wherein the wayside signal equipment includes a track switch machine, and wherein the electronic control device receives control data from the approaching train.

7. A signal installation comprising:

a plurality of electronic signal devices, each of which interfaces with signal equipment at a signal location, wherein each signal equipment includes at least one of a plurality of signal aspects, an automatic train stop, a train detection block apparatus, a track switch machine and a traffic controller, wherein an electronic signal device includes a communication module, a vital processor module with a computer-readable medium encoded with a computer program that controls the operation of the device, an interface module to interface the device with said signal equipment, the interface module comprising a plurality of vital I/O boards, each vital I/O board configured to interface with associated signal equipment, the plurality of vital I/O boards including a signal lighting board configured to interface with a signal aspect, the signal lighting board comprising light-out detection function for detection of a light out condition in the signal aspect, wherein the electronic signal device receives data via the communication module from an approaching train, and wherein the electronic signal device transmits a status of the signal equipment at the signal location to said approaching train.

8. The signal installation as recited in claim 7, wherein an electronic signal device that interfaces with the track switch machine communicates a position of the track switch machine to the approaching train.

9. The signal installation as recited in claim 7, wherein an electronic signal device that interfaces with the track switch machine communicates a locking status of the track switch machine to an approaching train.

10. The signal installation as recited in claim 7, wherein an electronic signal device that interfaces with a plurality of signal aspects communicates status of the plurality of signal aspects to the approaching train.

11. An electronic signal control device that interfaces with a plurality of signal aspects, wherein the electronic signal control device includes a data communication module, an interface module to interface with the plurality of signal aspects, a vital processor with a computer-readable medium encoded with a computer program to control operation of the electronic signal control device, wherein the interface module comprises a plurality of vital I/O boards including a signal lighting board configured to interface with the plurality of signal aspects, the signal lighting board comprising light-out detection function for detection of a light out condition in the plurality of signal aspects, and wherein the data communication module communicates with an approaching train to receive control data and to transmit to the approaching train status of said plurality of signal aspects.

12. The electronic signal control device as recited in claim 11, wherein the plurality of signal aspects is associated with at least one of an automatic signal, an approach signal and a home signal.

* * * * *